US005787323A

United States Patent [19]

Nomura et al.

[11] Patent Number: 5,787,323

[45] Date of Patent: Jul. 28, 1998

[54] IMAGE FORMING APPARATUS HAVING A DETACHABLY MOUNTABLE PROCESS CARTRIDGE

[75] Inventors: Yoshiya Nomura, Tokyo; Yoshinori Sugiura, Kawasaki; Yoshiro Tsuchiya, Yokohama, all of Japan

[73] Assignee: Canon Kabushiki Kaisha, Tokyo, Japan

[21] Appl. No.: 587,570

[22] Filed: Jan. 17, 1996

Related U.S. Application Data

[63] Continuation of Ser. No. 234,419, Apr. 28, 1994.

[30] Foreign Application Priority Data

Apr. 28, 1993 [JP] Japan ..... 5-123163

[51] Int. Cl.[6] ..... G03G 21/18

[52] U.S. Cl. ..... 399/111; 399/125

[58] Field of Search ..... 399/110, 111, 399/114, 125

[56] References Cited

U.S. PATENT DOCUMENTS

| | | | |
|---|---|---|---|
| 4,500,195 | 2/1985 | Hosono . | |
| 4,668,072 | 5/1987 | Yasuda . | |
| 4,866,482 | 9/1989 | Hirasawa | 355/260 |
| 4,876,572 | 10/1989 | Nagatsuma | 355/210 |
| 4,974,033 | 11/1990 | Yamada et al. | 355/319 |
| 4,978,995 | 12/1990 | Takahashi | 355/206 |
| 5,041,871 | 8/1991 | Hata | 355/200 |
| 5,047,803 | 9/1991 | Kanoto | 355/211 |
| 5,086,316 | 2/1992 | Aoki | 355/200 |
| 5,136,333 | 8/1992 | Craft et al. | 355/211 |
| 5,146,278 | 9/1992 | Kroll et al. | 355/253 |
| 5,155,537 | 10/1992 | Komatsu et al. | 355/309 |
| 5,239,349 | 8/1993 | Hoover et al. | 355/282 |
| 5,300,979 | 4/1994 | Tsukakoshi et al. | 355/200 |
| 5,333,036 | 7/1994 | Koga | 355/200 |

FOREIGN PATENT DOCUMENTS

| | | |
|---|---|---|
| 0406149 | 1/1991 | European Pat. Off. . |
| 0530491 | 3/1993 | European Pat. Off. . |
| 0622696 | 11/1994 | European Pat. Off. . |
| 0622699 | 11/1994 | European Pat. Off. . |
| 0622700 | 11/1994 | European Pat. Off. . |
| 0626624 | 11/1994 | European Pat. Off. . |
| 0632342 | 1/1995 | European Pat. Off. . |

*Primary Examiner*—William J. Royer

*Attorney, Agent, or Firm*—Fitzpatrick, Cella, Harper & Scinto

[57] ABSTRACT

An image forming apparatus, usable with a process cartridge detachably mountable thereto, for forming an image on a recording material includes a mounting device for mounting the process cartridge; an openable member relative to a main assembly of the image forming apparatus; an urging device, provided in the main assembly, for urging the process cartridge when the openable member is closed, and for releasing the process cartridge when the openable member is opened.

57 Claims, 63 Drawing Sheets

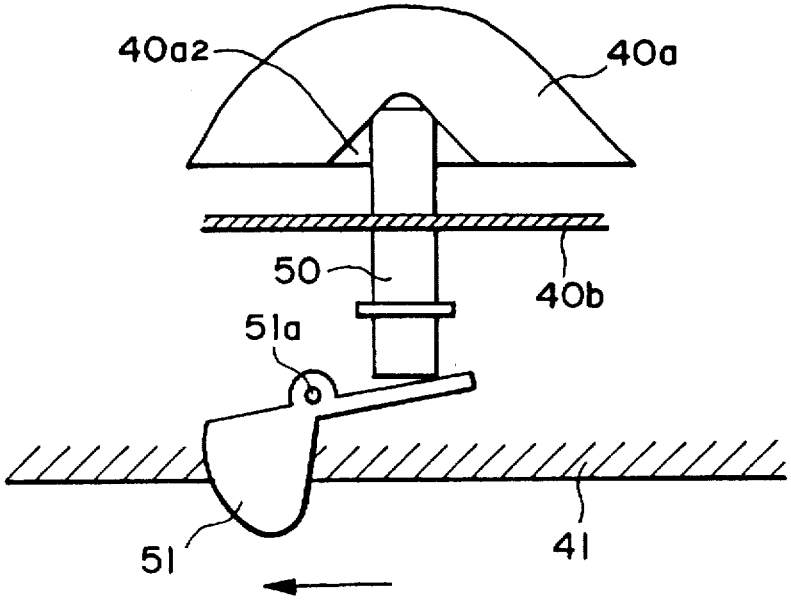
FIG. 65
FIG. 66(b)
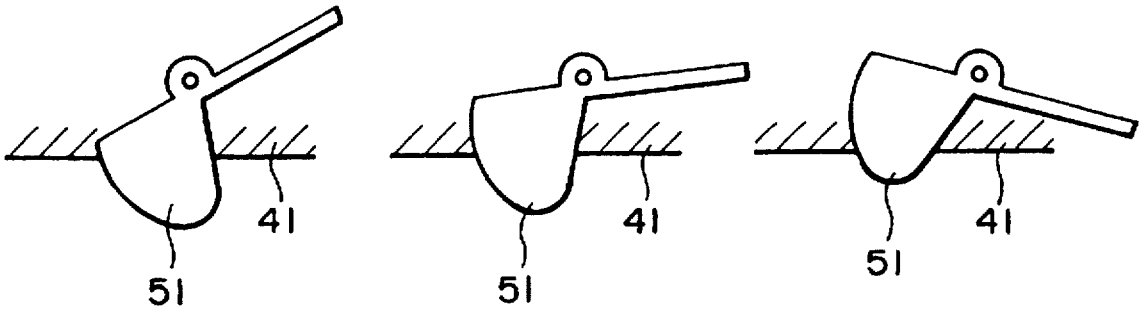
FIG. 66(a) FIG. 66(c)

IMAGE FORMING APPARATUS HAVING A DETACHABLY MOUNTABLE PROCESS CARTRIDGE

This application is a continuation of application Ser. No. 08/234,419 filed Apr. 28. 1994.

FIELD OF THE INVENTION AND RELATED ART

The present invention relates to an image forming apparatus usable with a process cartridge detachably mountable thereto, for forming an image on a recording material.

The image forming apparatus includes, for example, a laser beam printer, an LED printer, an electrophotographic copying machine, a facsimile machine, a word processor and the like.

In an image forming apparatus such as a printer, a uniformly charged image bearing member is selectively exposed to light so that a latent image is formed. The latent image is visualized with a toner into a toner image, which is transferred onto a recording material. In such an apparatus, the toner has to be supplied each time the toner is used up. The toner supplying operation is cumbersome, and also, contamination results. Maintenance operation for various members has to be performed by an expert service man with the result of inconveniencing of the user.

Under the circumstances, a proposal has been made that the image bearing member, a charger, a developing device, a cleaning device or the like are unified into a cartridge, which is loaded into the main assembly by the user, by which the toner supply, the exchange of members such as image bearing member having reached the end of the service life, can be all together exchanged, thus facilitating the maintenance operation. The process cartridge is disclosed in U.S. Pat. Nos. 3,985,436, 4,500,195, 4,540,268, 4,627,701 and so on. As for such an image forming apparatus usable with the process cartridge, a cartridge mounting portion is provided in an openable member which is openable relative to the main assembly. After the cartridge is set to the mounting portion, the openable member is closed, as disclosed in U.S. Pat. No. 4,873,548.

In such an apparatus, the cartridge is required to be fixed to prevent play of the cartridge when the openable member is closed. However, with the structure in which the process cartridge is set to the openable member, a large space is required by a member urging the cartridge in the main apparatus.

When the member is closed, a drum gear of the image bearing member and a driving gear of the main assembly for transmitting driving force to the image bearing member, are meshed. At this time, the direction of the meshing pressure angle between the gears is required to be directed downwardly beyond a horizontal axis. With this structure, when the member is opened and the cartridge is taken out, the engagement between the gears prevents the take-out action, and therefore, the driving gear is required to be provided with a one-way clutch permitting reverse motion. This increases the number of parts.

On the other hand, when the mounting portion of the process cartridge is provided in the main assembly and an openable member is closed after the cartridge is mounted in the main assembly, the cartridge is pushed simultaneously with insertion of the cartridge into the main assembly. However, with such a structure, the cartridge is inserted while being subjected to the load by the urging means, and therefore, cartridge insertion is difficult. Additionally, discriminating whether the cartridge is inserted to the predetermined position or not is difficult.

SUMMARY OF THE INVENTION

Accordingly, it is a principal object of the present invention to provide an image forming apparatus of improved operability upon the mounting of the process cartridge.

It is another object of the present invention to provide an image forming apparatus in which an operability upon the demounting of the process cartridge from the apparatus, is improved.

It is a further object of the present invention to provide an image forming apparatus in which load produced upon mounting of the process cartridge into the main assembly, is reduced.

It is a yet further object of the present invention to provide an image forming apparatus in which no load is applied to the cartridge by urging means upon insertion of the cartridge, and the cartridge can be easily taken out without increase of the number of parts.

These and other objects, features and advantages of the present invention will become more apparent upon a consideration of the following description of the preferred embodiments of the present invention taken in conjunction with the accompanying drawings.

BRIEF DESCRIPTION OF DRAWINGS

FIG. 65 is a plan view of a locking lever mechanism of the alternative embodiment of the pressure generating structure based on the drum shutter.

FIGS. 66(*a*), (*b*) and (*c*) depict the state of the locking lever in the alternative embodiment of the pressure generating structure based on the drum shutter.

DESCRIPTION OF THE PREFERRED EMBODIMENTS

Embodiment 1

A process cartridge according to the first embodiment of the present invention, and an image forming apparatus comprising such a process cartridge will be described, referring to drawings.

{General Description of Process Cartridge and Image Forming Apparatus Comprising Such Process Cartridge}

First, referring to FIGS. 1–5, an overall structure of an image forming apparatus will be described in general terms.

Figure 1:
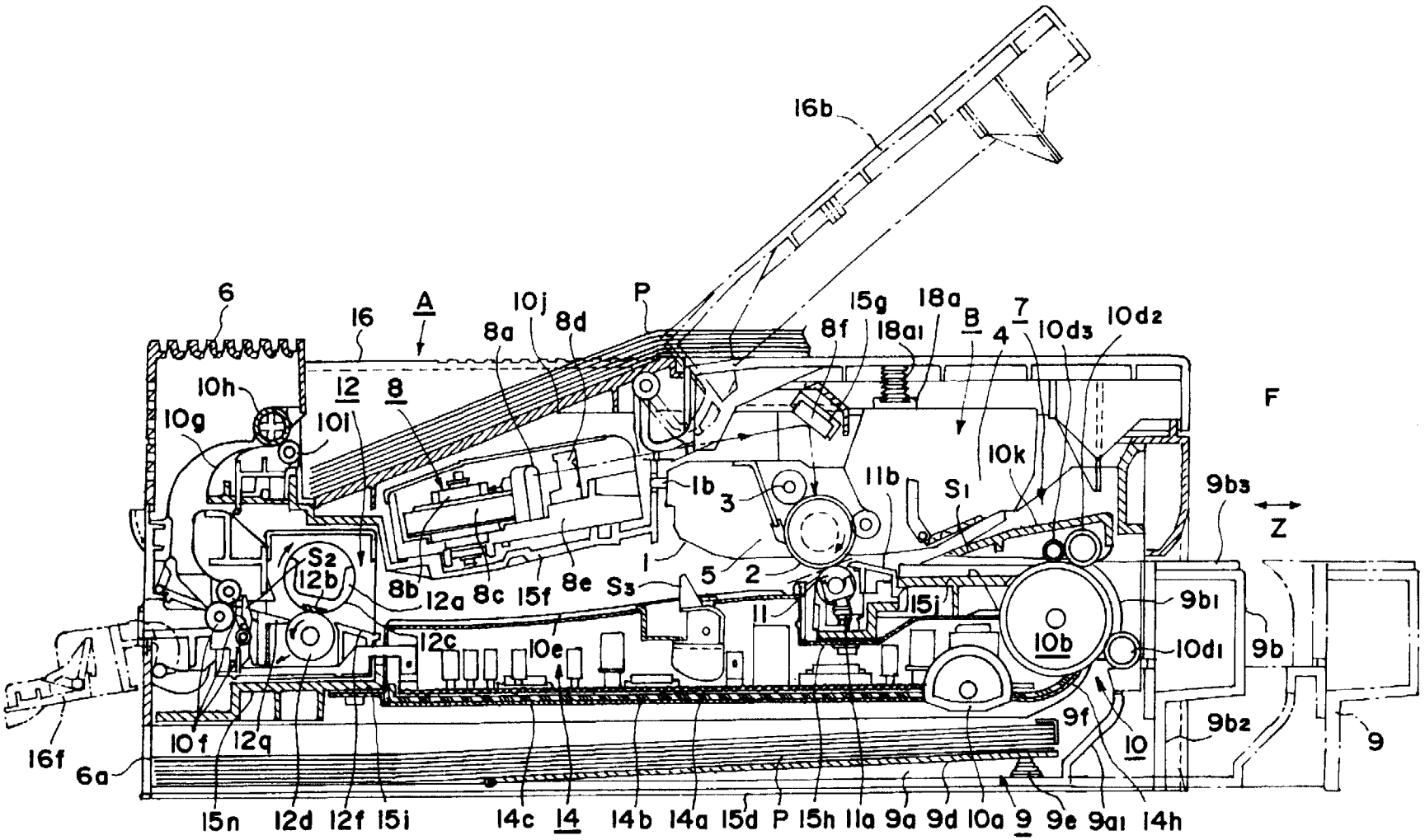
FIG. 1 is a sectional view of an embodiment of the image forming apparatus according to the present invention, depicting the general structure.

FIG. 1 is a sectional view of a laser printer, a typical image forming apparatus, comprising a process cartridge.

Figure 2:
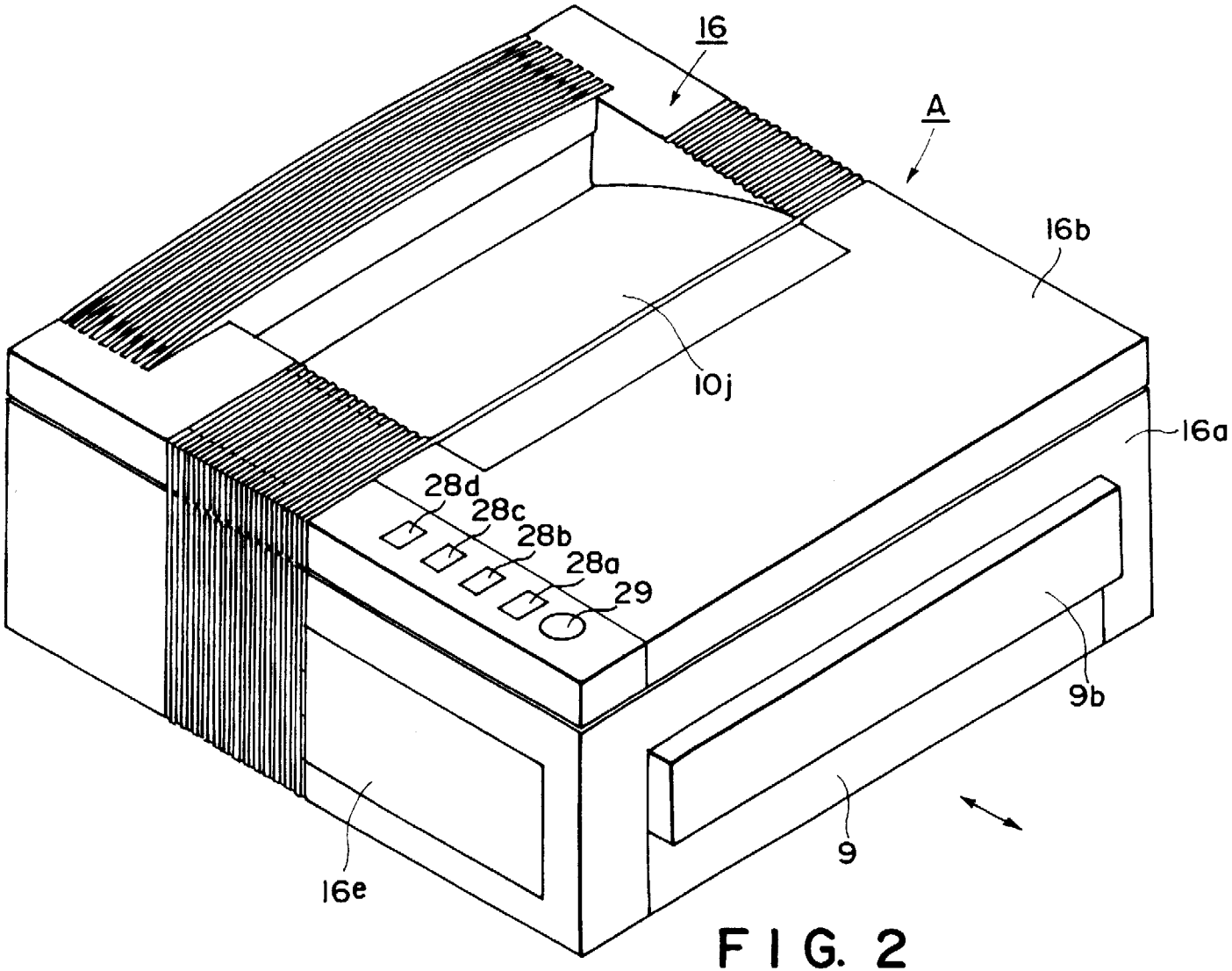
FIG. 2 is an oblique external view of the same image forming apparatus as the one in FIG. 1.
Figure 3:
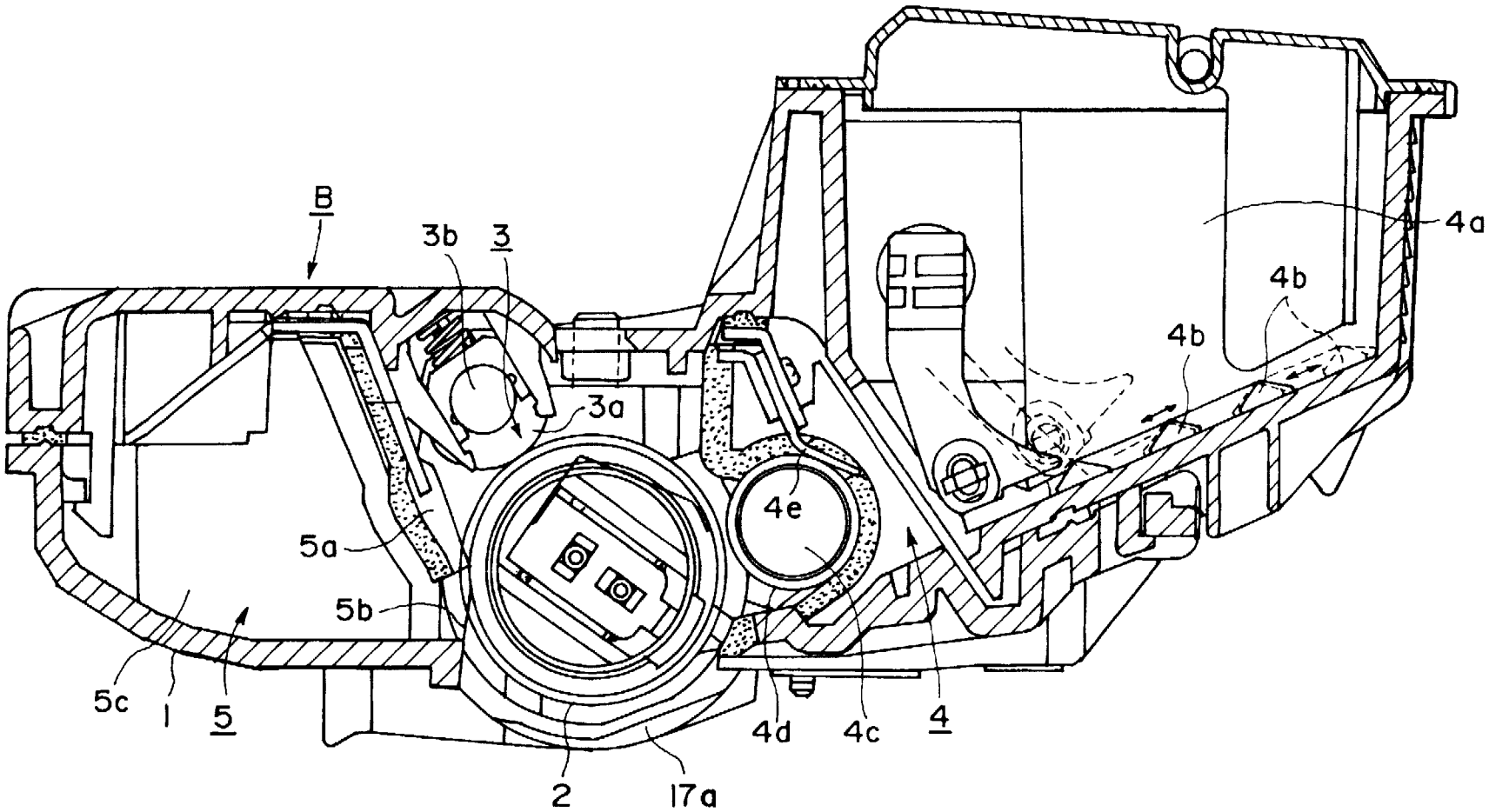
FIG. 3 depicts the structure of a process cartridge.
Figure 4:
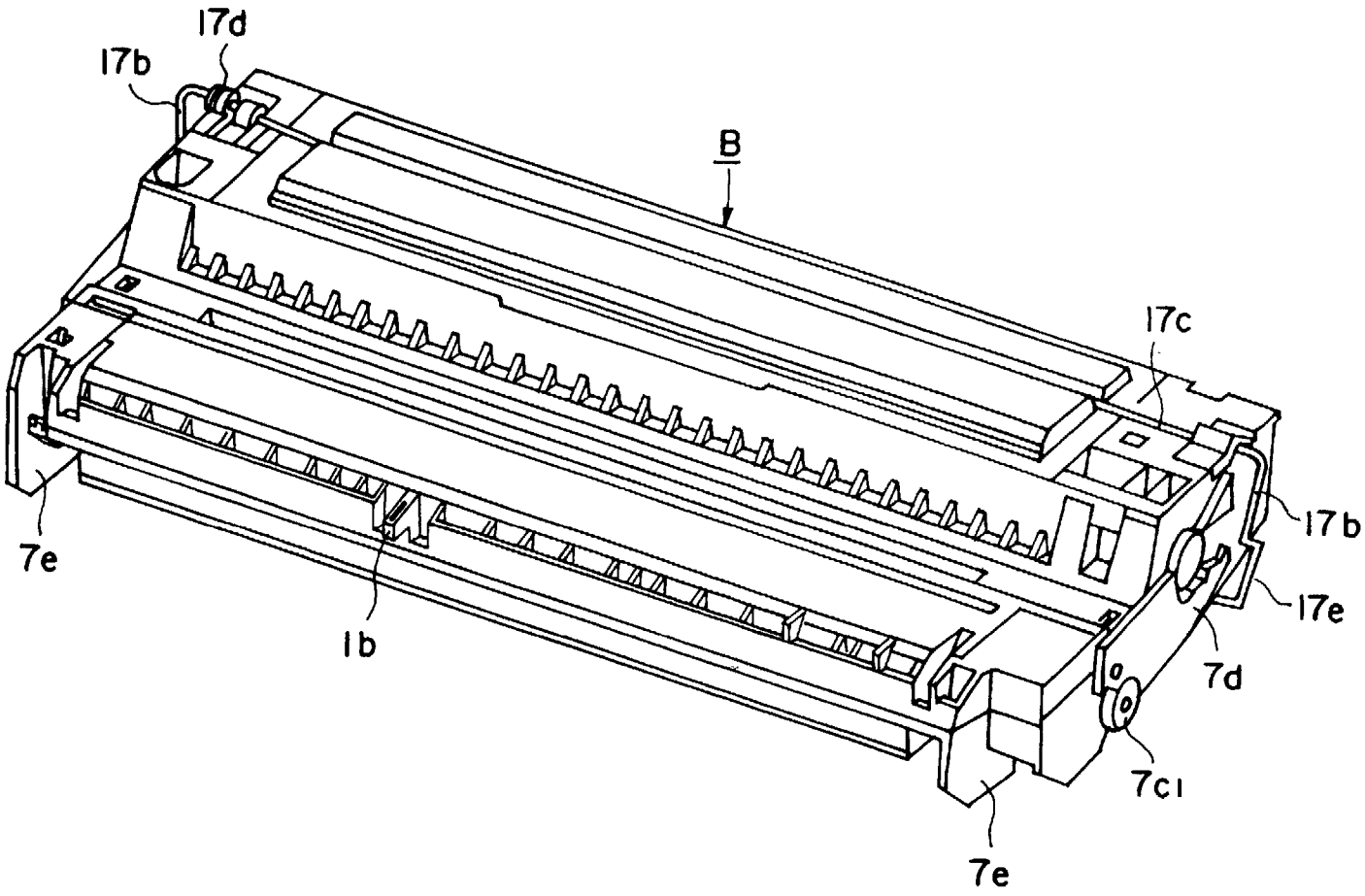
FIG. 4 is an oblique external view of the process cartridge.
Figure 5:
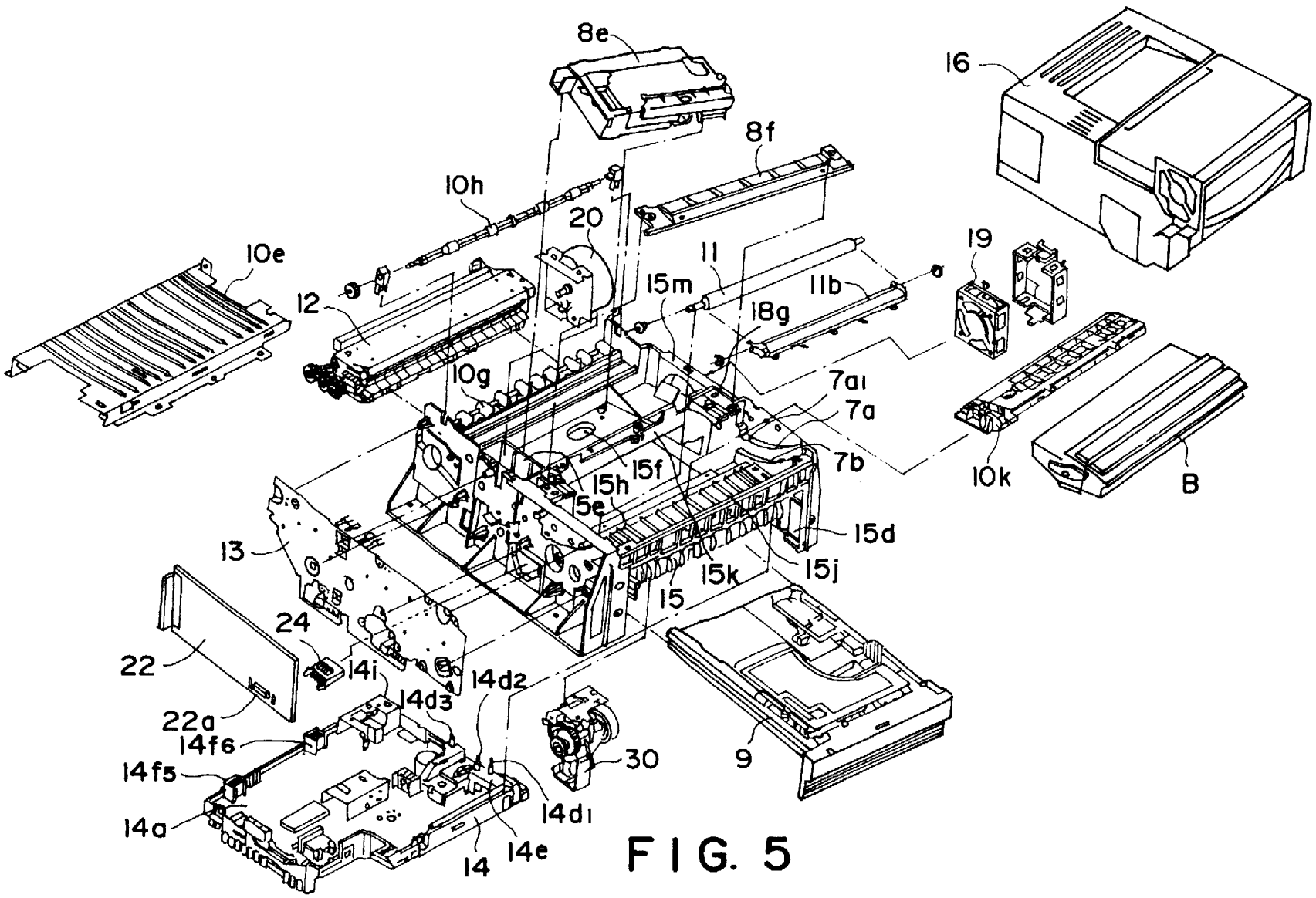
FIG. 5 is an exploded view of the image forming apparatus, depicting how various components are assembled together.

FIG. 2 is an oblique external view of the laser printer. FIG. 3 is a sectional view of the process cartridge. FIG. 4 is an oblique external view of the process cartridge. FIG. 5 is an exploded view the laser printer, depicting how the various components are assembled into the frame.

Referring to FIG. 1, this image forming apparatus A is used with a process cartridge B to form electrophotographically images, wherein a device for recording the images on a recording medium P has been downsized to an extraordinary degree.

The process cartridge B comprises a photosensitive drum 2 as an image bearing member on which a latent image is formed as it is exposed to an optical image which reflects image data, a charging means 3 for charging uniformly the surface of the photosensitive drum 2, a developing means 4 for developing the latent image, with a developer (hereinafter, toner), into a visible toner image, and a cleaning means for removing the residual toner on the surface of the photosensitive drum 2 after the toner image is transferred onto the recording medium P, wherein they are integrally assembled into a frame 1, in such a manner that the photosensitive drum 2 is surrounded by the rest, constituting thereby a cartridge.

On the other hand, the image forming apparatus A is provided with an installing means 7 for installing the process cartridge B into the apparatus main assembly 6. In the top portion of the apparatus main assembly 6, an optical system 8 is disposed for projecting onto the photosensitive drum 1 an optical image bearing the image data, and at the bottom, a cassette installation space is provided for accommodating a cassette 9 in which the recording medium P is stored. The recording medium P stored in the cassette 9 is fed out one by one by a conveying means 10.

Further, the apparatus main assembly 6 is provided with a transferring means 11 for transferring onto the recording medium P the toner image formed on the photosensitive drum 2, and a fixing means 12 for fixing the toner image having been transferred onto the recording medium P, wherein the transferring means 11 is disposed so as to face the photosensitive drum 2 and the fixing means 12 is disposed on the downstream side of the transferring means 11, relative to the direction in which the recording medium is conveyed.

Referring to FIGS. 1–5, on the internal surface of the apparatus main assembly, a gear unit 13 for transmitting the driving force of a main motor 20 is disposed, and above the cassette 9, an electrical component unit 14 for controlling the main motor 20 or the like is disposed, wherein all of the aforementioned components are mounted on a frame 15, being assembled as a unit, and are covered with an external case 16.

The structures of various components within the process cartridge B will be described in detail, along with those within the image forming apparatus A for forming images in cooperation with the process cartridge B having been installed in it.

{Process Cartridge}

To begin with, the structures of the various components of the process cartridge B will be described in the order of the photosensitive drum 2, charging means 3, developing means 4, and cleaning means 5.

(Photosensitive Drum)

The photosensitive drum 2 in this embodiment comprises a cylindrical aluminum drum as a base member, and an organic photosensitive layer coated on the circumferential surface of the base member. This photosensitive drum 2 is rotatively mounted on the frame 1 and is rotated in the direction indicated by an arrow in FIG. 1 by a driving force transmitted to a gear affixed to one of the longitudinal ends of the photosensitive drum 2, from the main motor 20 mounted on the apparatus main assembly side.

(Charging Means)

Referring to FIG. 3, the charging means 3 in this embodiment is based on so-called contact charging method in which a charging roller 3*a* mounted rotatively on the frame 1 is placed in contact with the photosensitive drum 2. The charging roller 3*a* comprises a metallic roller shaft 3*b*, an electrically conductive elastic layer placed thereon, a high resistance elastic layer laminated thereon, and a protecting film coated thereon. The electrically conductive layer is of elastic rubber material such as EPDM, NBR, or the like with dispersed carbon, and functions to conduct a bias voltage supplied to the roller shaft 3*b*. The high resistance elastic layer is of urethane rubber or the like in which an extremely small amount of electrically conductive micro-particle powder is contained, and functions to restrict leakage current, which flows through pin holes or the like of the photosensitive drum 2 being in contact with the highly conductive charging roller, so that the bias voltage is prevented from dropping suddenly. The protective layer is of N-methylmethoxy nylon, and functions to prevent the surface of the photosensitive drum 2 from being deteriorated by coming into contact with the plastic material of the electrically conductive elastic layer or high resistance elastic layer.

When the image is formed, a superposed voltage composed of a DC voltage and an AC voltage is applied to the charging roller 3*a*, being placed in contact with the photosensitive drum 2 and rotated by the rotation of the photosensitive drum 2, whereby the surface of the photosensitive drum 2 is uniformly charged.

(Developing Means)

Referring to FIG. 3, the developing means 4 is provided with a toner storage 4*a* for storing toner, and in the toner storage 4*a*, a toner feeding member 4*b* is provided, which reciprocates in the direction indicated by an arrow to feed the toner. The developing means 4 is also provided with a developing sleeve 4*d*, which contains a magnet 4*c* and is disposed so as to face the photosensitive drum 2, with a macro-gap between them. As the developing sleeve is rotated, a thin toner layer is formed on it.

While the toner layer is formed on the surface of the developing sleeve 4*d*, a sufficient amount of frictional charge potential for developing the electrostatic latent image on the photosensitive drum 2 is obtained through the friction between the toner and the developing sleeve 4*d*. Also, the developing means 4 is provided with a developing blade 4*e* for regulating the thickness of the toner layer.

(Cleaning Means)

Referring to FIG. 5, the cleaning means 5 comprises a cleaning blade 5*a*, a receptor sheet 5*b*, and a waste toner storage 5*c*. The cleaning blade 5*a* is placed in contact with the surface of the photosensitive drum 2 and scrapes off the residual toner on the photosensitive drum 2. The receptor sheet 5*b* is disposed below the cleaning blade 5, contacting gently on the surface of the photosensitive drum 2 in order to scoop up the scraped-off toner. The waste toner storage 5*c* stores the waste toner scooped up by the receptor sheet 5*b*.

{Image Forming Apparatus}

Next, the structure of the image forming apparatus A will be described referring to the cartridge installing means 7, optical system 8, cassette 9, recording medium conveying means 10, transferring means 11, fixing means 12, gear unit 13, electrical component unit 14, cooling fan 19, frame 15, and external case 16, in this order.

(Cartridge Installing Means)

<Structure of Process Cartridge Installation Guide>

Figure 6:
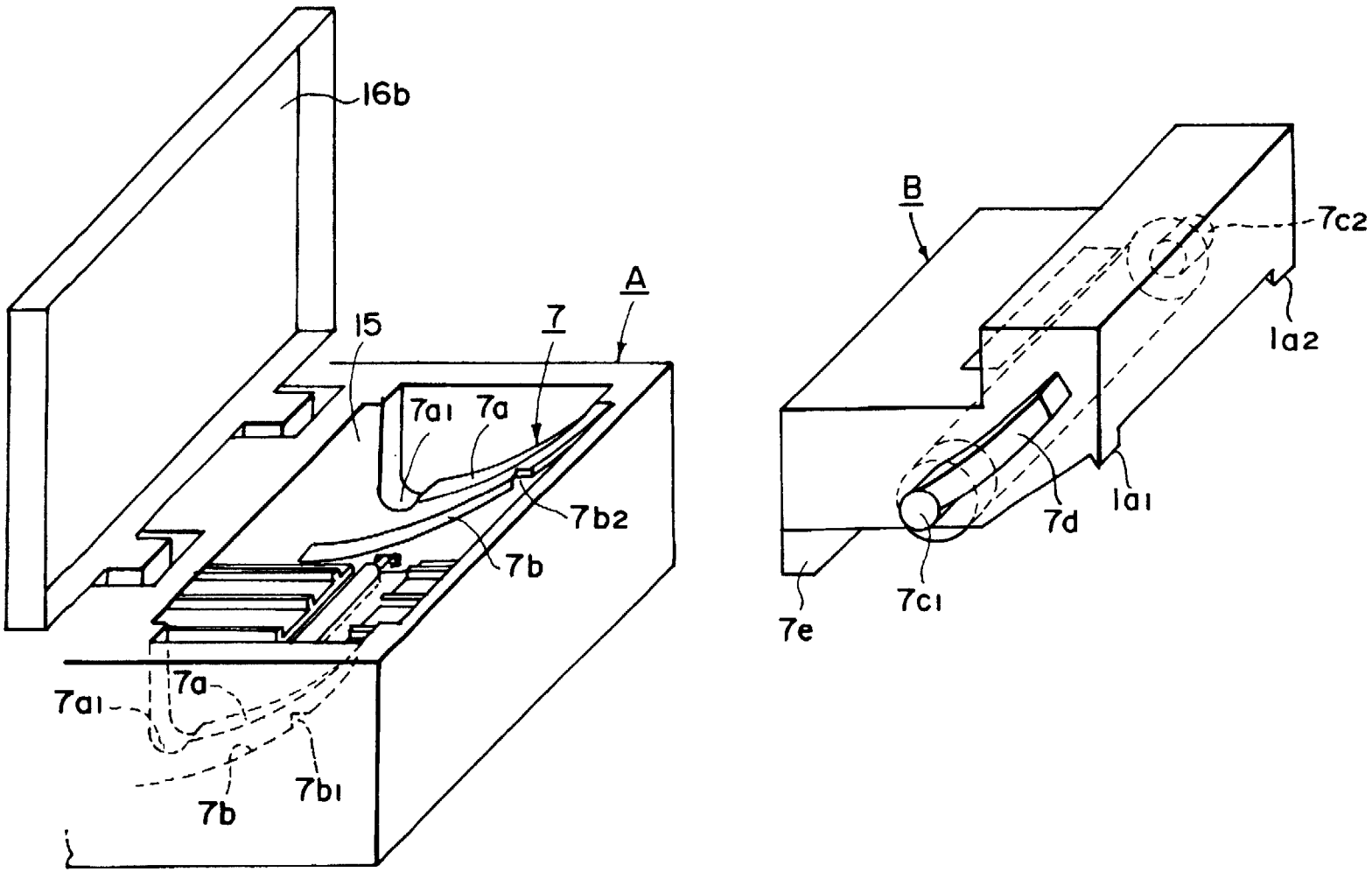
FIG. 6 is an oblique view of a process cartridge installation guide portion, depicting its structure.

In this embodiment, the frame 15 of the image forming apparatus A is provided with a guide portion for facilitating the installation of the process cartridge B. Referring to FIGS. 5 and 6, this guide portion comprises a pair of first guide portions 7a and a pair of second guide portions 7b, which are symmetrically disposed on respective internal surfaces of the side walls. The first guide portion 7a declines toward the rear portion of the apparatus (leftward in FIG. 6) and a groove portion 7a1 having an arc-shape section is provided at the bottom end of it. The second guide portion 7b is disposed inward of the first guide portion 7a in the lateral direction of the apparatus, and declines at a steeper angle than the first guide portions 7a, being different from the first guide 7a in height and location.

On the other hand, the process cartridge B is provided with a pair of cylindrical projections 7c1 and 7c2, which have substantially the same radius as that of the groove portion 7a1 provided in the frame 15 and project from the respective external side surfaces in the longitudinal direction. At each of the respective ends of these projections 7c1 and 7c2, a first engagement portion 7d is attached, ascending rearward, relative to the cartridge installation direction (right in FIG. 6), and at the bottom-forward portion relative to the cartridge installation direction, a second engagement portion 7b is provided.

Figure 7:
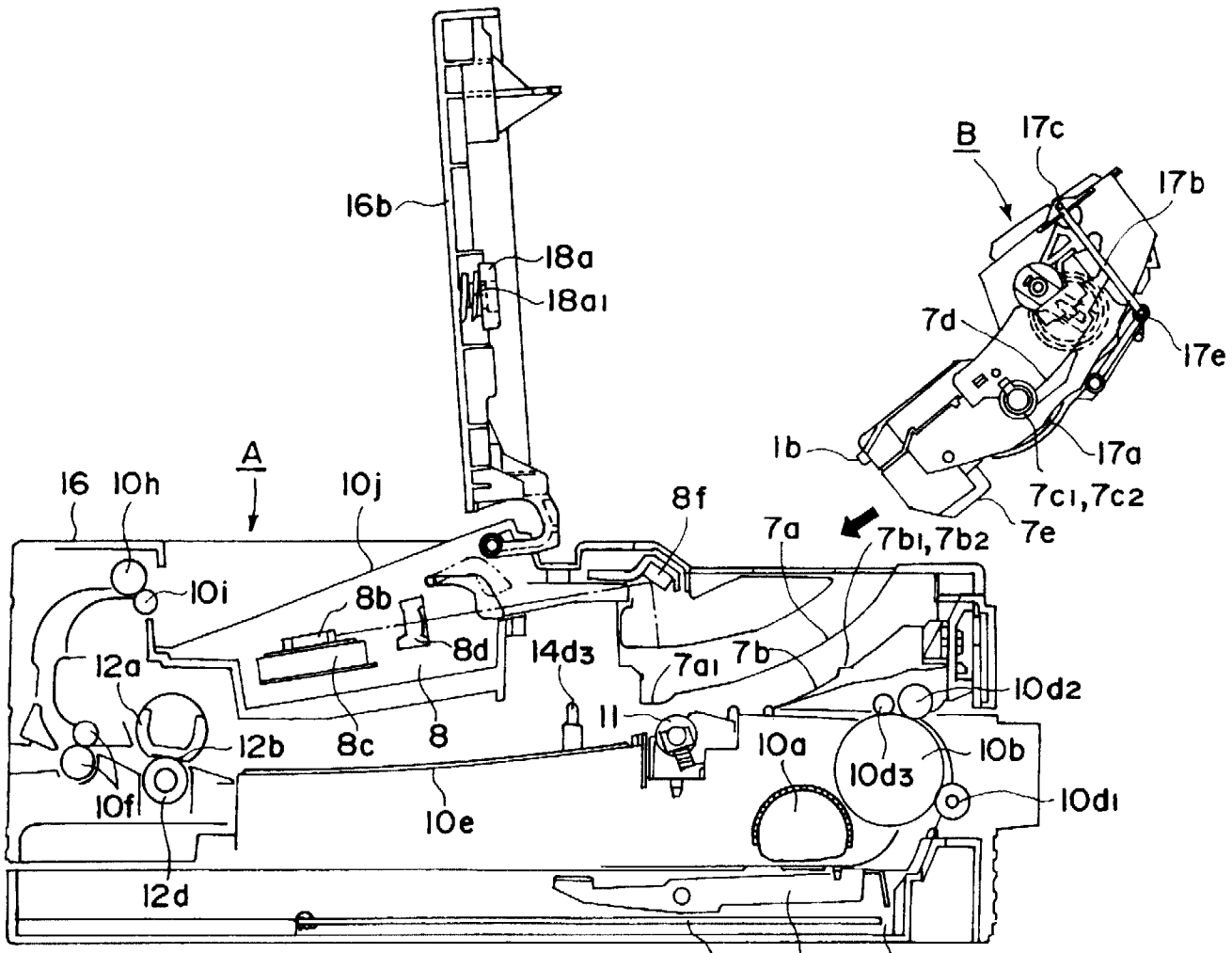
FIG. 7 depicts the state of the cartridge during the cartridge installation.
Figure 8:
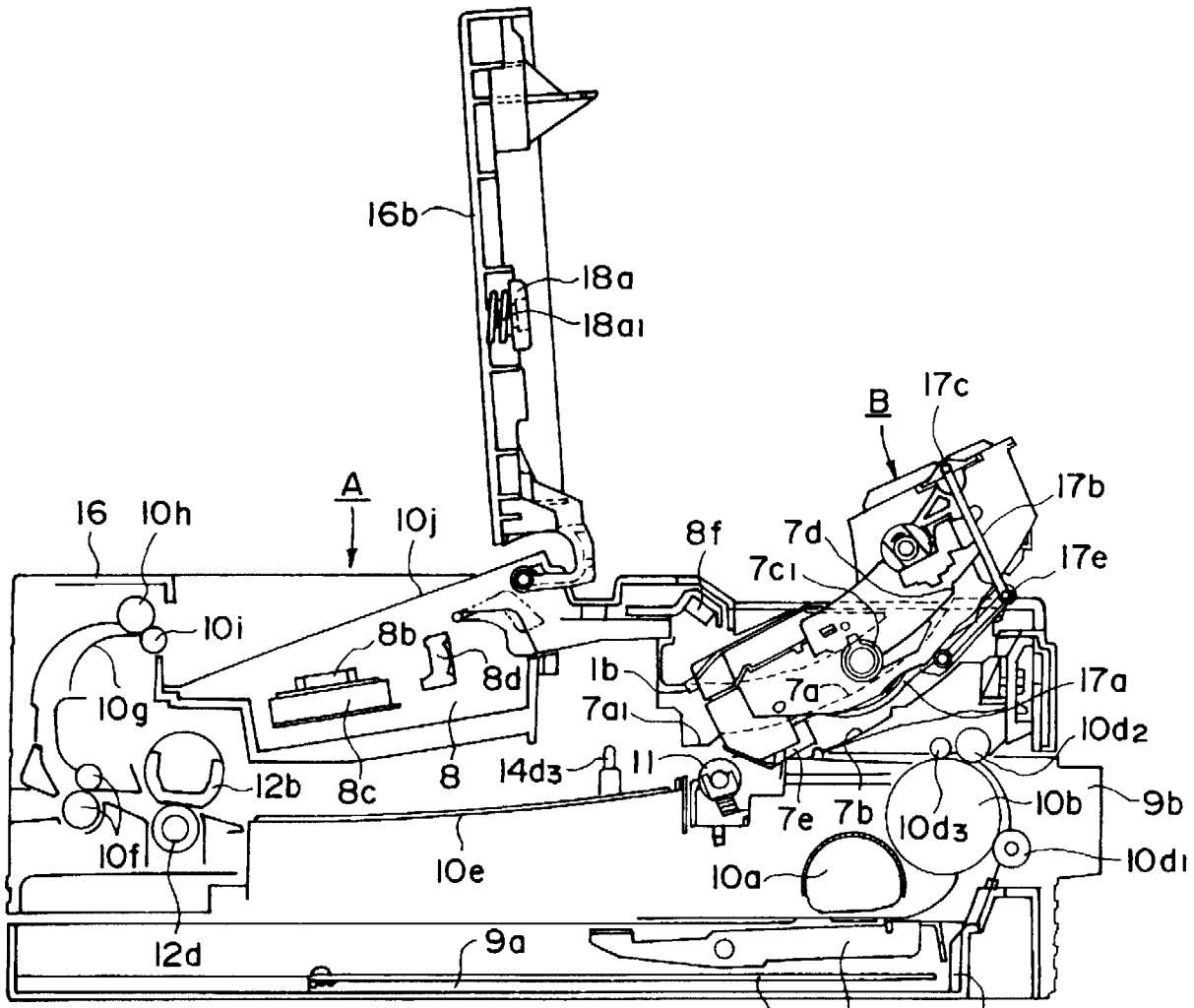
FIG. 8 depicts the state of the cartridge during the cartridge installation.

Referring to FIGS. 7 and 8, when the process cartridge B is installed in the image forming apparatus A, first, a top lid 16b provided on the external case 16 is opened, and then, the cylindrical projections 7c1 and 7c2 are placed on the corresponding first guide portion 7a and the second engagement portion 7e is placed on the second guide portion 7b. At this time, the cylindrical projections 7c1 and 7c2 and the second engagement portion 7e are guided by the guide portions 7a and 7b, and the first engagement portion 7d is guided by the first guide 7a.

Figure 9:
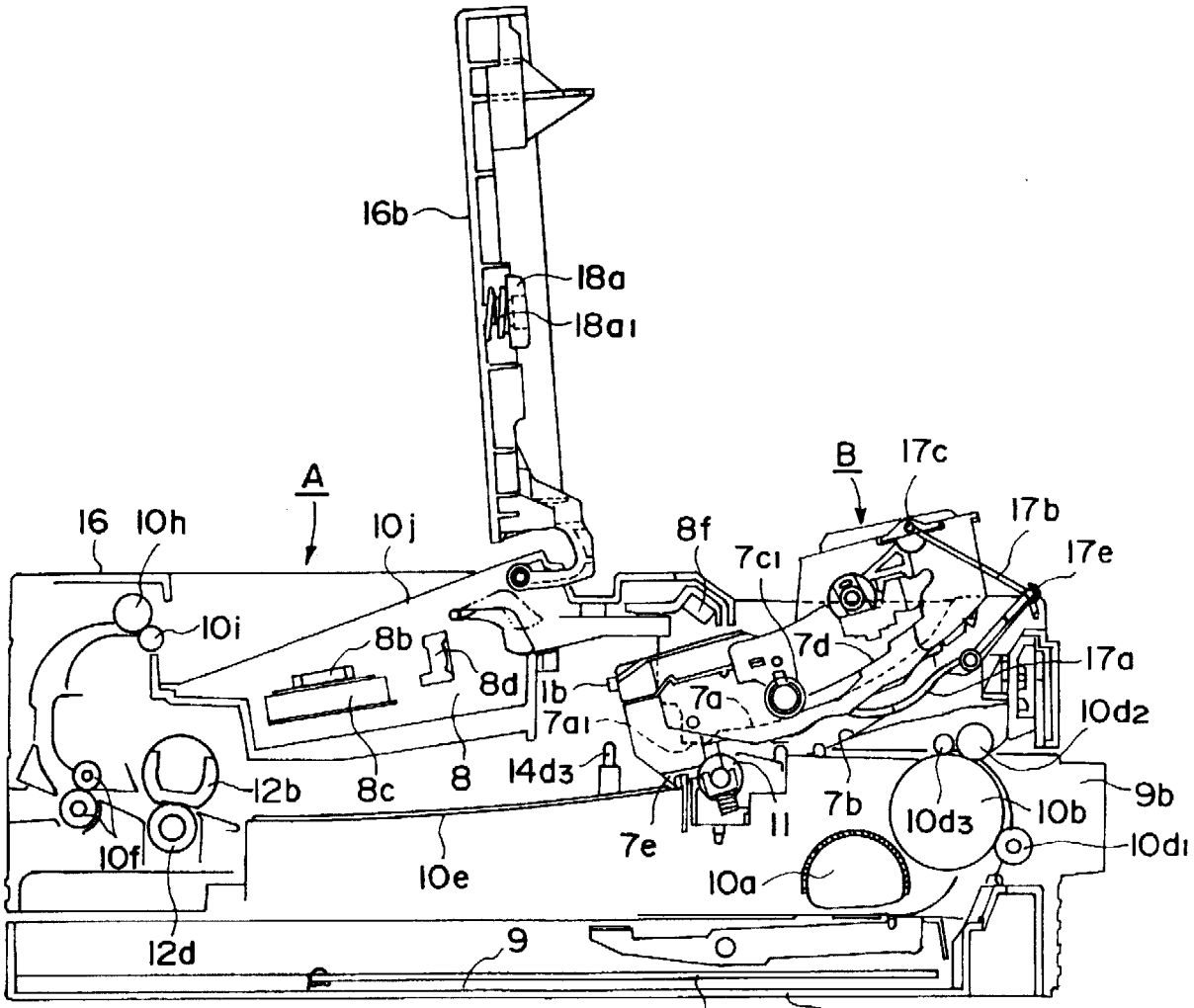
FIG. 9 depicts the state of the cartridge during the cartridge installation.

During this installation, when an attempt is made to push the process cartridge B diagonally forward in the downward direction (to pivot it about the cylindrical projection 7c1 and 7c2 in the counterclockwise direction as shown in FIG. 8), relative to the installation direction, the process cartridge B will not go down since the second engagement portion 7e and second guide portion 7b are in contact with each other. On the other hand, when another attempt is made, during the installation, to press the process cartridge B in the back and downward direction (to pivot it about the cylindrical projections 7c1 and 7c2 in the clockwise direction as shown in FIG. 9), relative to the installation direction, the first engagement portion 7d comes in contact with the first guide portion 7a, preventing thereby the process cartridge B from going down further. Therefore, the process cartridge B is smoothly inserted, being guided by the guide portions 7a and 7b, and as the cylindrical projections 7c1 and 7c2 engage with the groove portions 7a1, the process cartridge B is properly installed as shown in FIG. 1.

Figure 10:
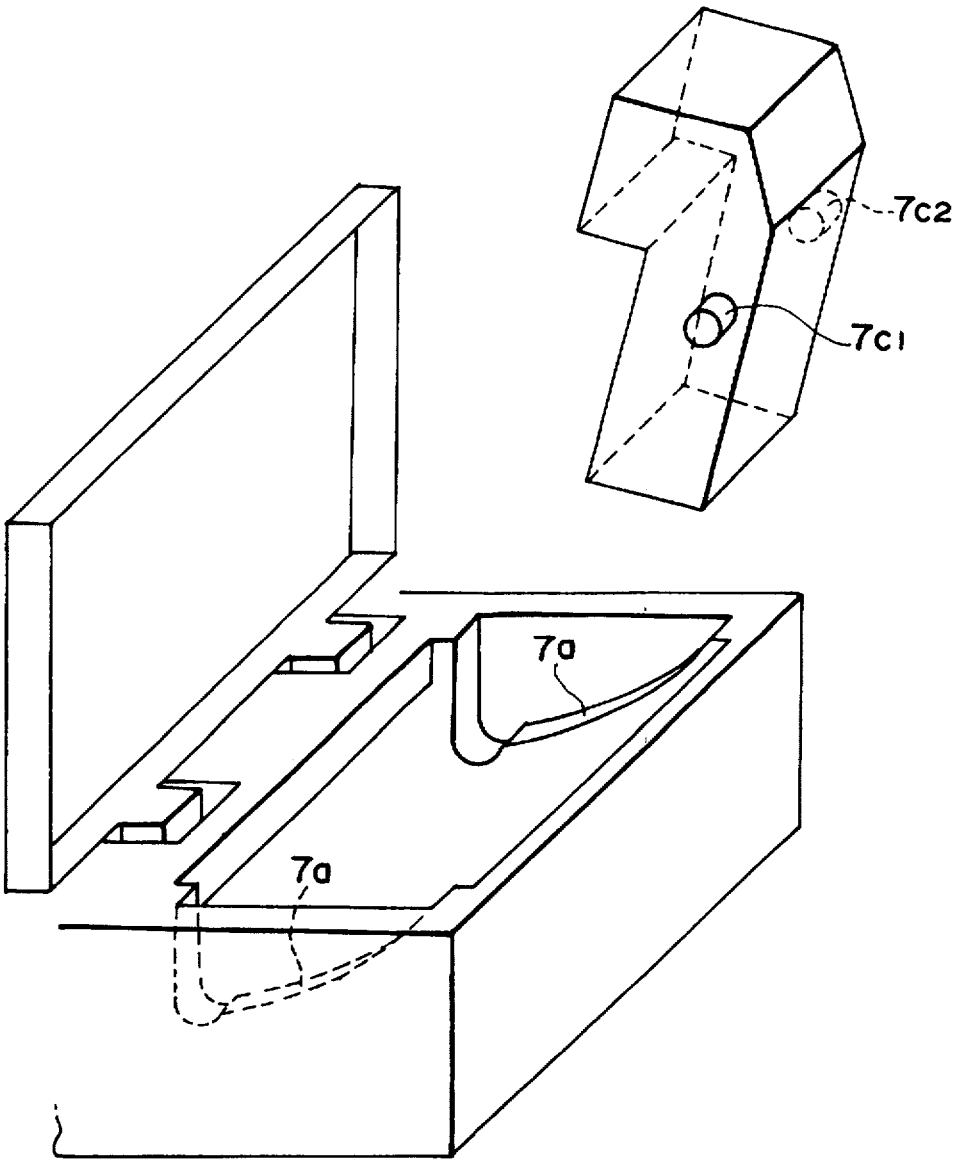
FIG. 10 is an oblique view of the cartridge installation guide portion in a conventional apparatus.

In the case of a structure which vertically lowers the process cartridge B into the image forming apparatus A, the process cartridge B collides with the reflection mirror or the like mounted on the apparatus main assembly. Therefore, in a prior type apparatus, the forward end of the process cartridge B is lowered first, with the cylindrical projections 7c1 and 7c2 of the process cartridge B being guided by the guide portion 7a as shown in FIG. 10, in a manner so as to avoid the reflection mirror or the like, and then, its rear end portion is lowered.

Figure 11:
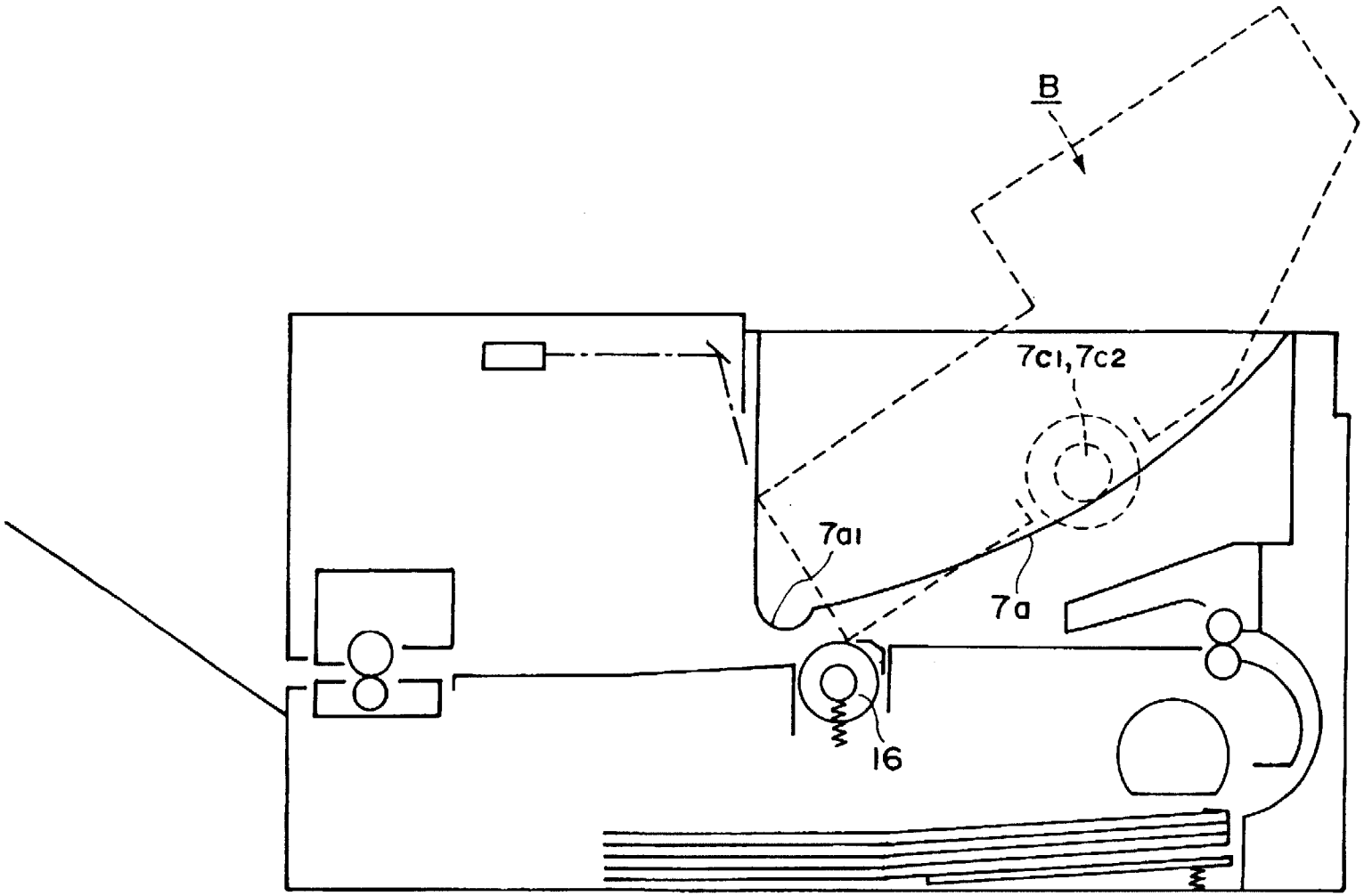
FIG. 11 is a sectional view of the cartridge installation guide portion in the conventional apparatus.

In such a case, when the forward end of the process cartridge B is lowered too far, the process cartridge B is liable to collide with the transferring roller 11, discharging needle, or the like as shown in FIG. 11, and damage it. Also, foreign matter adhering to the process cartridge B is liable to be transferred onto the transferring roller 11 when the collision occurs, and then, this transferred foreign matter is liable to travel to the photosensitive drum 2 and deteriorate image quality.

However, in this embodiment, when the process cartridge B is inserted, with the cylindrical projections 7c1 and 7c2 being guided along the first guide portion 7a, the first engagement portion 7d, and second engagement portion 7e, being provided at the fore and aft portions of the process cartridge B, are guided by the first guide 7a and second guide 7b of the frame 15; therefore, the process cartridge B does not contact the transferring roller 11 or the like. In other words, the process cartridge B in this embodiment is not liable to damage them.

<Pressure Generated by Drum Shutter>

The process cartridge B is provided with a drum shutter for protecting the photosensitive drum 2. This drum shutter automatically opens as the process cartridge B is installed in the image forming apparatus A, and automatically closes as the process cartridge B is taken out. In this embodiment, an elastic member which exerts a closing pressure on the shutter drum is also used to make it easier to take out the process cartridge B.

More specifically, referring to FIG. 7, a drum shutter 17a is attached to the frame 1 so as to cover the photosensitive drum 2. To each end of this drum shutter 17a, an arm 17b is attached, which is allowed to rotate about an axis 17c provided on the frame 1. The axis 17c is provided with a torsional coil spring 17d (FIG. 4), one end of which engages with the arm 17b and the other end of which engages with the frame 1. The drum shutter 17a is under constant pressure exerted in the closing direction by this spring 17d.

The arm 17b is provided with an engagement projection 17e (FIG. 4), and this projection 17e engages with the upper edge of the frame 15 when the process cartridge B is installed.

Therefore, while the process cartridge B is inserted along the guide portions provided on the frame 15, as shown in FIGS. 8 and 9 and described hereinbefore, the engagement projection 17e engages with the upper edge of the frame 15, and as the process cartridge B is further inserted, the arm 17b is rotated in the counterclockwise direction, against the elastic force of the spring 17d, whereby the drum shutter 7a is automatically opened.

<Pressure Generated during Process Cartridge Installation>

When the process cartridge B is inserted along the guide portions 7a and 7b, and then, the top lid 16b is closed, the process cartridge B must be reliably stabilized. Therefore, in this embodiment, it is designed so that when the top lid 16b is closed, the process cartridge B is subjected to the pressure from the frame 15.

Figure 12:
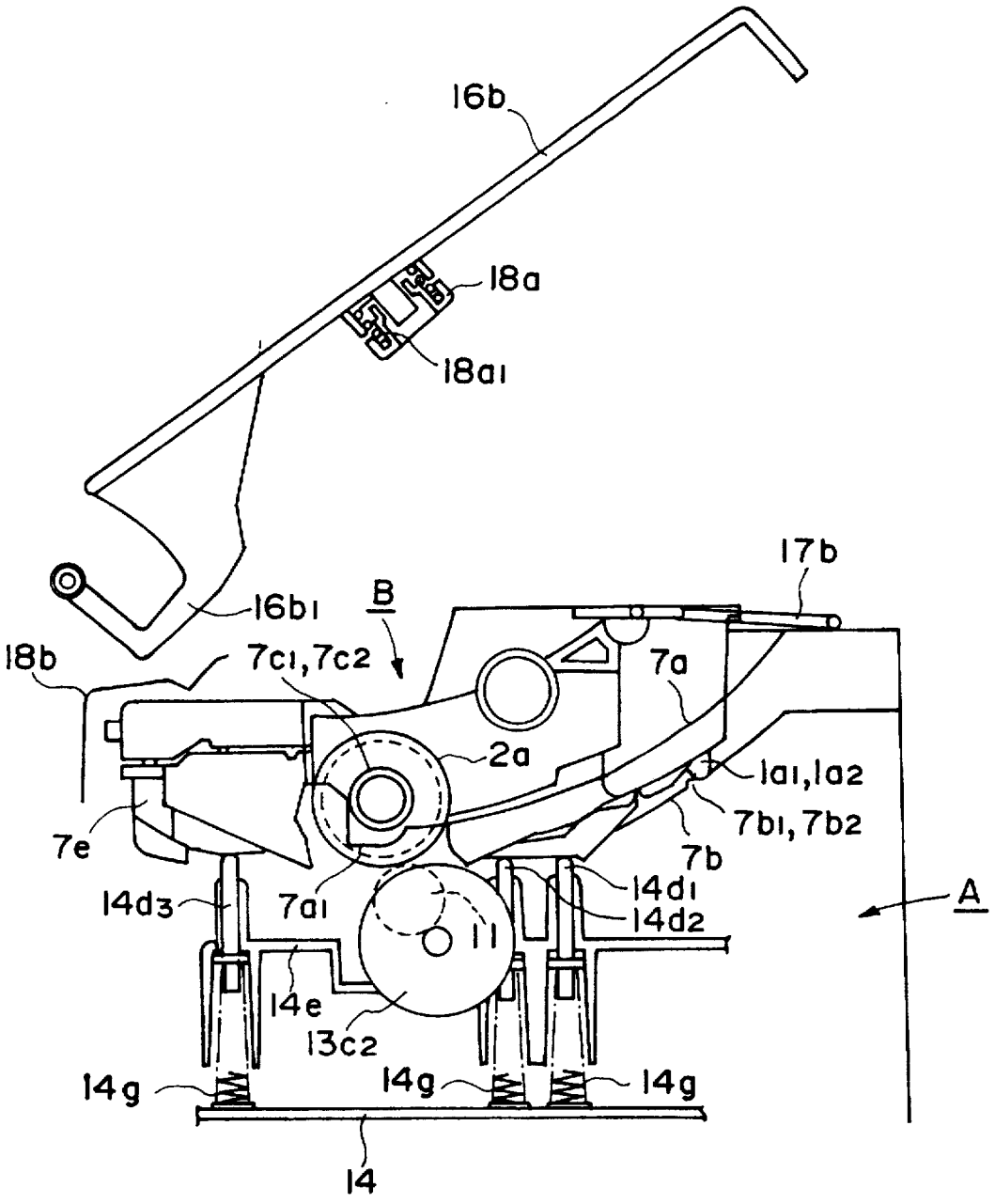
FIG. 12 depicts the installed state of the process cartridge, with a lid being open.

Referring to FIG. 12, a pressing member 18a having a shock absorbing spring 18a1 is attached to the top cover 16b, on the internal surface of the top wall portion of the top lid 16b, and a plate spring 18b, which is another pressing member, is attached to the frame 15, adjacent to the rotational center of the top lid 16b. When the top lid 16b is open, the plate spring 18b is not in contact with the process cartridge B, as shown in FIG. 12.

With such a structure in place, when the top lid 16b is opened, the process cartridge B is inserted along the guide portions 17a and 17b, then the top lid 16b is closed, the pressing member 18a provided on the internal surface of the ceiling portion of the top lid 16b presses down on the top surface of the process cartridge B, and at the same time, a leg portion 16b1 of the top lid 16b also presses down on the plate spring 18b, which in turn presses down on the top surface of the process cartridge B.

Therefore, the cylindrical projections 7c1 and 7c2 are pressed down in the groove portion 7a1, whereby the position of the process cartridge B is fixed, and at the same time, projections 1a1 and 1a2 projecting downward from the bottom surface of the frame 1 come in contact with abutment portions 7b1 and 7b2 provided at respective predetermined locations on the second guide portions 7b, being positionally fixed, whereby the rotation of the process cartridge B is regulated.

Referring to FIG. 6, two projections 1a1 and 1a2 are provided at the bottom of the frame 1, and two abutment portions 7b1 and 7b2 are provided on the guide portions 7b, at locations which correspond to the locations of the projections 1a1 and 1a2 on the frame 1, wherein two abutment portions 7b1 and 7b2 are equal in height, whereas the projections 1a1 and 1a2 are different, that is, the projection 1a1 is taller than the projection 1a2. Therefore, when the cartridge is in the normal state of installation, only one projection 1a1 is in contact with the abutment portion 7b1, fixing thereby the position of the cartridge, and other projection 1a2 remains slightly lifted from the abutment portion 7b2. When the process cartridge B is deformed by an external force such as vibration, or in a like situation, this floating projection 1a2 comes in contact with the abutment portion 7b2 and functions as a stopper.

Since the plate spring 18b is to be directly mounted on the frame 15, it can be mounted so as to press the process cartridge B on a more precise spot, and also, since this plate spring is to be pressed by the leg portions 16b1 of the top lid 16b, a relatively small space is needed for pressing; therefore, the apparatus can be downsized. Further, referring to FIG. 13, since a distance from a fulcrum P1 of the plate spring 18b to a pressure application point P3 at which the plate spring 18b is pressed is longer than a distance from a fulcrum P1 of the plate spring 18b to a point of action P2 at which the process cartridge is pressed, the process cartridge B can be pressed down with a small pressure. Therefore, the load exerted on the top lid 16b is reduced, preventing thereby the deformation of the top lid 16b which occurs when it is closed.

Figure 13:
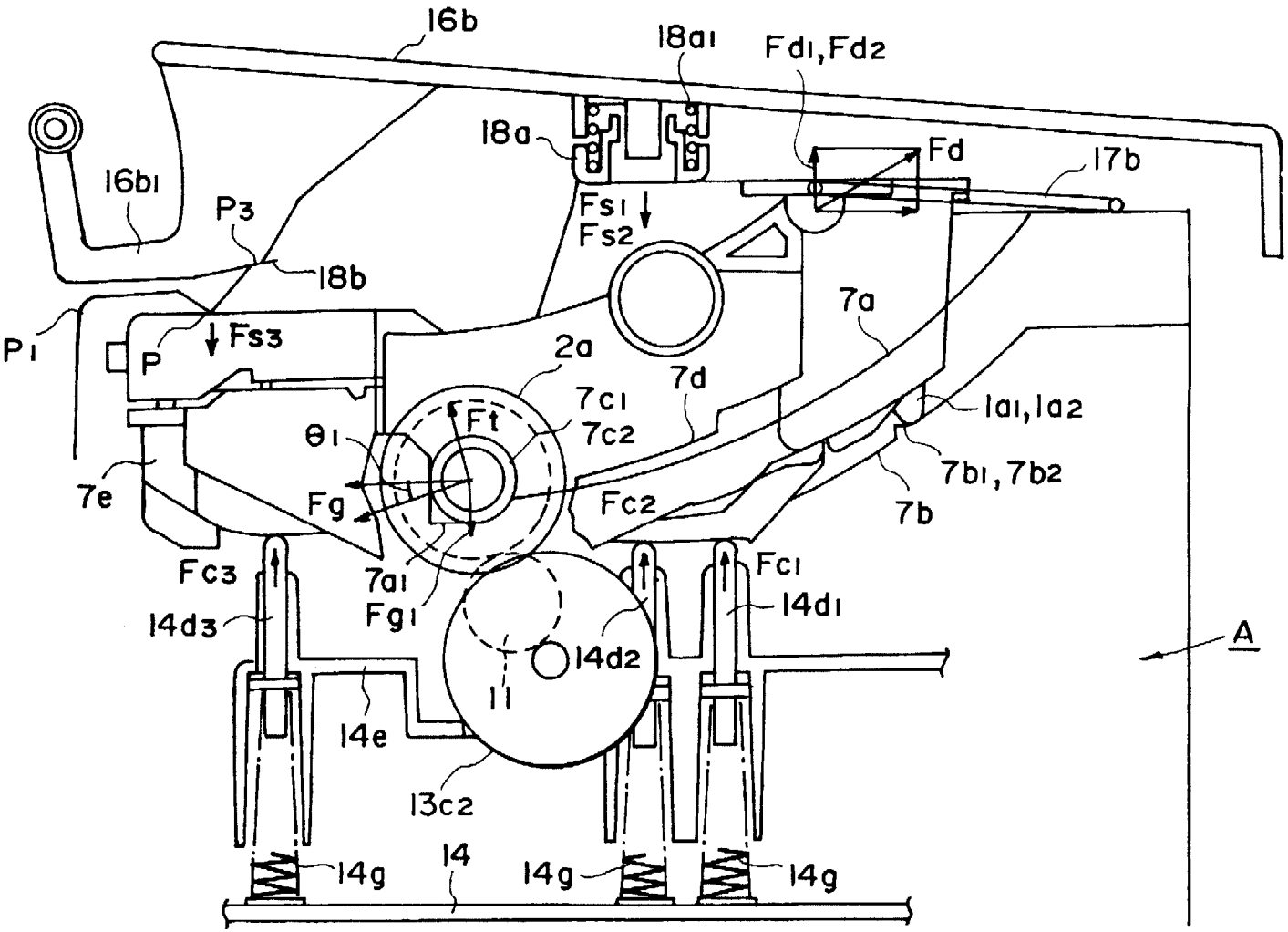
FIG. 13 depicts the installed state of the process cartridge, with the lid being closed.

Referring to FIGS. 12 and 13, the plate spring 18 is elastically deformed as the top lid 16b is opened or closed. Therefore, this plate spring 18b can be rendered to function as an actuator of a switch, in which the plate spring 18b presses the switch when the top lid 16b is closed and releases it when the top lid 16b is opened. With this arrangement, the plate spring 18b doubles as a detection switch for detecting whether the top lid 16b is open or closed, reducing thereby the component count. As a result, a manufacturing cost can be saved.

<Force Exerted on Installed Process Cartridge>

When the top lid 16b is closed after the installation of the process cartridge B, an upward force is also exerted on the cartridge B in addition to the downward pressure imparted by the pressure generating member 18a or the like, as described hereinbefore. Therefore, in order to stabilize the installed process cartridge B, the downward pressure exerted on the process cartridge B must be larger than the upward pressure.

The upward force exerted on the process cartridge B is generated by the electrical contact pins, transferring roller 11, and drum shutter 17a. Referring to FIG. 13, on the bottom surface of the cartridge B, electrical contacts are exposed. These contacts make contact with contact pins provided on an electrical component unit 14. More specifically, the electrical component unit 14 is provided with a development bias contact pin 14d1 for applying the development bias to the developing sleeve, a ground contact pin 14d2 for grounding the photosensitive drum 2, and a charge bias contact pin 14d3 for applying the charge bias to the charging roller. Each of these pins 14d1, 14d2, and 14d3 is fitted within a holder cover 14e in such a manner that it can project without coming out all the way, wherein the wiring pattern of the electrical component unit 14 to which the holder cover 14e is attached is electrically connected to each of the contact pins 14d1, 14d2, and 14d3 with an electrically conductive compression spring 14g.

Figure 14:
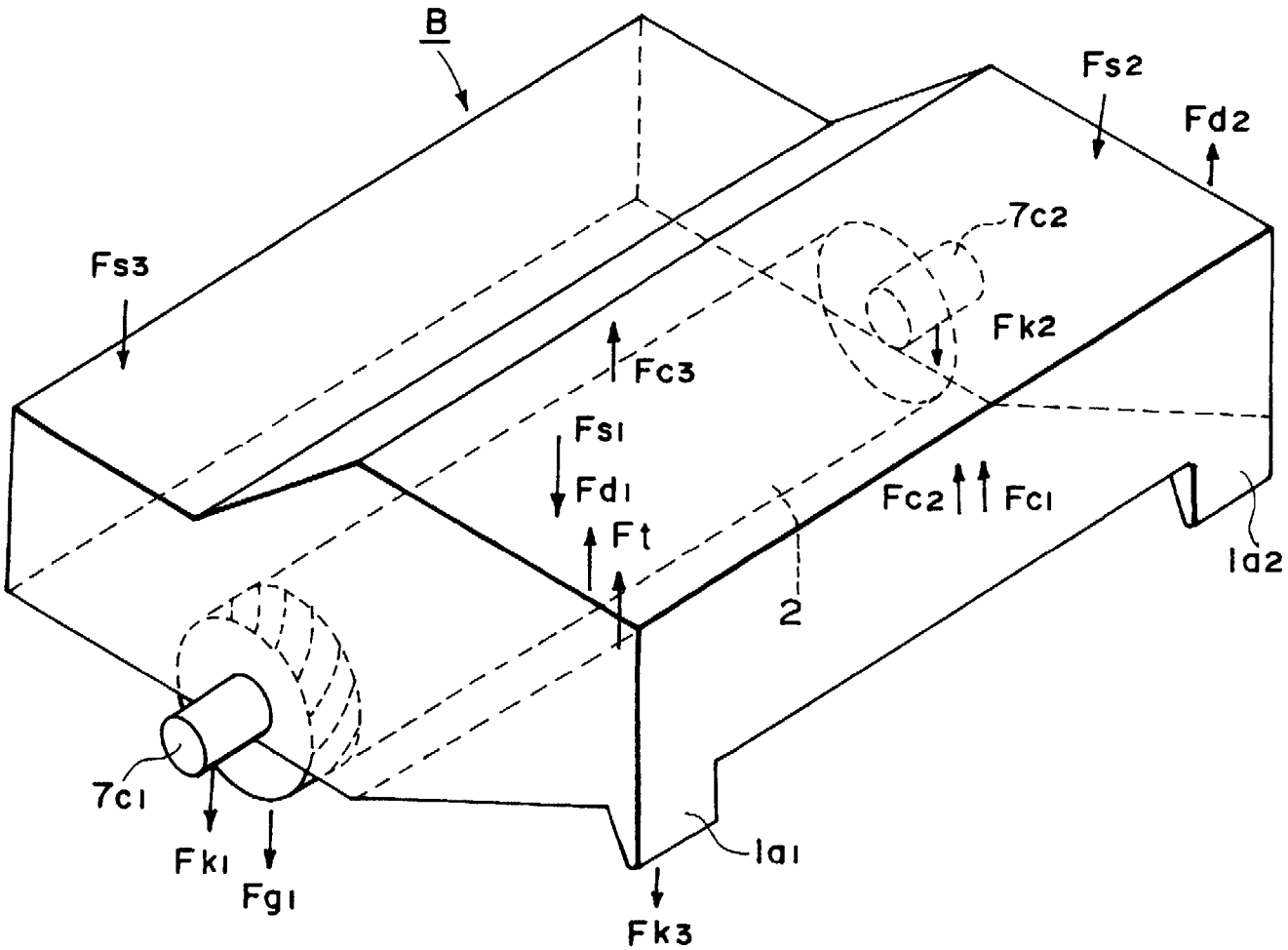
FIG. 14 depicts forces exerted on the process cartridge during the image forming operation.

During the installation of the process cartridge B, the electrical contact pins 14d1, 14d2, and 14d3 are pushed in, and the transferring roller 11 comes to press on the photosensitive drum 9. Therefore, the process cartridge B is pressured upward by the forces Fc1, Fc2, and Fc3 from the contact springs 14g of respective contact pins as shown in FIGS. 13 and 14, as well as by the force Ft from the transferring roller 11 (FIG. 1). Further, the opened drum shutter 17a remains pressed constantly in the closing direction by the torsional coil spring 17d. This force Fd is exerted on the process cartridge B in the same direction as that in which the process cartridge B is pulled when it is taken out, whereby the process cartridge B is pressured upward by the vertical components Fd1 and Fd2 of the force Fd.

On the other hand, the process cartridge B is pressured downward by the forces Fs1 and Fs2 from the pressure generating member 18a, and the force Fs from the plate spring 18b, as described previously. In addition, it is also pressured downward by the self weights Fk1, Fk2, and Fk3, and the rotation of the gear for transmitting the driving force to the photosensitive drum 2.

More specifically, referring to FIG. 13, when the process cartridge B is installed, the drum gear 2a attached to one of the longitudinal ends of the photosensitive drum 2 engages with a driving gear 13c2 provided in the apparatus main assembly 6, for transmitting the driving force of a main motor 20. At this time, the direction of the operating pressure angle between the both gears 2a and 13c2 is set downward by an angle $\theta=1°-6°$ (approximately 4° in this embodiment), relative to the horizontal line. Therefore, during the image forming operation, a component FG1 of the operating pressure FG between the driving gear 13c2 and drum gear 2a works to press the process cartridge B downward. By directing the operating pressure FG of the gears downward, relative to the horizontal line, the process cartridge B is prevented from being pushed up.

Further, having the operating pressure angle being directed downward relative to the horizontal line, even when the operator closes the top lid 16b without inserting the process cartridge B all the way (but enough to allow the top lid 16b to be closed), the process cartridge B is pulled in by the rotational force of the driving gear 13c2 as the main motor 20 rotates after the closing of the top lid 16b is detected, and the cylindrical projections 17c1 and 17c2 engage into the groove portions 7a1, whereby the process cartridge B is properly installed.

When the process cartridge B is inserted so improperly that the drum gear 2a and driving gear 13c2 fail to engage, the process cartridge B sticks out upward from the apparatus main assembly 6 and prevents the top lid 16b from being closed. Therefore, the operator will notice that the process cartridge B has been improperly inserted.

Further, even when the process cartridge B is subjected to a force directed in the diagonally left-downward direction in FIG. 13 during the image forming operation, the cylindrical projections 7c1 and 7c2 are abutted in the grooves 7a1 because of the aforementioned operating pressure angle; therefore, the process cartridge B remains stable. However, when the operating pressure angle is set diagonally left-downward in relation to the horizontal line as described in the foregoing, the positional arrangement becomes such that the drum gear 2a has to ride over the driving gear 13c2. Therefore, when the downward operating pressure angle is increased, the drum gear 2a is liable to collide with the driving gear 13c2 during the installation of the process cartridge B. In addition, the process cartridge B must be lift higher before it can be pulled, during removal; otherwise, both of the gears 2a and 13c2 are liable to collide with each other, hampering thereby their disengagement. Therefore, the aforementioned diagonally left-downward operating pressure angle θ is preferred to be in a range of approximately 1°–6°.

As for the relationship between the upward and downward forces exerted on the process cartridge B as described in the foregoing, it has to satisfy the following conditions in order for the process cartridge B to be properly installed and for each of the contact pins to come and remain reliably in contact with the counterparts of the process cartridge B.

(1) An overall pressure exerted on the process cartridge B manifests as a downward pressure.

(2) The left side projection 1a1 is not allowed to be pivoted about an axis connecting both cylindrical projections 7c1 and 7c2 and lifted up.

(3) Both cylindrical projections 7c1 and 7c2 are not allowed to be pivoted about an axis connecting both projections 1a1 and 1a2, and to be thereby lifted up.

(4) The left cylindrical projection 7c1 and left projection 7c1 are not allowed to be pivoted about an axis connecting the right cylindrical projection 7c2 and right projection 1a2, and to be thereby lifted up.

(5) The right cylindrical projection 7c2 and right projection 1a2 are not allowed to be pivoted about an axis connecting the left cylindrical projection 7c1 and left projection 7c1, and to be thereby lifted up.

(6) The left cylindrical projection 7c1 is not allowed to be pivoted about an axis connecting the right cylindrical projection 7c2 and left projection 1a1 and lifted up.

(7) The right cylindrical projection 7c2 is not allowed to be pivoted about an axis connecting the left cylindrical projection 7c1 and right projection 1a2, and to be thereby lifted up.

However, in the case of this embodiment, since the right projection 1a2 is slightly lifted above the abutment portion 7b2 anyway, Condition (7) may be eliminated; therefore, it is only necessary to satisfy Conditions (1)–(6).

More specifically, in order to meet Condition (1), for example, only the following relation has to be satisfied:

$$Fs1+Fs2+Fs3+FG1+Fk1+Fk2+Fk3 > Fc1+Fc2+Fc3+Ft+Fd1+Fd2$$

Figure 15:
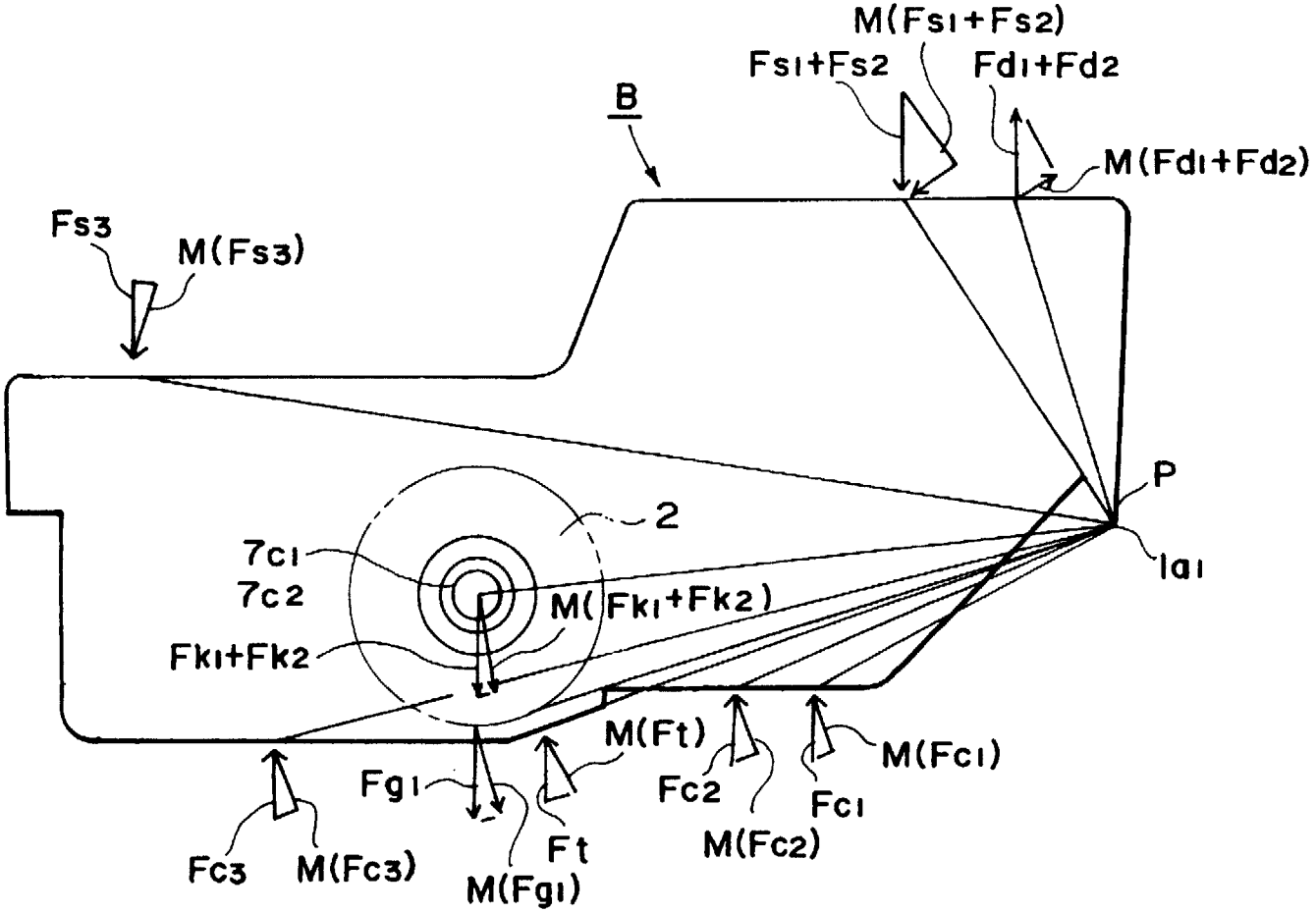
FIG. 15 depicts rotational moments exerted on the process cartridge during the image forming operation.

Further, referring to FIG. 15, in order to meet Condition (3), it suffices if a rotational moment about a point p of the projection 1a1 on the driven side satisfies the following mathematical expression, wherein M(T) in the expression is a reaction force generated by the cartridge torque, that is, a clockwise moment of the process cartridge B about the point p in the drawing.

$$M(Fs1+Fs2)+M(Fs3)+M(FG1)+M(k1+Fk2)>M(Fc1)+M(Fc2)+M(Fc3)+M(Ft)+M(Fd1+Fd2)+M(T)$$

where M( ) is a moment.

Similarly, expressions which satisfy Conditions (1)–(6) are obtained, and the pressures Fs1, Fs2, and Fs3 are determined so as to satisfy all the conditions. As a result, the process cartridge B remains stabilized within the frame 15 during the image forming operation.

On the contrary, in the case of the prior structure in which the process cartridge B is installed in the top lid 16b assembly, when the operating pressure angle is set diagonally downward relative to the horizontal line, the drum gear 2a and driving gear 13c2 remain engaged when the top lid 16b is opened. As a result, the process cartridge B cannot be smoothly pulled out. Therefore, the driving gear 13c2 must be provided with a one-way clutch or the like. However, in the case of this embodiment, when the top lid 16b is opened, the force pressuring upward the cartridge B automatically works to disengage the drum gear 2a and driving gear 13c2, which eliminates the need for the provision of the one-way clutch, allowing thereby the component count to be reduced.

Also, when the process cartridge B is lifted, and the cylindrical projections 7c1 and 7c2 are disengaged from the groove portion 7a1, as described previously, the process cartridge B is pushed in the same direction as that in which the process cartridge B is pulled out, by the pressure from the spring 17d exerting the pressure for closing the drum shutter 17a. Therefore, it becomes easier to remove the process cartridge B.

(Optical System)

<Scanner Unit>

The optical system 8 projects the light beam carrying the imaging information read in from the external apparatus or the like, onto the photosensitive drum 2. As shown in FIG. 1, it comprises a scanner unit 8e and a mirror 8f, which are disposed in the frame 15, wherein the scanner unit 8e comprises a laser diode 8a for emitting a laser beam, a polygon mirror 8b molded of metallic or resin material, a scanner motor 8c, and an image forming lens 8d molded of glass or resin.

When an imaging signal is sent in by an external equipment such as a computer or word processor, the laser diode 8a emits light in response to the imaging signal, and the emitted light is projected as the imaging beam to the polygon mirror 8b, which is being rotated at a high speed by the scanner motor 8c. The imaging beam reflected by the polygon mirror 8b is projected through the image forming lens 8d and is reflected by the mirror 8f onto the photosensitive drum 2, exposing selectively the surface of the photosensitive drum 2. As a result, a latent image according to the imaging information is formed on the photosensitive drum 2. The reflection mirror 8f is mounted on the frame 15, with screws or the like, at a predetermined angle.

The scanner unit 8e and reflection mirror 8f are disposed to be substantially in the middle of the apparatus main assembly 6 for the following reason.

That is, the apparatus main assembly 6 of the image forming apparatus is generally provided with legs, one at each of four bottom corners (unshown), and when the apparatus is in use, only these four legs contact the surface where the apparatus is placed. When this surface is not flat, a torsional force is generated. This torsional force is exerted on the apparatus main assembly 6, which is liable to twist the optical system. When the optical system is twisted, it cannot precisely project the optical image no matter how slightly it is twisted; therefore, the image is distorted.

When the torsional force generated due to the unevenness of the surface on which the apparatus is placed is exerted on the apparatus main assembly through the legs located on four corners, the closer to the center of the apparatus main assembly it is, the less the effects of the torsional force is. For this reason, the image distortion can be suppressed to a minimum by disposing the scanner unit 8e and reflection mirror 8f substantially in the middle of the apparatus main assembly, which is least affected by the torsional force.

Further, the reflection mirror 8f is disposed approximately above and adjacent to the photosensitive drum 2, and vibrates substantially in synchronism with it. Therefore, the amount by which the writing position of the laser beam is shifted by the vibration can be reduced. Further, the reflection mirror 8f is mounted with use of a holding member, adjacent to a wall 15k of the main frame and adjacent to the scanner unit 8e, which affords a very vibration resistant structure.

The scanner unit 8e is surrounded by the fixing means 12, cover guide 10e, process cartridge B, reflection mirror 8f and mirror holding portion 15g (FIG. 15), external case 16, and frame 15. Therefore, the structure surrounding the scanner unit 83 is provided with high rigidity and strength to protect the scanner unit 8 against the deformation or vibration caused by the external force.

Referring to FIG. 1, the scanner unit 8e is inclined diagonally upward so that the light coming out of the resin molded image forming lens 8d is directed diagonally upward. Also, the scanner unit 8e is inclined in the same direction as the discharge tray 10j which is provided on the top surface of the apparatus main assembly 6, being inclined diagonally upward, so that the scanner unit 8e becomes substantially parallel to the inclined surface of the discharge tray 10j. With this arrangement, even when the height of the apparatus main assembly 6 is reduced as much as possible, the inclination angle of the discharge tray 10j can be increased so that a sufficient number of recording media P can be accumulated in the discharge tray 10j.

Here, the inclination of the discharge tray 10j relative to the horizontal line is approximately 15°–45°, preferably approximately 20°–40°, in consideration of the discharge performance. In this embodiment, it is set at approximately 20°. As for the mounting angle of the scanner unit 8e relative to the horizontal line, it is approximately 9°–12.5°.

<Opening and Closing Operation of Laser Shutter>

Figure 16A:
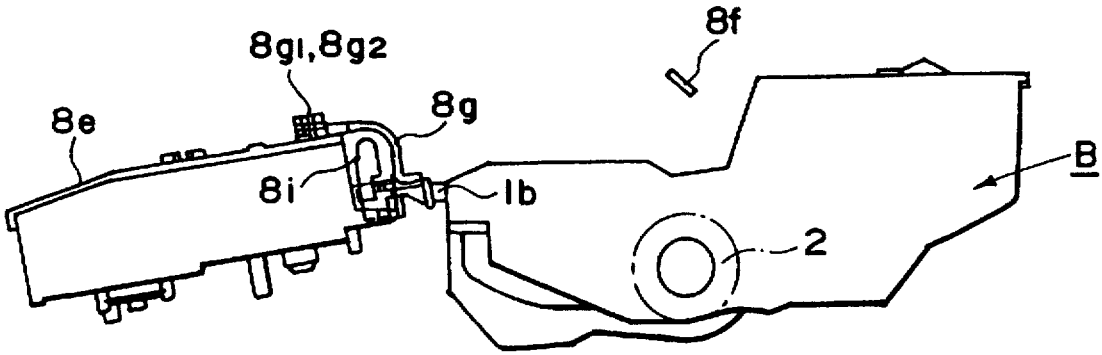
FIG. 16(*a*) depicts a state in which a laser shutter is closed, and FIG. 16(*b*) depicts a state in which the laser shutter is open.
Figure 16B:
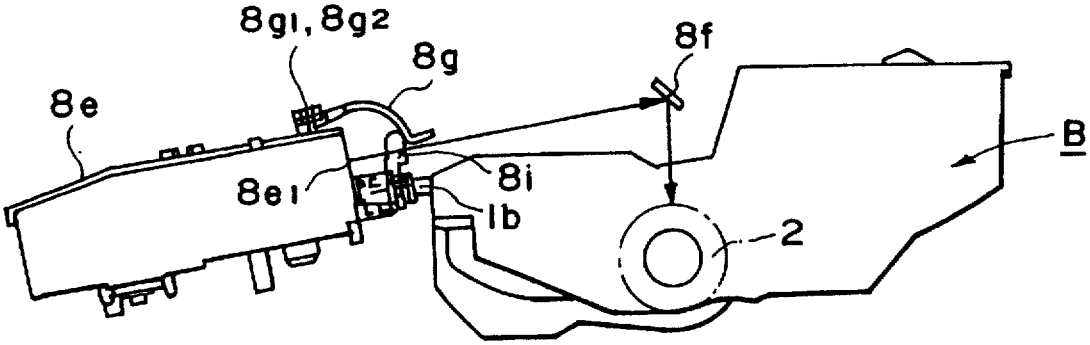

The scanner unit 8e, which is the projecting means of the laser beam, is provided with a laser shutter 8g constituting a shutter means which takes a closed position as shown in FIG. 16(*a*), at which it blocks the laser beam passage to prevent the laser beam from being unintentionally leaked, and a opened position as shown in FIG. 16(*b*), to which it retracts from the closed position to unblock the laser beam passage when the scanner is in use.

Figure 17:
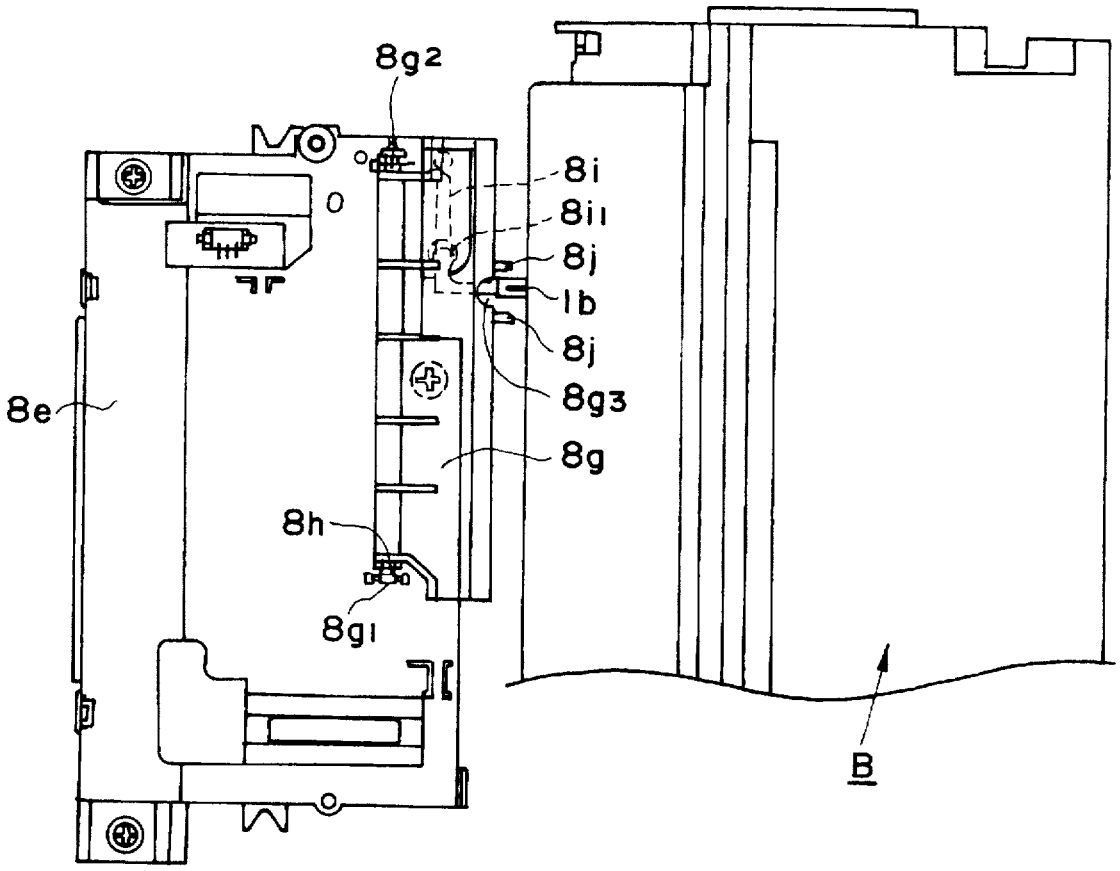
FIG. 17 is a plan view of the laser shutter.

Next, the opening and closing operation of this laser shutter 8g will be described. Referring to FIGS. 16 and 17, the scanner unit 8e is provided with a unit opening 8e1 which constitutes a passage for the laser beam, and this unit opening 8e1 is provided with the laser shutter 8g which is rotatable about axes 8g1 and 8g2. As this shutter 8g is rotated, the opening 8e1 is exposed or covered. One of the axis 8g1 is provided with a torsional coil spring 8h which constantly pressures the shutter 8g in the closing direction.

Adjacent to the laser shutter 8g, a shutter lever 8i is disposed. This shutter lever 8i is rotatable about an axis 8i. Further, a projection lb which serves as an actuator is provided at the forward edge of the process cartridge B. As the cartridge B is installed, the projection 1b is inserted through the inserting portion 8g3 of the laser shutter 8g and presses the lever 8i, whereby the lever 8i is rotated in the clockwise direction, pushing up the laser shutter 8g to open, as shown in FIG. 16(*b*). As the process cartridge B is pulled out of the apparatus main assembly, the pressure from the projection 1b is eliminated, allowing thereby the laser shutter 8g to be automatically closed by the pressure from the torsional coil spring 8h. In other words, the laser shutter 8g is automatically opened or closed as the process cartridge B is installed or taken out.

Referring to FIG. 17, a pair of protective guide members 8j are provided adjacent to the inserting portion 8g3 through which the projection 1b is inserted. The distance between these two protective guide members 8j is set to be approximately 5 mm, and their lengths are set to be approximately 6 mm, preventing thereby a finger or the like from being inserted through the gap between two members 8j while allowing the cartridge projection 1b to be inserted.

Further, the gap between two protective guide members 8j tapers out toward the free end side from which the cartridge projection 1b is inserted. Therefore, when the process cartridge B is inserted, being guided by the guide portions 7a and 7b, these two protective guide members 8j can also function as guides for facilitating the insertion of the projection 1b into the inserting portion 8g3. In other words, even when the process cartridge B is inserted at a slightly wrong angle, the projection 1b is guided by the tapered portions of the protective guide members 8j to be properly inserted into the inserting portion 8g3.

Also in this embodiment, the top surface of the laser shutter 8g is curved as shown in FIG. 16 so that the laser shutter 8g cannot be easily opened with a finger or the like object. When the shape of this shutter 8g is rectangular, for example, the shutter 8g can be easily opened by placing a finger or the like object on corner portions, but when the shutter contour is a curvature, the finger placed on the shutter to pry open it slips, preventing thereby it from being easily opened. In this matter, it is even more effective if the curved surface of the shutter 8g is made smoother and more slippery.

(Feeder Cassette)

Figure 18:
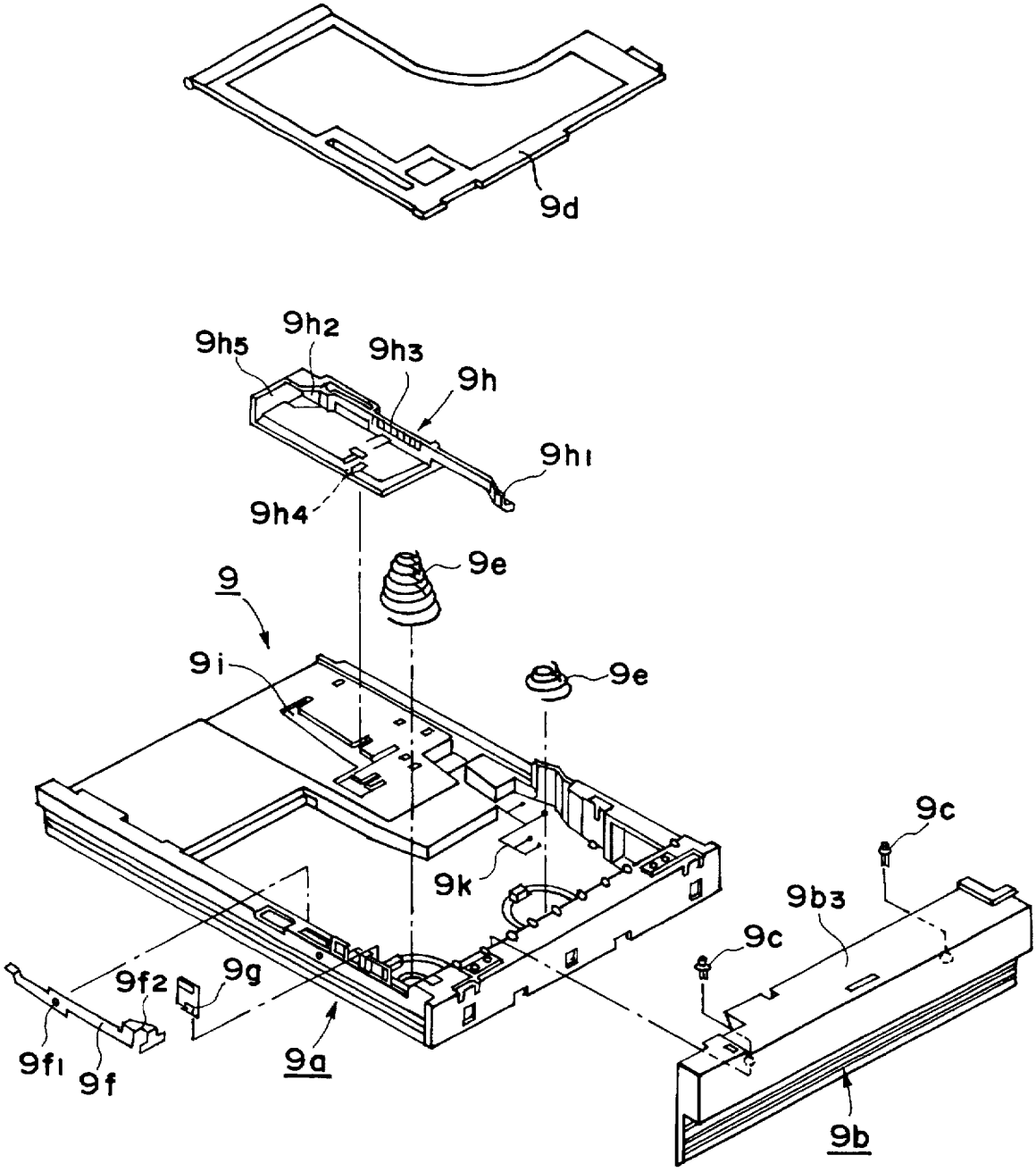
FIG. 18 is an exploded view of a feeder cassette.

Next, the structure of the feeder cassette 9 will be described. Referring to FIG. 1, within the apparatus main assembly 6, an installation space 6a for the feeder cassette 9 is provided at the bottom, where the feeder cassette 9 storing the recording medium P is installed. The feeder cassette 9 comprises, as shown in FIG. 1, a cassette main assembly 9a having a guide portion 9a1 which serves as a guide when the recording medium is fed, and a cassette auxiliary assembly 9b which is an assembly independent from the cassette main assembly 9a, wherein the cassette auxiliary assembly 9b has a conveying guide portion 9b1, a cassette auxiliary assembly surface 9b2, and a hand feeding guide portion which serves as a table used for inserting the recording medium P during a hand feeding operation. Referring to FIG. 18, the cassette main assembly 9a and cassette auxiliary assembly 9b are joined with rivets 9c.

Incidentally, when the feeder cassette 9 is in the apparatus main assembly 6, the only portion exposed outward from the apparatus main assembly 6 is a cassette auxiliary assembly 9b. Therefore, the exterior design of the feeder cassette 9 can be matched to that of the apparatus main assembly 6 just by replacing this cassette auxiliary assembly 9b.

Figure 19:
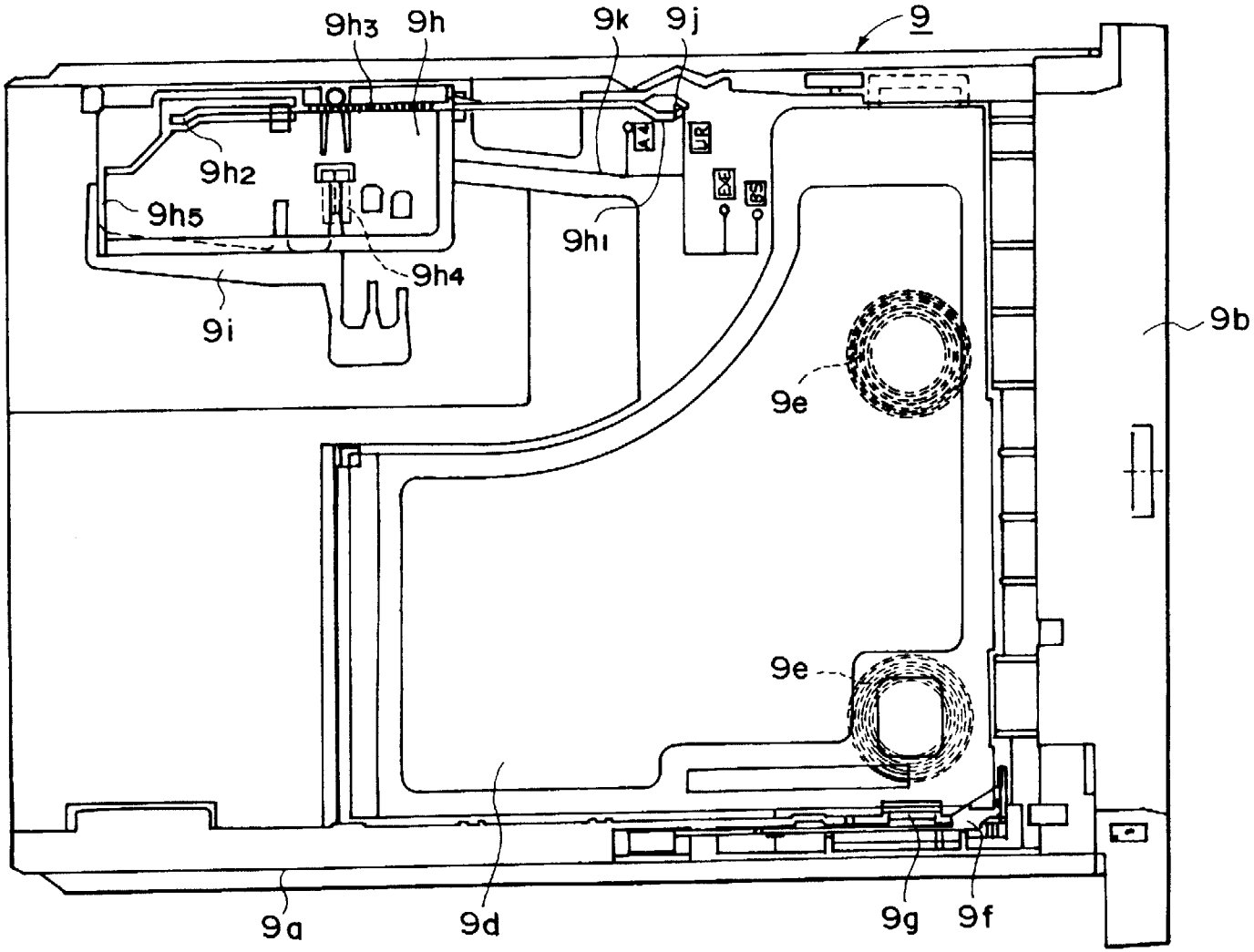
FIG. 19 is a plan view of the feeder cassette.

Referring to FIGS. 18 and 19, a middle plate 9d on which two or more recording mediums P are loaded, a spring 9c for providing the middle plate 9c with upward pressure, and a separating claw 9f for separating one by one the recording medium P by regulating the forward corner of a stack of the recording mediums P loaded on the middle plate 9d, on the aligning reference side, are provided within the cassette main assembly 9a.

The separating claw 9f is provided with an axis hole 9f1 for a separating claw axis (unshown) provided on the cassette main assembly 9a, wherein the separating claw 9f is attached to the cassette main assembly 9a by means of engaging the axis hole 9f1 with the separating claw axis, and pivots about the mounting axis, following one by one the movement of the uppermost sheet of the stacked recording media P, at the forward corner on the alignment reference side. This separating claw 9f is provided with a separating portion 9f2 for separating one by one the recording media P stacked on the middle plate 9d. In addition, the separating claw 9f is provided, on the opposite side across the axis hole 9f1, with a pressuring portion 9f3 for pressuring upward the separating portion 9f2. By holding down this pressing portion 9f3 while placing a stack of the recording mediums P in the feeder cassette 9, the separating portion 9f2 is lifted to allow the recording media P to be easily inserted.

Adjacent to the separating claw 9f provided within the cassette main assembly 9a, a metallic aligning plate 9g is attached. When the recording medium P is fed out of the cassette 9 by a pickup roller 10a, it is guided along the aligning plate 9g, on the lateral side.

Referring to FIG. 19, a movable regulating member 9h is disposed within the cassette main assembly, adjacent to the corner diagonally opposite to where the separating claw 9f is disposed. This movable regulating member 9h regulates the recording medium P, at the rearward end as well as on the lateral side opposite to the one regulated by the aligning plate 9g, and also, is capable of accommodating the recording medium P in several different sizes. This regulating member 9h has lateral side pressing portions 9h1 and 9h2 for pressing the lateral side in order to regulate the recording medium P, a rearward end pressing portion 9h5 for regulating the recording medium P by pressing the rearward end, a grasping portion 9h3 to be grasped by an operator when the size of the recording medium P to be loaded is changed, and a hooking portion 9h4 to be used for engaging the regulating portion 9h with the cassette main assembly 9a.

The pressing portions 9h1 and 9h2 function to press the recording medium P against the aligning plate 9g, and the pressing portion 9h5 serves to hold the rearward end of the recording medium P, so that the recording medium P can be steadily fed out of the feeder cassette 9. The regulating member 9h is movable along the engagement slot 9i provided on the cassette main assembly 9a and can be set at two or more locations on the cassette main assembly 9a, which allows an operator to use a single feeder cassette 9 for several types of recording media different in size. This regulating member 9h can be adjusted so that the rearward end pressing portion 9h5 protrudes beyond the cassette main assembly 9a, allowing thereby the feeding of a recording medium P longer than the cassette main assembly 9a.

Further, the pressing portion 9h1 is provided with a recording medium size pointer 9j, adjacent to the forward end, and the cassette main assembly 9a is provided with a recording medium size index (B5, EXE, LTR, A4) 9k. Therefore, the operator can easily set the regulating member 9 at a proper location corresponding to the size of the recording medium P to be fed, just by aligning the size pointer 9j with a desired index mark on the recording medium size index 9k.

(Recording Medium Conveying Means)

Next, the recording medium conveying means 10 will be described, referring to FIG. 1. The recording medium conveying means 10 conveys the recording medium P stored in the feeder cassette 9 to an image forming station, and then, to the discharge tray 10j after the recording medium comes out of the fixing means 12. More specifically, as the conveyance of the recording medium P begins after the installation of the feeder cassette 9, the pickup roller 10a is rotated to separate and feed out, one by one from the top, the recording medium P from the feeder cassette 9. The fed-out recording medium P is conveyed rearward through the first reversing sheet path comprising conveying roller 10b, guide 10c, auxiliary rollers 10b, 10d2, and 10d3, and the like, whereby the recording medium P is reversed. Then, the recording medium P is conveyed to a pressure nip formed between the photosensitive drum 2 and the transferring roller 11, where the toner image having been formed on the drum 2 surface is transferred onto the recording medium P. The recording medium P having received the toner image is delivered, being guided by the cover guide 10e provided on the electrical component mounting board 14, to the fixing means 12, where the toner image is fixed. After being passed through the fixing means 12, the recording medium P is conveyed to the second reversal path, through the relay roller 10f. While being passed through this second reversing sheet path 10g, the recording medium P is reversed again, and then, is discharged by the discharge roller pair 10h and 10i onto the discharge tray 10j provided above both the scanner unit 8e and the installed process cassette B.

Next, referring to FIGS. 20–24, description is given as to a conveying unit for delivering the recording medium P from the cassette 9 to the image forming station. The aforementioned auxiliary rollers 10d1, 10d2, and 10d3 are slightly slanted by angles of $\alpha 1$, $\alpha 2$, and $\alpha 3$, respectively, relative to the axis of the conveying roller 10b. The presence of these angles generates a lateral pressure to shift laterally the recording medium P toward the conveying guide aligning surface 31 formed integrally on the frame 15.

Figure 20:
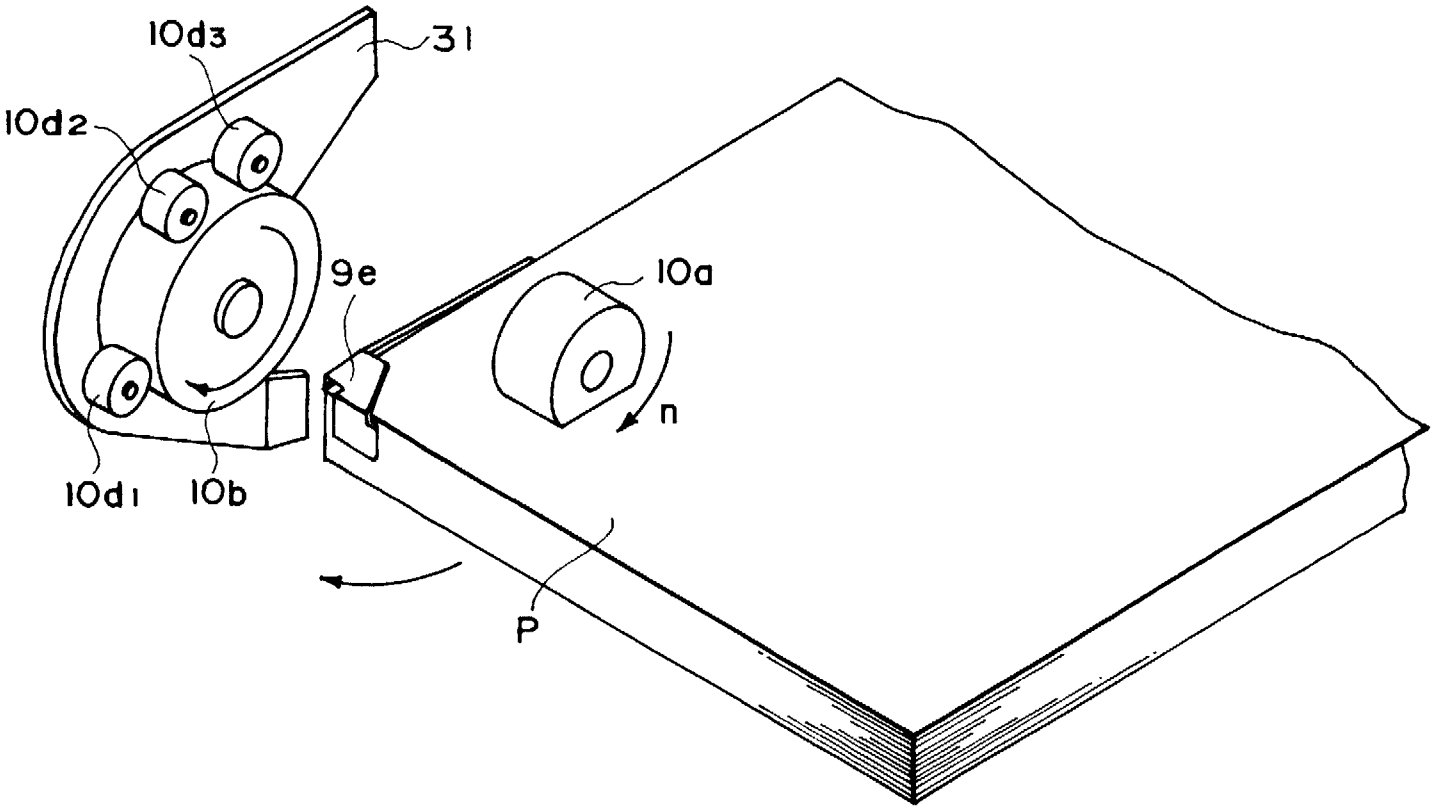
FIG. 20 depicts the structures of a conveying roller, and auxiliary rollers.

As is evident from FIG. 20, the conveying roller 10b does not have a length to cover the entire width of the recording material P, but instead, it covers only a small width of the recording medium P, adjacent to the aligning surface 31.

As for the definitions of angles $\alpha 1$, $\alpha 2$, and $\alpha 3$, they are the axial angles of the auxiliary rollers 10d1, 10d2, and 10d3 relative to a circumferential surface of phantom cylinder, which shares the same axis as the conveying roller 10, and the circumferential surface of which contains the centers of the auxiliary rollers. In this embodiment, these angles are set approximately as follows: $\alpha 1=0.5°$; $\alpha 2=4.0°$; and $\alpha 3=4.0°$. The overall pressure exerted on the conveying roller 10b by the auxiliary rollers 10d1, 10d2 and 10d3 are set to be approximately 400 g, wherein the pressure exerted by the auxiliary rollers 10d1, 10d2, and 10d3 for shifting laterally the recording material P is approximately 150 g, and the maximum pressure of the compression spring is set to be approximately 70 gf.

The apparatus main assembly is provided with the main motor 20, which is linked to a conveying gear 10b1 and a pickup gear 10a1, through a gear train. In particular, a gear which engages with the pickup gear 10a1 is disposed so as for its meshing portion to correspond to the toothless portion of the pickup gear 10a1. An unshown feeding roller solenoid is hooked up with a stopper portion 10a2 of the pickup roller 10a, preventing thereby the rotation.

Figure 21:
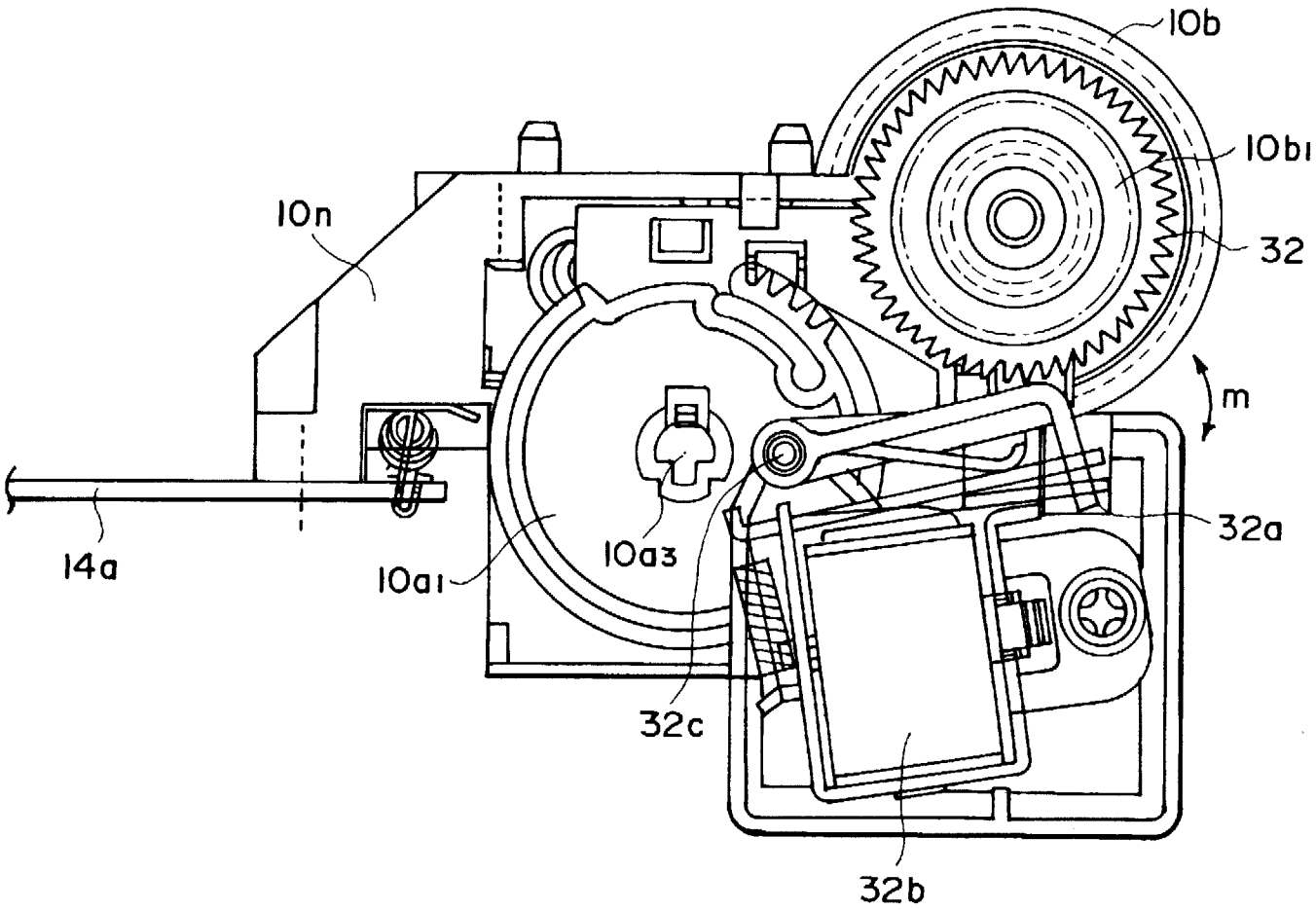
FIG. 21 is a sectional view of a conveying unit, depicting its structure.
Figure 22:
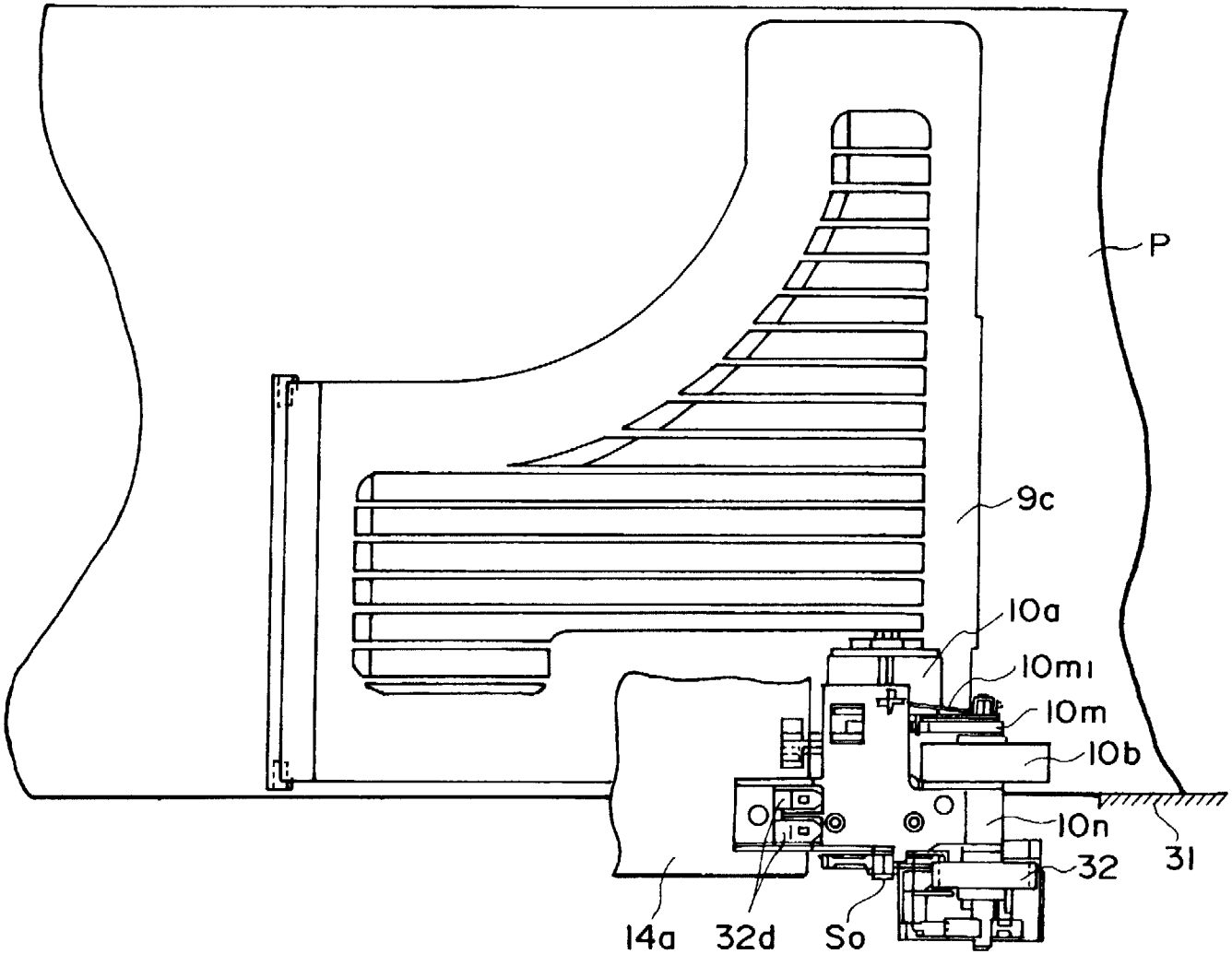
FIG. 22 is a plan view of the conveying unit.

Referring to FIG. 21, reference numeral 32 designates a clutch comprising a known built-in planetary gear train. A sun gear is rotated or stopped by a latch claw 32a which is rotated by a solenoid 32b about an axis 32c in the direction indicated by an arrow m, whereby the transmission of the driving force to the conveying roller 10 mounted on the axis of the clutch 32 is controlled. Referring to FIG. 22, a reference numeral 32d designates a solenoid terminal to which a lead wire from the solenoid 32b is crimped.

The pickup roller 10a for separating and feeding out, one by one, the recording medium P stacked in the cassette 9, is linked to the pickup gear 10a1 through a roller axis 10b3.

A reference numeral 10*m* designates a conveying roller lever, which is rotatable about the axis of clutch 32. Together with a conveying roller lever spring 10*m*1, the conveying roller lever 10*m* pressures a cam portion provided on the pickup roller 10*a*, in the rotational direction indicated by an arrow n in FIG. 20.

Figure 23:
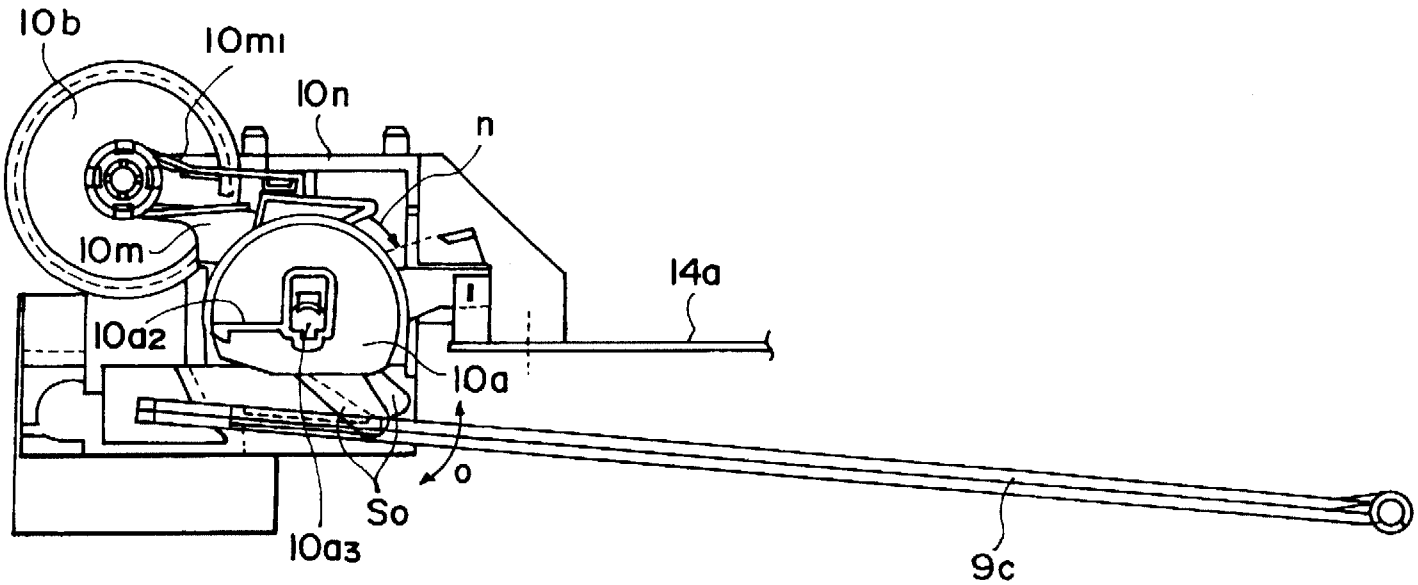
FIG. 23 depicts an essential portion of the conveying unit.

Referring to FIG. 22, a reference numeral So designates a recording medium sensor, which detects the absence of the recording medium by pivoting in the direction indicated by an arrow o in FIG. 23 when the recording medium P is not present on the middle plate 9*d* of the cassette 9.

These components described in the preceding paragraphs are mounted on a feeder frame 10*n*. In addition, a sensor arm is rotatively mounted on a boss portion of the feeder frame 10*n*, constituting all together the feeder unit.

In this embodiment, the passage for conveying the recording medium P comprises the first and second sheet reversing paths, forming thereby a so-called S-shape. Therefore, not only can the space occupied by the apparatus be further reduced, but also, after the image is recorded, the recording medium P is stacked in the normal paginal order, with the image facing downward.

Referring to FIG. 1, sensors S1, S2, and S3 are provided along the recording medium P conveying passage, for detecting the presence, absence, or the like, of the recording medium P.

The sensor S1 is a registration sensor, which detects the leading end of the recording medium P being delivered to the transferring roller 11 from the cassette 9, providing thereby the laser scanner 8 with a timing for laser beam writing, and also, when the image forming apparatus is started, it detects whether or not the recording medium P had been left within the apparatus main assembly.

Figure 24:
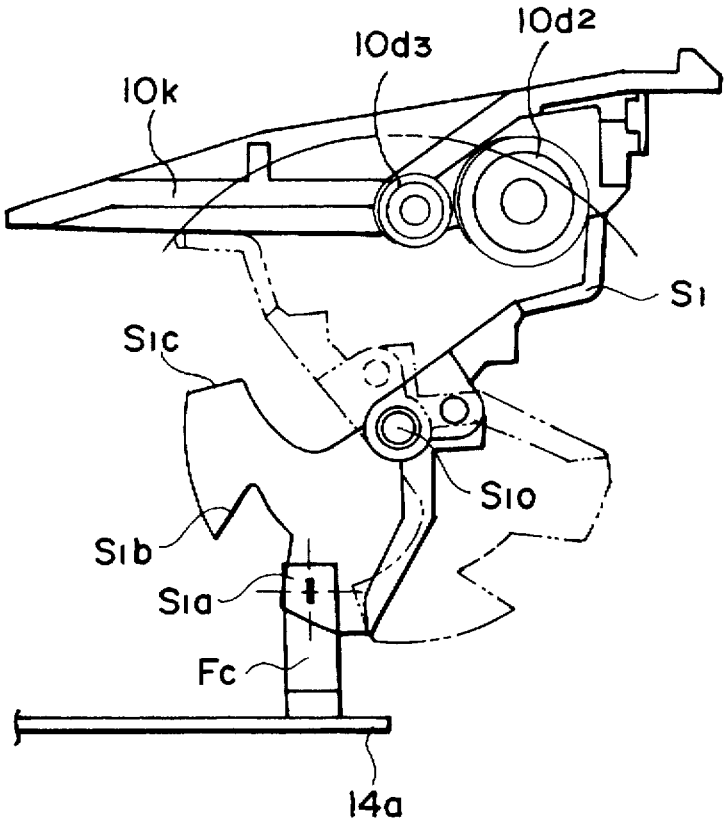
FIG. 24 depicts a registration sensor.

Referring to FIG. 24, the registration sensor S1 is rotatable about an axis Sol, and is provided with edge portions S1*a*, S1*b*, and S1*c* for generating three signals. The edge portion S1*a* generates a signal to indicate whether or not a manually fed recording medium is present. The edge portion S1*b* generates a signal to indicate the presence of a recording medium P having been picked up and being on stand-by. The edge portion S1*c* generates a signal for providing the writing timing for the laser. More specifically, each signal is generated as a photointerruptor FC disposed on the electrical component mounting board detects each of the edge portions S1*a*, S1*b*, and S1*c*.

The sensor S2 is a discharge sensor, which not only detects the leading and trailing ends of the recording medium P after the recording medium P has passed the fixing means 12, but also, when the image forming apparatus is started, it detects whether or not the recording medium P had been left behind in the apparatus main assembly.

The sensor S3 is a sensor provided along the sheet path from the toner image transferring point to the fixing means 12, for detecting whether or not the recording medium P had been left behind, and at the same time, it serves as a sensor for detecting whether or not a rear lid 16*f* is open.

With the provision of these sensors, when the apparatus is jammed, a main control detects the occurrence of the jam, based on the relation between the recording medium feeding timing and the signals from the sensors S1 and S2, bringing thereby the apparatus to an emergency stop and displaying a jam symbol.

More specifically, whether or not the recording medium P has been jammed in the fixing means is determined following manner: when the control does not receive from the discharge sensor S2 a signal indicating that the discharge sensor S2 has detected the arrival of the leading end of the recording medium P, it counts the time which has elapsed since the recording medium had been fed, and when it finds that the elapsed time is longer than the time required for the leading end of the recording material P to reach the discharge sensor S2, it determines that the recording medium P has been jammed in the fixing means, bringing thereby the apparatus to an emergency stop.

(Transferring Means)

The transferring means 11 transfers the toner image formed on the photosensitive drum 2 in the image forming station, onto the recording medium P. The transferring means 11 of this embodiment comprises a transferring roller 11, as shown in FIG. 1. The transferring roller 11 presses the recording medium P onto the photosensitive drum 2 of the installed process cartridge B. With the recording medium P being pressed upon the photosensitive drum 2, a voltage having the polarity opposite to that of the toner image is applied to the transferring roller 11, whereby the toner image on the photosensitive drum 2 is transferred onto the recording medium P. A reference numeral 11*a* designates a spring, which pressures the transferring roller 11 onto the photosensitive drum 2.

On the upstream side of the transferring roller 11, relative to the recording medium conveyance direction, there is a guide member 11*b*, which stabilizes the recording medium P as the recording medium P enters into the nip between the photosensitive drum 2 and the transferring roller 11, and at the same time, shields the surface of the transferring roller 11 to prevent the toner from being scattered.

After being passed through the nip between the photosensitive drum 2 and transferring roller 11, the recording medium P is conveyed in the downward direction, at an approximate angle of 20° relative to the horizontal line, so that it can be surely separated from the photosensitive drum 2 after the transfer operation.

(Fixing Means)

The fixing means 12 fixes the toner image, which has been transferred onto the recording medium P by the voltage application to the transferring roller 11. Its structure is as shown in FIG. 1. In the fixing means 12, a reference numeral 12*a* designates a heat resistant film guide member shaped like a trough, the cross section of which forms a substantial semicircle. On the under side surface of this guide member 12*a*, a low thermal capacity ceramic heater 12*b* of a flat plate shape is disposed, extending along the approximate longitudinal center line. Further, around the guide member 12*a*, a cylindrical (endless) thin film 12*c* of heat resistant resin is loosely fitted. This film 12*c* comprises three layers: an approximately 50 μm thick polyimide base film, an approximately 4 μm thick primer layer, and an approximately 10 μm fluorine coat layer. The base layer material has a high tensile strength and it is thick enough to withstand various stresses or wear inflicted upon the film. This primer layer is made of the mixture of polyamideimide resin, fluorinated resin, and carbon; therefore, it is electrically conductive.

Also on the under side of the guide member 12*a*, a pressure roller 12*d* is disposed in contact with the ceramic heater 12*b*, with constant pressure provided by a spring (not shown), and the film 12*c* being interposed. In other words, the ceramic heater 12*b* and pressure roller 12*d* form a fixing nip, with the film 12*c* being interposed. The pressure roller 12*d* comprises a metallic core and soft silicone rubber, and the silicone rubber has fluorine coated on its peripheral surface.

The ceramic heater 12*b* is provided with a thermistor chip (unshown), and the power supply to the ceramic heater 12*b* is controlled by the temperature control system of a control portion, which will be described later, in response to the signal from the thermistor, so that a predetermined fixing temperature can be obtained. The pressure roller 12*d* is fitted with a gear at one axial end, and is rotated counterclockwise as indicated by an arrow in FIG. 1, at a predetermined peripheral velocity. As the pressure roller 12*d* is rotatively driven, the cylindrical film 12*c* is clockwise rotated at a predetermined peripheral velocity around the film guide member 12*a* as indicated by the arrow mark in FIG. 1, by the friction between the roller 12*d* and film 12*c*, through the fixing nip, remaining tightly in contact with and sliding on the downward facing surface of the ceramic heater 12*b*.

After undergoing the image transfer process, the recording medium P is delivered to the fixing means 12, where it is guided by an entrance guide 12*f* into the fixing nip formed between the temperature controlled ceramic heater 12*b* and pressure roller 12*d*. In the fixing nip, the recording medium P is fed between the cylindrical film 12*c* which is being rotatively driven, and pressure roller 12*d*, and is passed through the nip together with the film 12*c* in a manner of being laminated together, remaining tightly pressed upon the downward facing surface of the ceramic heater 12*b*, with the film 12*c* being interposed.

While passing through the fixing nip, the unfixed toner image on the recording medium P receives, through the film 12*c*, the heat from the ceramic heater 12*b*, whereby the toner image is thermally fixed on the recording medium P. After coming out of the fixing nip, the recording medium P is separated from the surface of rotating film 12*c*, and is guided by an exit guide 12*g* to the conveying roller 10*f*.

(De-curling after Fixing Operation)

The recording medium P is curled while being heated by the fixing means 12. Therefore, in this embodiment, after being passed through the fixing means 12, the recording medium P is de-curled before it is discharged onto the discharge tray 10*j*.

Figure 25:
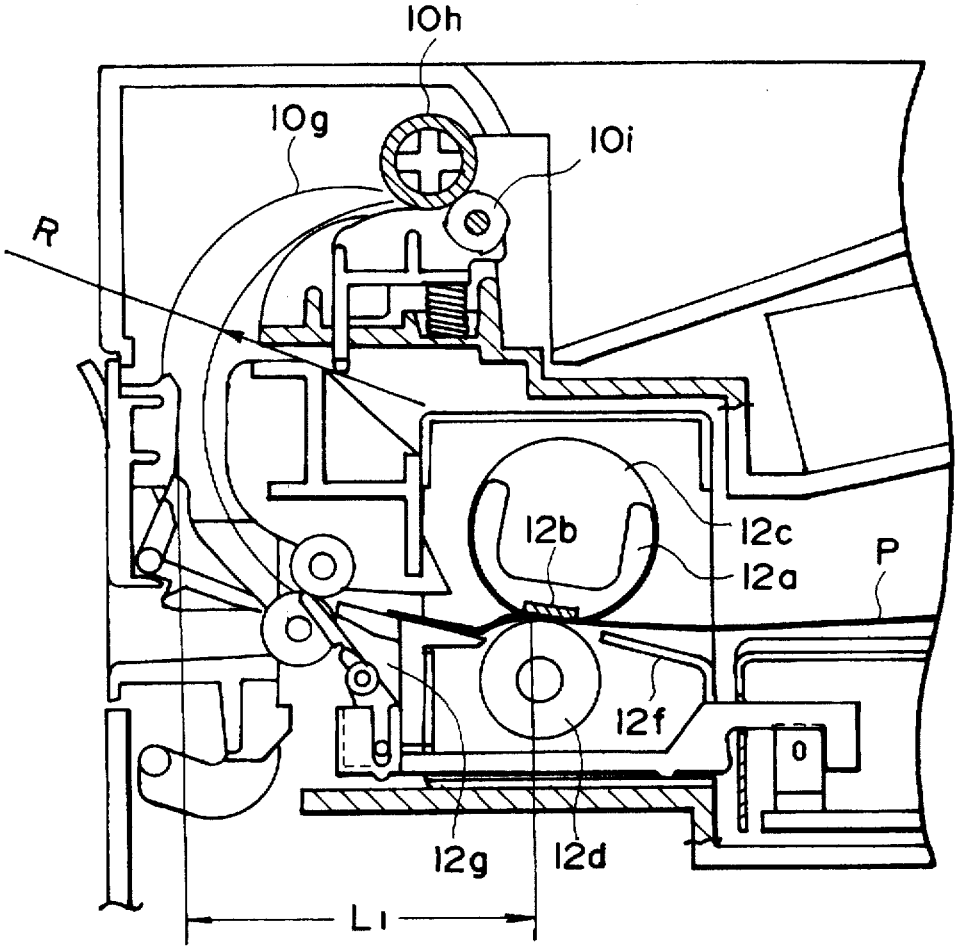
FIG. 25 depicts a structure for de-curling a recording medium after a fixing operation.

More specifically, referring to FIG. 25, when a plain paper which is commonly used as the recording medium P is heated by the plate-shaped heater 12*b*, it curls toward the non-heated side due to the temperature difference between the heated and non-heated surfaces. The plain paper is easiest to curl by the application of a curvature when the paper temperature is in an approximate range of 60° C.–90° C. Therefore, in this embodiment, the recording medium P, having been curled downward in the fixing nip, is conveyed by a distance L1 of approximately 40 mm in a straight line, and then, is passed through the second sheet path 10*g* forming a curvature having a radius R of approximately 30 mm, so that the recording medium P is subjected to a curvature opposite to that of the curl caused in the fixing nip.

Through this process, the recording medium P having been heated to approximately 120° C. by the heater 12*b* cools down to approximately 75° C., that is, an appropriate paper temperature, while being conveyed a straight distance L1. Then, as the recording medium P is conveyed so as to be curled in the reverse direction, the curl generated in the fixing means 12 is effectively corrected and the recording medium P is discharged onto the discharge tray 10*j*. Therefore, this embodiment does not require a special component such as a de-curling roller dedicated to correction of the curl.

(Gear Unit)

The gear train which transmits the rotational driving force to the photosensitive drum 2, pickup roller 10*a*, or the like will be described.

(Creation of Gear Train Unit)

Figure 26:
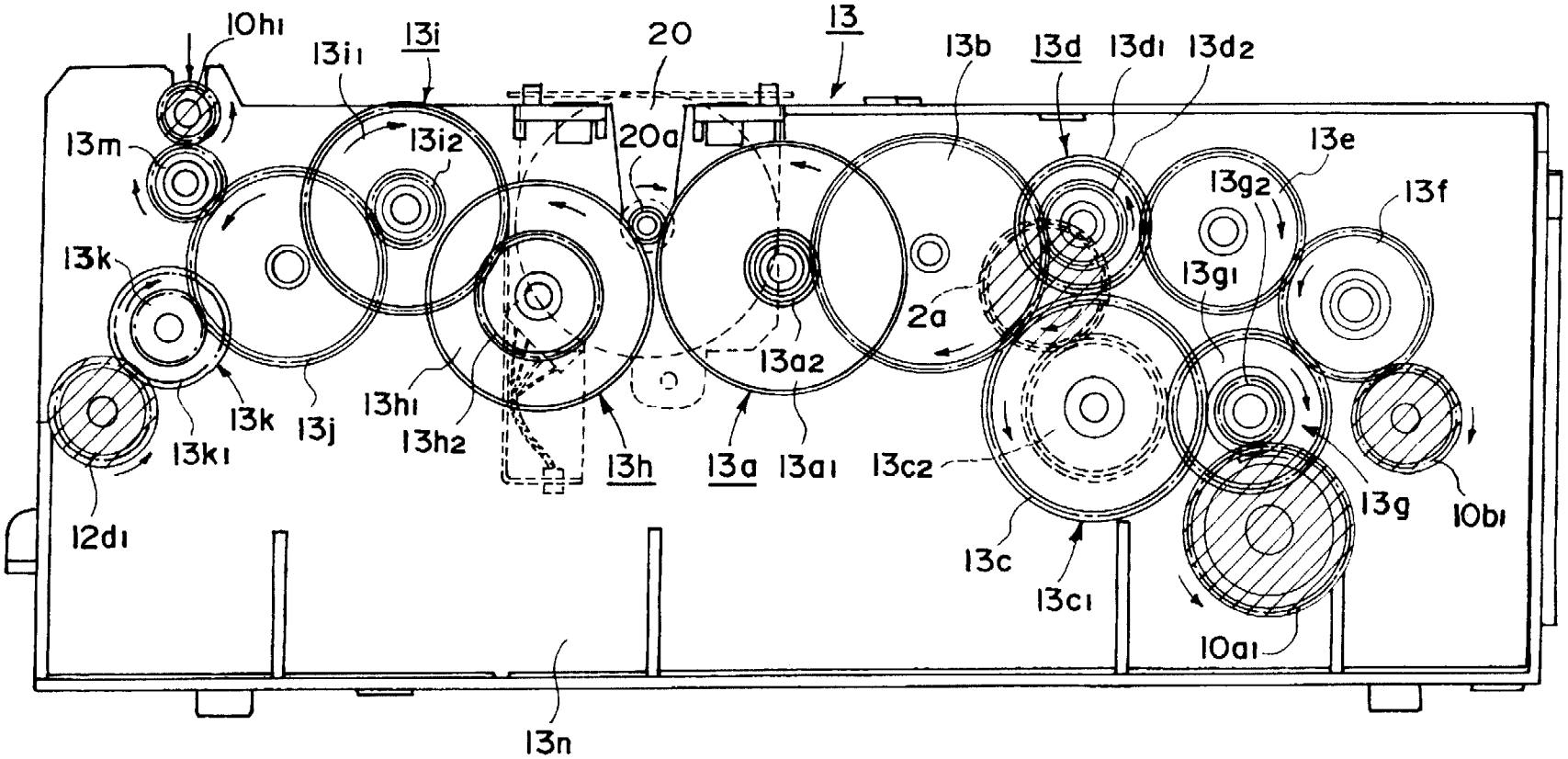
FIG. 26 depicts a gear train.
Figure 27:
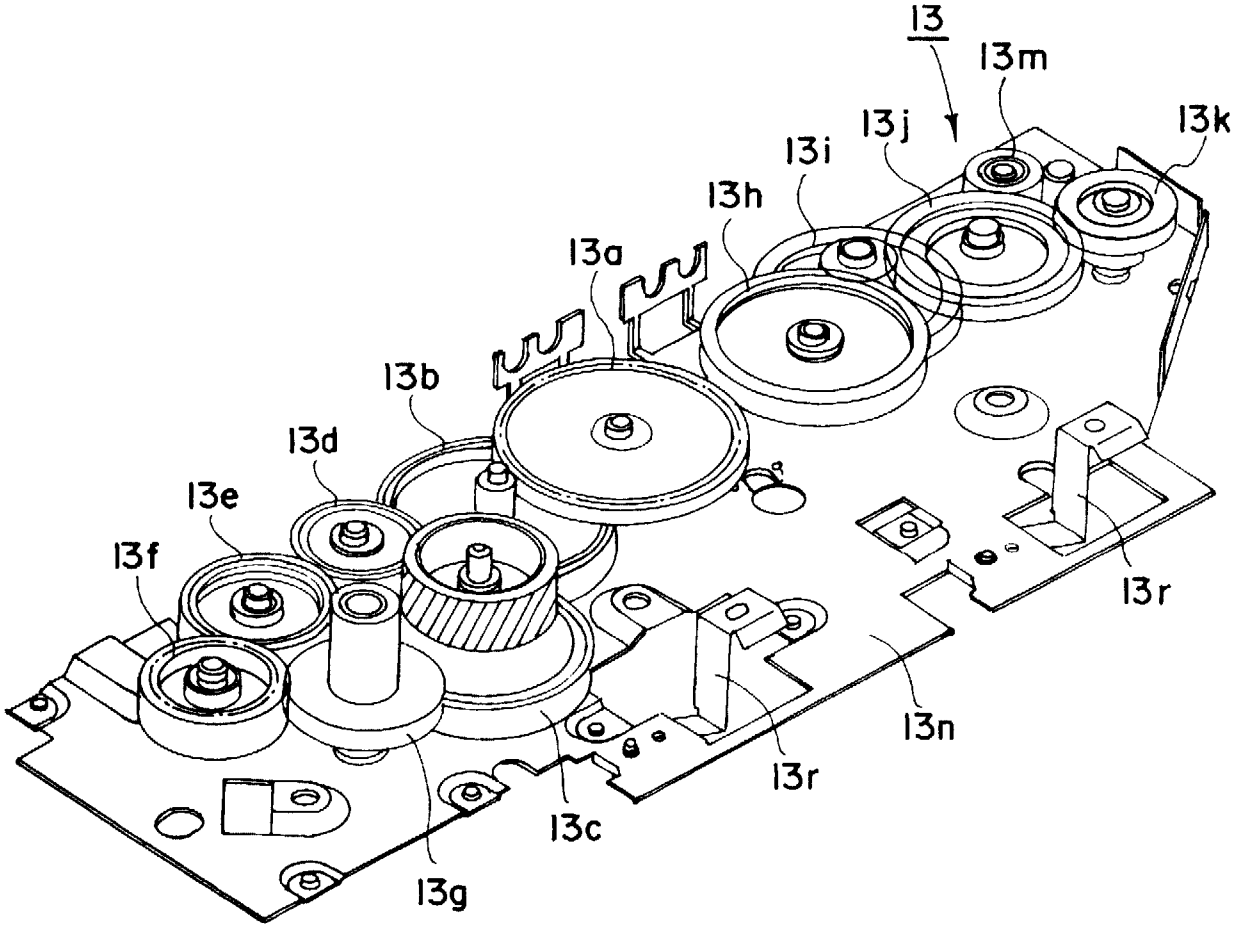
FIG. 27 is an oblique view of the gear unit.
Figure 28:
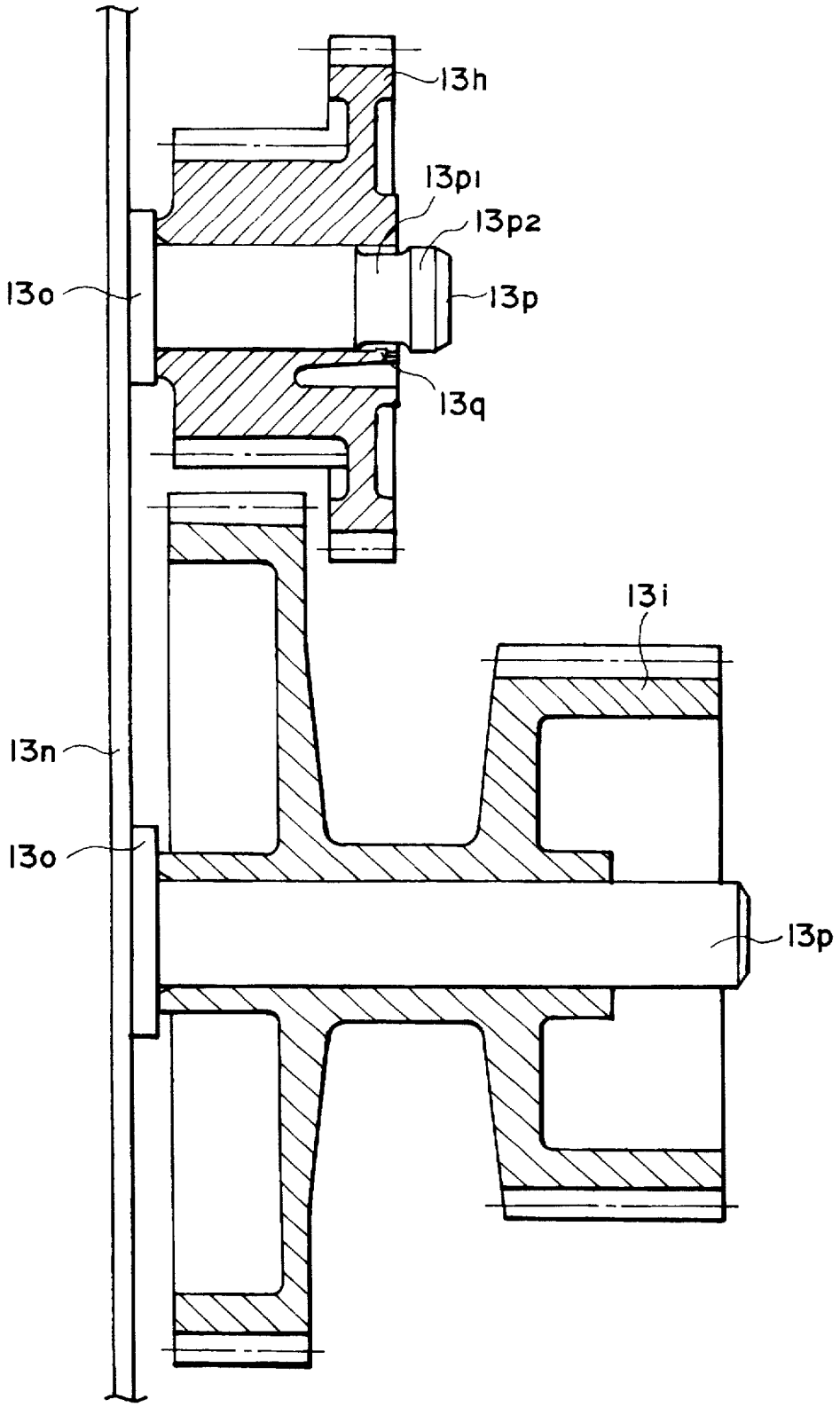
FIG. 28 depicts how the gears are attached.

In the image forming apparatus of this embodiment, all the mechanical components, except for those in the scanner unit 8*e* and a cooling fan 19, are driven by a single driving force source, the main motor 20. This driving force from the main motor 20 is transmitted to each operational member through the gear train illustrated in FIGS. 26–28, wherein FIG. 26 is a plan view of the gear train; FIG. 27 is an oblique view of the gear unit; and FIG. 28 is a sectional view depicting how the gears are mounted.

Most of gears in the gear train of this embodiment are concentrated on one of the lateral sides of the frame 15. Referring to FIG. 26, among these gears of this gear train, the ones that transmit the driving force are the following five gears: (1) pickup gear 10*a*1 mounted on the same axle as that for the pickup roller 10*a*, for conveying the recording medium P from the cassette 9; (2) conveying gear 10*b*1 mounted on the same axle as that for the conveying roller 10*b*, for conveying the recording medium P having been delivered by the pickup roller 10*a*; (3) drum gear 2*a* attached to the photosensitive drum 2; (4) relay roller gear 10*f*1 for transmitting the driving force to the fixing gear mounted on the same axle as that for the pressure roller 12*d* of the fixing means 12; and (5) discharging gear 10*h*1 mounted on the same axle as that for the discharging roller 10*h*.

In order to form images by driving the image forming apparatus, the developing sleeve 4*d*, toner feeding member 4*b*, transferring roller 11, polygon mirror 8*b*, and cooling fan 19 must be mechanically driven in addition to those mentioned in the foregoing, wherein the developing sleeve 4*d*, toner feeding member 4*b*, and transferring roller 11 receive the driving force from a gear meshed with the drum gear 2*a* when the photosensitive drum 2 is rotated, whereas the polygon mirror 8*b* is driven by the scanner motor 8*c*, and the cooling fan 19 is driven by its own fan motor.

In the gear train shown in FIG. 26, the driving force generated by the main motor 20 is divided into the left and right forces through a motor pinion gear 20*a*, that is, one for a system which drives the drum and conveying means and the other for a system which drives the fixing means and discharging means. The drum and conveying means driving system is a system for driving the photosensitive drum 2 and conveying means 10 and is in charge of the operational range starting from the feeding of the recording medium P to the image formation. The drum driving gear train comprises: motor pinion 20*a*, large diameter gear 13*a*1 and small diameter gear 13*a*2 of double gear 13*a*, idler gear 13*b*, large diameter gear 13*c*1 and small diameter gear 13*c*2 of double gear 13*c* which is the drum driving gear, being engaged to each other in this order, wherein the small diameter gear 13*c*2 transmits the driving force to the photosensitive drum 2 by engaging as the driving gear with the drum gear 2*a*.

Figure 51:
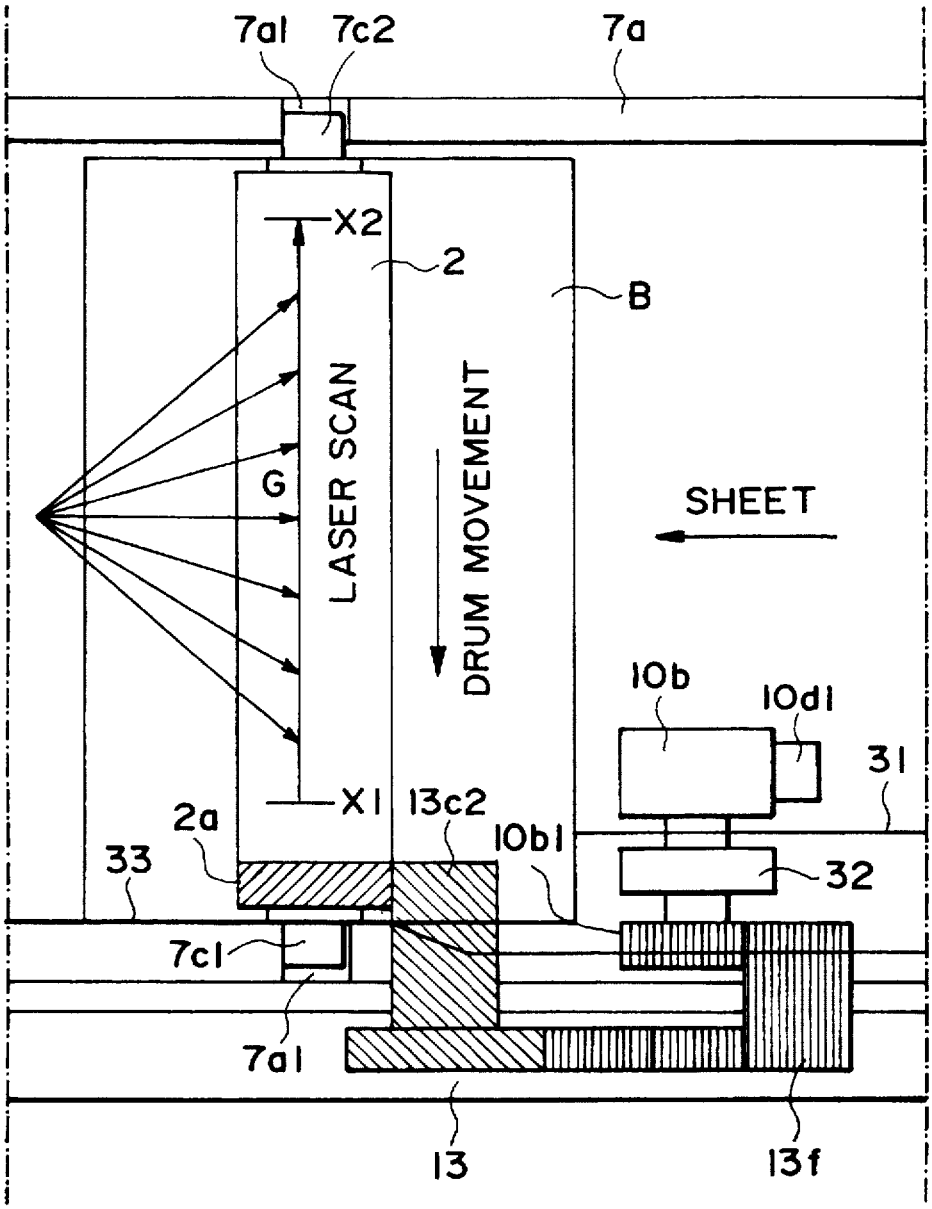
FIG. 51 is a schematic of an exemplary structure in which a conveyance reference, a cartridge reference, and a scanning starting reference are all provided on the same side.

The conveying means driving gear train comprises: idler gear 13*b*, small diameter gear 13*d*2 and large diameter gear 13*d*1 of double gear 13*d*, idler gear 13*e*, conveying means driving gear 13*f*, being engaged in this order, wherein this conveying means driving gear 13*f* transmits the driving force to the conveying roller 10*b* by engaging with the conveying gear 10*b*1. As described hereinbefore, this conveying roller 10*b* is united with the conveying gear 10*b*1, pickup roller 10*a*, feeding gear 10*a*1, and the like, being formed into a feeding unit, and is assembled as a unit into the apparatus main assembly 6. In this feeding unit, a clutch 32 (FIG. 51) is provided, by which the conveying roller 10*b* is rotated in reverse, relative to the conveying gear 10*b*1.

The conveying means driving gear 13*f* is meshed with the large diameter gear 13*g*1 of the double gear 13*g* which is the feeding means driving gear, and the small diameter gear 13*g*2 of the double gear 13*g* is meshed with the pickup gear 10*a*1, whereby the driving force is transmitted to the pickup roller 10*a*.

The gears of the gear train are made of resin material, wherein, since the double gear 13*a*, idler gear 13*b*, and double gear 13*c* transmits the driving force to the photosensitive drum 2 which carries a larger rotational load, they are made of special resin filled with glass fiber to increase their strength.

The fixing means and discharging means driving system, that is, the other system, drives the fixing means and the driving means. The fixing means driving gear train comprises: motor pinion 20*a*, large diameter gear 13*h*1 and small diameter gear 13*h*2 of double gear 13*h*, large diameter gear 13*i*1 and small diameter gear 13*i*2 of double gear 13*i*, idler gear 13*j*, small diameter gear 13*k*1 of double gear 13*k* which is a fixing means driving gear, being engaged to each other in this order, wherein the large diameter gear 13*k*2 is meshed with the relay roller gear 10*f*1, transmitting the driving force to the pressure roller 12*d*.

The idler gear 13*j* is meshed with the discharging means driving gear 13*m*, and this gear 13*m* is meshed with the discharging roller 10*h*, transmitting thereby the driving force to the discharging roller 10*h*.

Referring to FIG. 27, the gears of the gear train are mounted on a supporting member 13*n* made of a sheet of steel plate, being united as the gear unit. Referring to FIG. 28, as for a method for mounting each of these gears on the supporting member 13*n*, a gear axle 13*p* having a flange 13*o* is crimped onto the supporting member 13*n*, and then, each of gears 13*a*–13*m* is mounted on the gear axle 13*p*. Adjacent to the ends of some axles 13*p*, ring-like grooves 13*p*1 are cut, and the axle hole portion of the double gear 13*h*, for example, through which the axle 13*p* is put through, is provided with an elastically deformable projection 13*q* which can fit into the groove 13*p*1. When this gear 13*h* is mounted on the axle 13*p*, the projection 13*q* elastically deforms to ride over a straight portion 13*p*2 and drop into the groove 13*p*1. With the projection 13*q* being fitted in the groove 13*p*1, the gear 13*h* is not likely to easily come off the axle 13*p*.

Further, the gears such as the gear 13*h* having the projection 13*q* are strategically disposed so that when a force is exerted in a manner to cause other gears, which do not have a projective portion (for example, gear 13*i*), to come off the axle 13*p*, the gears with the projection 13*q* can serve as a deterrent for preventing them from easily coming off. Because of such an arrangement, each gear of this gear unit is not likely to come off after it is mounted on the gear axle 13*p* of its own; therefore, the gear unit is easier to handle during transportation or the like.

Also, since all the gear axles 13*p* are provided with the flange 13*o*, not only are their chances of falling down during the crimping operation minimized, but they are also reinforced against the load inflicted upon them in a manner so as to collapse them during the transmission of the driving force. Further, since the driving force from the main motor 20 is dividedly transmitted to the left and right sides, balance is improved among the loads inflicted upon the pinion gear 20*a* in a manner to collapse it; therefore, the motor pinion gear 20 is more difficult to collapse.

Since the gears of the gear train are united into a gear unit by means of mounting them on a single-piece supporting member 13*n*, occurrence of gear pitch error among a large number of gears is minimized; therefore, the driving force can be precisely transmitted. As for the transmission efficiency per gear of the gear unit in this embodiment, it has been increased to approximately 95% or higher.

Out of all the gears in the gear train, all of the gears 13*a*–13*c* of the gear train portion for transmitting the driving force to the photosensitive drum 2 are helical gears, and the rest (gears other than those meshing with the helical gears) are spur gears. The direction of the helix angle of the helical gear is determined based on the rotational direction of the photosensitive drum 2. More specifically, it is determined so that the thrust generated by the helical gear is directed to pressure the photosensitive drum 2 toward the aligning reference surface of the frame. The aligning reference surface of the frame will be described later.

Right after the process cartridge B has been installed, it is impossible to tell where the process cartridge B is located in the gap between the frame 15 and the process cartridge in the thrust direction of the drum axle, but when the gear train begins to rotate for the image formation, the entire process cartridge B is pushed toward the aligning reference surface of the frame 15 by the thrust generated by the meshing helical gears, being abutted on the aligning reference surface. Also, within the process cartridge B, the photosensitive drum 2, which is allowed some play in the thrust direction, is abutted on the aligning reference surface by the same thrust, whereby the positions of the process cartridge B and photosensitive drum 2 relative to the apparatus main assembly 6 are fixed. The reference for fixing the position of the cartridge will be described later.

The helix angle of the helical gear is necessary to be large enough to produce a stable pressure in the thrust direction for keeping the photosensitive drum 2 abutted on the aligning reference surface while allowing the gear to rotate stably. However, too large a thrust is liable to reduce the transmission efficiency, to cause gear damage, or to trigger like situations. In consideration of such concerns, in this embodiment, the helix angle at the meshing portion between the drum driving gear 13*c*2 and drum gear 2*a* is set at approximately 14.6°.

The thrust generated by the helical gear abuts the process cartridge B and photosensitive drum 2 on the aligning reference surface, as well as causes the driving force transmission efficiency to drop. Therefore, where the thrust is not needed, a spur gear is used, or in the case of the double gear comprising the helical gears, the directions of the helix angles of the large and small gears are rendered to be the same so that the thrusts can be canceled.

<Sandwiching of Gear Train>

The gear unit 13 is mounted on the lateral wall of the frame 15. More specifically, referring to FIG. 29, the surface of the left lateral wall of the frame 15, which serves as the aligning reference surface, is provided with holes 15*a* for fitting the gear axles 13*p* to which the gears 13*a*–13*m* of the gear unit 13 have been mounted, respectively. After fitting the gear axles 13*p* into these holes 15*a*, the supporting member 13*n* is screwed to the frame 15, with the screws put through screw holes provided at predetermined locations of the supporting member 13*n*, completing thereby the mounting of the gear unit.

Out of these gear axles 13*p*, a gear axle 13*p*1 for supporting the drum driving gear 13*c* (FIG. 26) and a gear axle 13*p*2 for supporting the double gear 13*h* are put through the holes 15*a*1 and 15*a*2 of the frame 15 and fixed there, respectively, whereby the position of the gear unit 13 relative to the frame 15 is fixed. Since the drum driving gear 13*c* is a gear for transmitting the driving force to the photosensitive drum 2, the gear axle 13*p*1 for supporting this gear 13*c* is subjected to the largest load. However, the gear axle 13*p*1 is put through the frame hole 15*a*1 and fixed there, whereby the gear axle 13*p*1 is supported at both ends, by the frame hole 15*a*1 and supporting member 13*n*, respectively; therefore, the collapsing of the gear axle 13*p*1 or a like incident is unlikely to occur.

The gear axles 13p other than the two axles mentioned in the foregoing are also fitted in the frame holes 15a, but the states of engagements between these gear axles 13p and holes 15a are rather rough compared to those of the aforementioned two gear axles. In other words, these axles and holes serve as a sort of guide when the gear unit 13 is mounted on the frame 15.

As the gear unit 13 is mounted on one of the lateral walls of the frame 15, the driving gears (more specifically, drum driving gear 13c, feeding means driving gear 13f, conveying means driving gear 13g, fixing means driving gear 13k, and discharging means driving gear 13m) for transmitting the driving force to the drum gear 2a and the like project into the frame interior through the windows 15b provided on the lateral wall of the frame 15, being exposed within the frame interior, either entirely or partially, and become meshed with the counterpart gears such as the drum gear 2a.

Also, the driving gears are mounted on the gear unit in such a manner that when the gear unit 13 is mounted on the frame 15, they are going to be disposed within the frame, at more inward locations than where the gears (drum gear 2a and the like) driven by these driving gear are going to be disposed. In other words, after the gear unit 13 has been mounted on the frame 15, the driving gears are disposed at more inward locations than where the driven gears are going to be disposed, so that when the driven gears are mounted, the driving gears will be waiting within the frame, being disposed at the more inward locations. Therefore, the positional relationship between the gear unit 13 and each of the driven gears is such that either one can be mounted first, and any of them can be independently removed.

By uniting the gears of the gear train, in the form of a gear unit 13, and mounting them as the gear unit 13 on the frame 15, the gear train can be mounted, extremely simply and precisely. In addition, the gear train becomes interposed between (sandwiched by) the lateral side wall and supporting member 13n. Therefore, there is no possibility that the gear trains are touched by fingers or the like, that the state of gear meshing is disturbed by a collision with foreign matter, nor that the oil from the gear train is scattered to the external case 16 or the like. Further, since the gear train is sandwiched between the frame 15 and supporting member 13n, the noises generated as the gears of the gear train rotate can be reduced.

Figure 29:
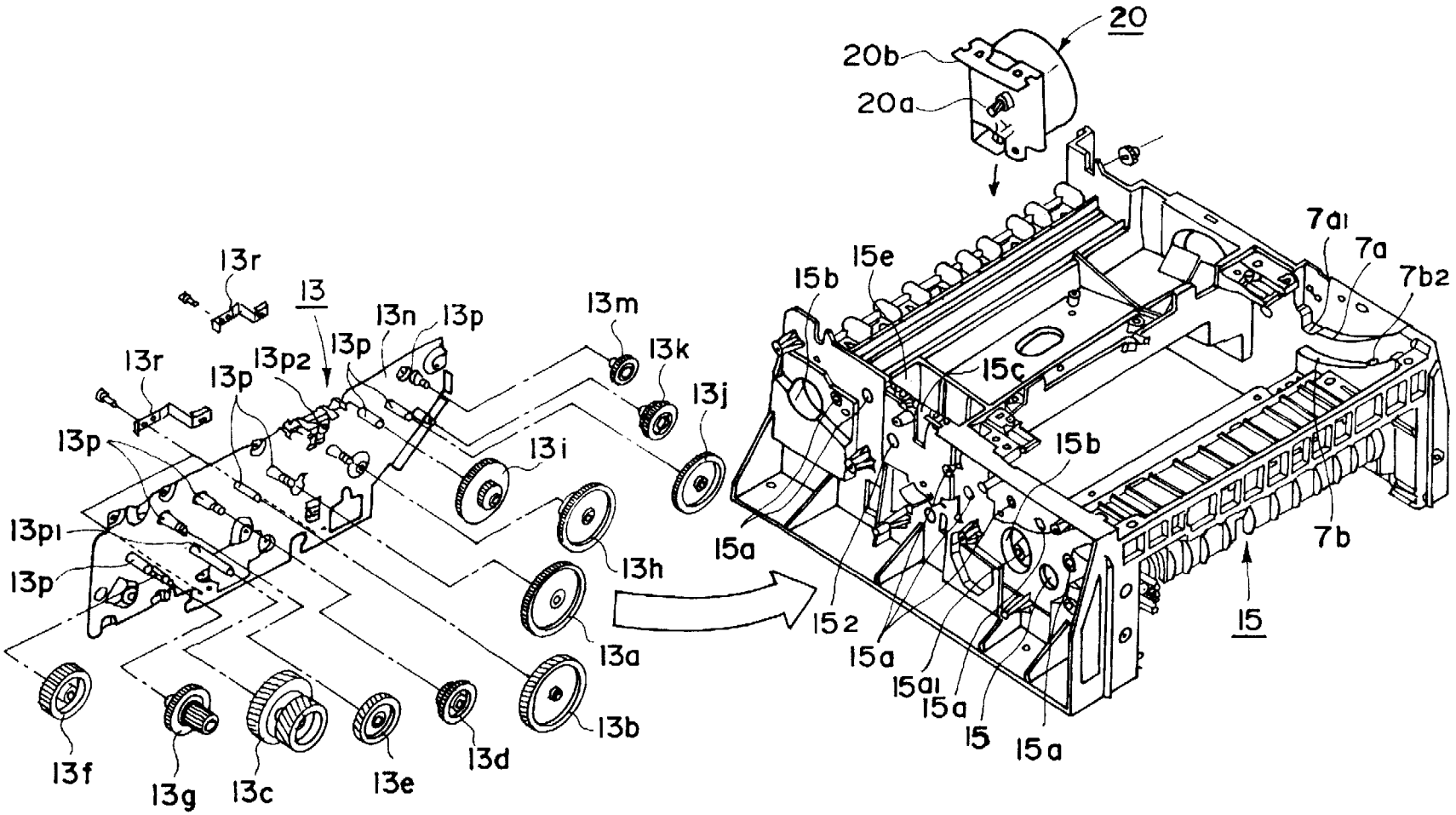
FIG. 29 depicts how the gear unit is mounted on the lateral side surface of the frame.
Figure 30:
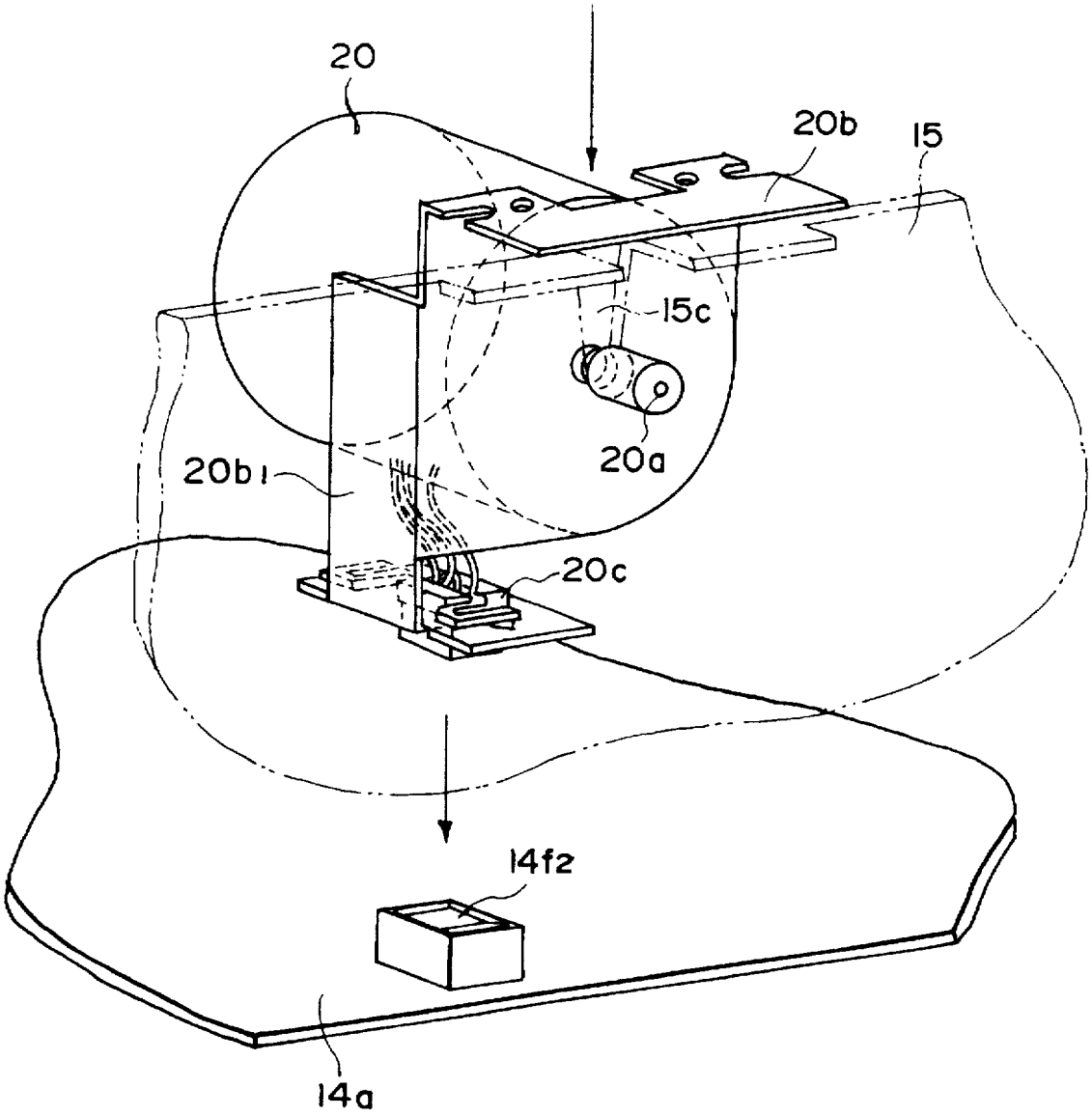
FIG. 30 depicts how a main motor is mounted.

After the gear unit 13 is mounted on the frame 15, the main motor 20 for supplying the driving force to the gear train of the gear unit is mounted. On the left lateral wall of the frame 15, a U-shaped groove 15c is provided as shown in FIGS. 29 and 30. As the motor 20 is lowered in a manner so as for the bearing portion of the motor 20 to be fitted into this U-shaped groove 15c, a motor pinion 20a drops into the valley formed between the double gears 13a and 13h of the gear unit 13, becoming meshed with both gears 13a and 13h (FIG. 26). The main motor 20 is provided with a mounting plate 20b, and is fixed by screwing this mounting plate 20b to the left lateral wall of the frame 15.

The mounting plate 20b is provided with a leg portion 20b1 which extends downward as shown in FIG. 30, and at the end of the leg portion, a connector 20c is attached. As the motor bearing portion is lowered into the U-shape groove 15c in order to mount the main motor 20 on the frame 15, the connector 20c engages with a motor connector 14f2 provided on the electrical component mounting board 14a.

As the motor 20 is mounted, the mounting plate 20b partially overlaps with the supporting member 13n, whereby the heat generated by the rotating motor 20 is conducted to the supporting member 13n made of metallic plate, through the mounting plate 20 also made of the metallic plate, to be dissipated. In other words, the supporting member 13n functions as a radiating plate.

Referring to FIGS. 27 and 29, with the presence of thin stainless steel plates 13r screwed on the supporting member 13n, the supporting member 13n of the gear unit 13 is electrically connected to the shield plate of the electrical component unit 14 which is mounted at the bottom portion of the frame 15. Therefore, the electrical potential of the supporting member 13n remains at ground level, and the ligning reference surface of the frame 15 is entirely shielded by the supporting member 13n. Further, as described previously, the metallic mounting plate 20b of the main motor 20 overlaps with the supporting member 13n; therefore, the potential of the surface of the motor 20 remains at the ground level. Though the supporting member 13n of this embodiment is made of steel plate, it may be made of material other than steel plate, for example, stainless steel plate, aluminum plate or the like. As long as the material is electrically conductive, it functions as the shield plate.

Since the supporting member 13n functions as the shield plate as described in the foregoing, it is preferable to mount an interface or the like on this supporting member 13n and cover it with metallic plate. With this arrangement, the interface or the like is disposed between the metallic plates, which simplifies the shielding. (Electrical Component Unit)

Figure 31:
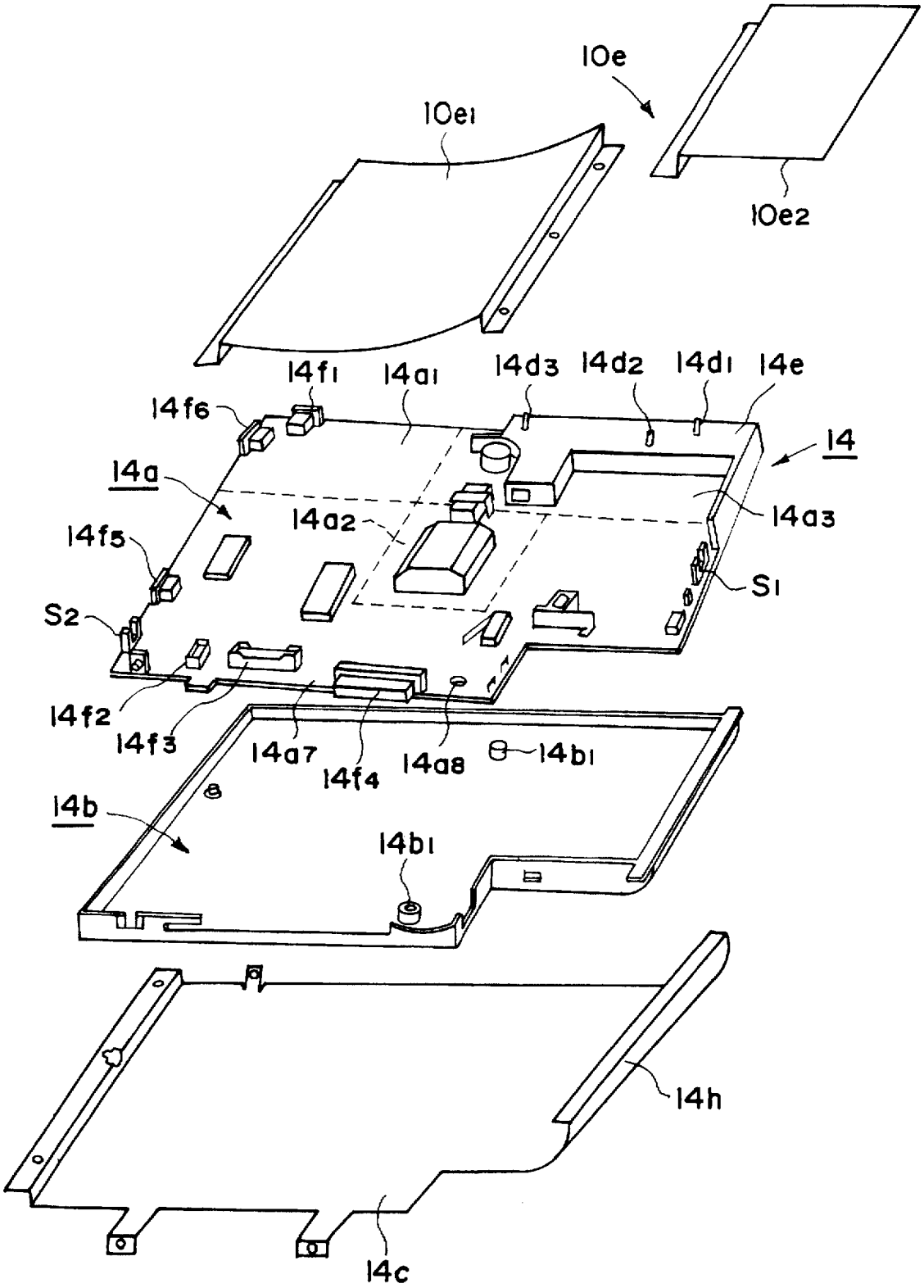
FIG. 31 is an exploded view of an electrical component unit.
Figure 32:
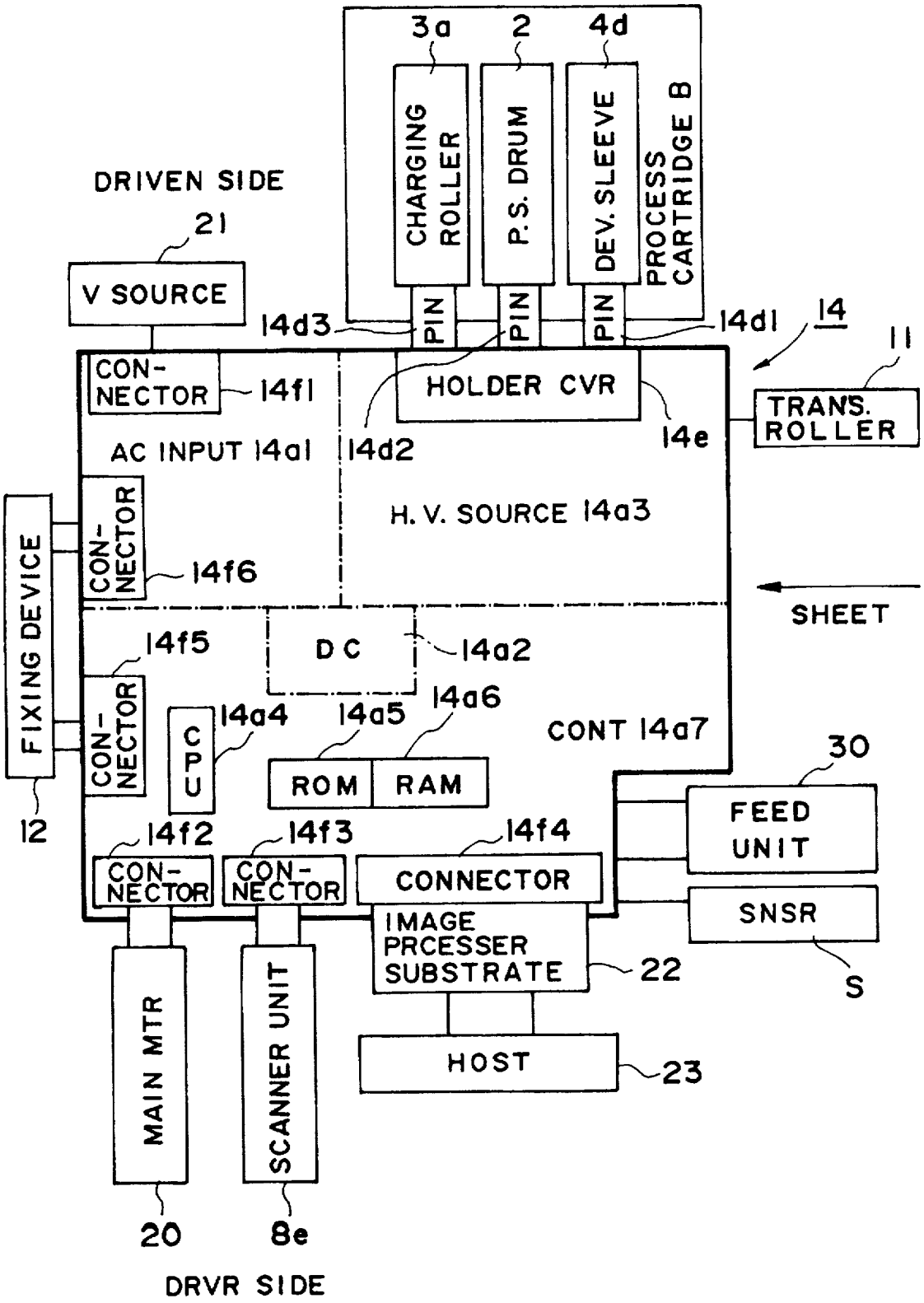
FIG. 32 is a block diagram of an electrical component mounting board.
Figure 33:
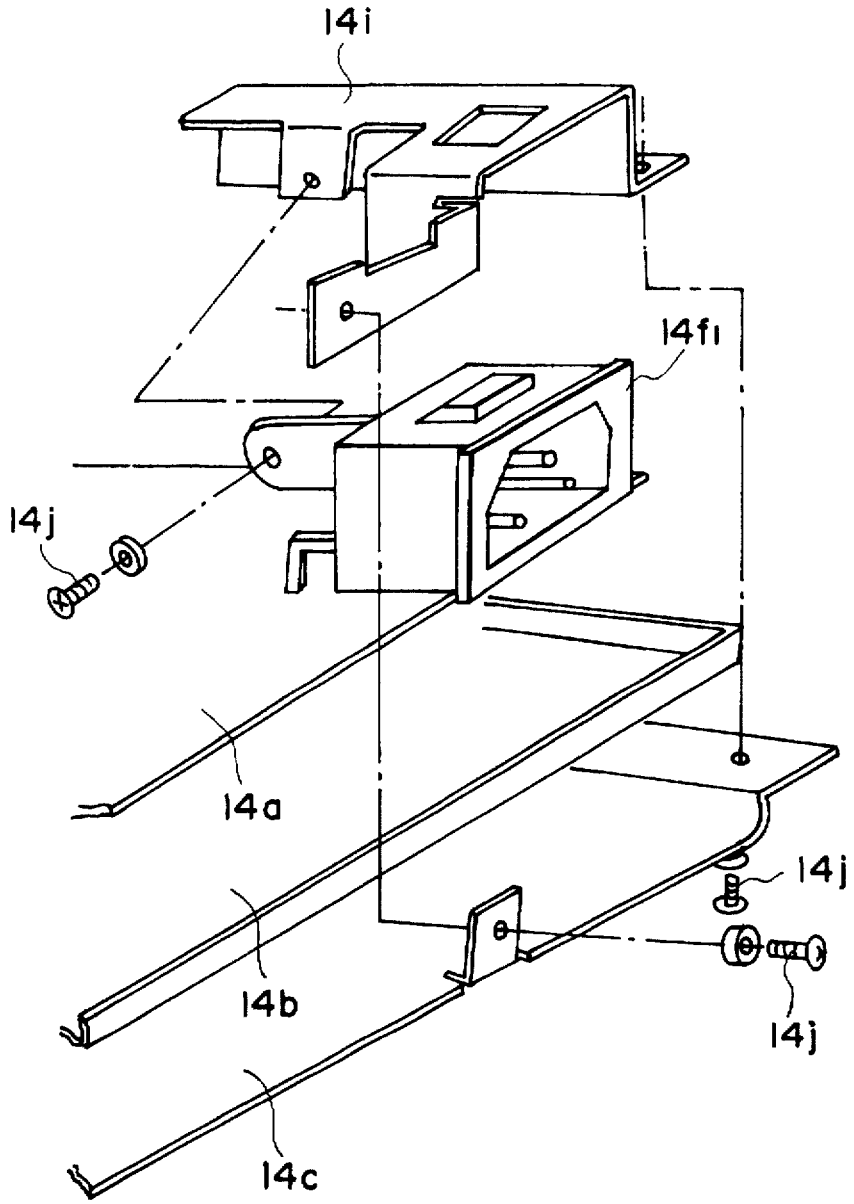
FIG. 33 depicts how an AC connector is affixed with a metallic inlet plate.

Next, referring to FIGS. 31–33, the electrical component unit 14 for controlling the driving operation of each of the aforementioned operational members will be described. FIG. 31 is an exploded view of the electrical component unit; FIG. 32 is a block diagram of the electrical component mounting board; and FIG. 33 depicts how an AC inlet is mounted.

(Single Piece Electrical Component Mounting Board)

Referring to FIG. 31, the electrical component unit 14 of this embodiment comprises an electrical component mounting board 14a, a case 14b, and a shield plate 14c, wherein the electrical component mounting board 14a is mounted in the case 14b, and the shield plate 14c is attached to the bottom surface of the case 14b.

The electrical component mounting board 14a comprises: (1) an AC input portion 14a1 for receiving an AC power from an external commercial power source 21 and filtering noises; (2) a DC power source portion 14a2 for converting the AC power into the DC power of 5 V, 12 V, or the like; (3) a high voltage source 14a3 for supplying the power to the process cartridge B (developing means and charging roller) and transferring roller 11; (4) a control circuit portion 14a7 comprising: a CPU 14a4 such as a microprocessor for controlling the overall operation of the image forming apparatus in response to the signals received from a group of sensors such as the registration sensor S1, discharge sensor S2, remainder recording medium sensor S3, and the like; an ROM 14a5 for storing control programs of the CPU 14a1 and various data, and a RAM 14a6 to be used as the work area of the CPU 14a5 as well as to be used for storing temporarily various data; and (5) various switch sensors and connectors, wherein all of the listed components are fixedly mounted on a single piece printed circuit board, whereas corresponding components to be connected with these components are provided with floating connectors.

Referring to FIGS. 31 and 32, it will be described how the AC input portion 14a1, DC power source portion 14a2, high voltage source portion 14a3, and control circuit portion 14a7 are arranged on the single piece electrical component mounting board 14a. Referring to FIG. 32, the left side relative to the recording medium P conveyance direction is the driven side where the gear unit 13 is mounted for transmitting the mechanical driving force, and the right side is the non-driven side.

As shown in FIG. 32, the AC input portion 14a1 belongs to the non-driven side and is disposed on the downstream side relative to the conveyance direction, and the high voltage source portion 14a3 also belongs to the non-driven side and is disposed on the upstream side. The control circuit portion 14a7 is disposed on the driven side, and the DC power source portion 14a2 is disposed approximately in the middle, being slightly offset to the driven side.

Adjacent to the non-driven side end of the high voltage source, the development bias contact pin 14d1, drum ground contact pin 14d2, and primary bias contact pin 14d3 are disposed, projecting out of the holder cover 14e.

At the non-driven side end of the AC input portion, an AC connector 14f1 (AC inlet) is provided; adjacent to the driven side end of the control circuit portion 14a7, a motor connector 14f2 to which the connector 20c of the main motor 20 is engaged, a scanner connector 14f3 for supplying the power to the scanner unit 8e, and an image signal connector 14f4 for receiving the image signal are provided; and at the downstream end of the board, a DC connector 14f5 for receiving the signal from the thermistor which detects the heater temperature of the fixing means, and an AC connector 14f6 for supplying the power to the heater, are provided.

The reason why the arrangement is made as described in the foregoing is for the following advantage. It is conceivable that when the contact pins through which the power is supplied to the process cartridge B are on the driven side, the pins are liable to be displaced due to the changes in the meshing state of the gears, causing thereby contact failures. However, when the high voltage source 14a3 provided with the contact pins 14d1, 14d2, and 14d3 is disposed on the non-driven side, such contact failures do not occur.

The control circuit portion 14a7, that is, a low voltage circuit, is disposed on the driven side, that is, the side opposite to where the high voltage source 14a3 and the AC input portion 14a1 which supplies the power to the high voltage source 14a3 are disposed; therefore, the control circuit portion 14a7 is less likely to be affected by the noise from the high voltage source 14a3 or the like. Further, the control circuit portion 14a7 having the motor connector 14f2 is disposed on the driven side; therefore, the wiring of the main motor 20 connected mechanically to the gear unit does not run across the high voltage side, which also helps the control circuit portion 14a7 be less susceptible to the noise.

The connectors 14f1–14f6 of the electrical component mounting board 14a are directly coupled (direct train) with corresponding connectors attached directly to the main motor 20, fixing unit, or the like, wherein the electrical connection is realized through the electrical component mounting board; therefore, a conventional wiring harness is unnecessary. As a result, not only is it extremely simple to mount the electrical components onto the electrical component mounting board 14a, but also, there will be less connection mistakes. In addition, since no wiring harness is laid out, the noise can be reduced. Further, the absence of the wiring harness improves the efficiency of the maintenance checkup operation.

When the electrical component mounting board 14a is joined with the case 14b, a positioning boss 14b1 provided on the case 14b is fitted into a positioning hole 14a8 provided on the electrical component mounting board 14a, and then, the board 14a and case 14b are fixed to each other with screws placed at predetermined locations. Next, the shield plate 14c made of electrically conductive metallic plate is screwed on the bottom surface of the case 14b, completing thus the electric component unit 14.

The electrical component unit 14 must also serve as the upper surface guide for the recording medium P fed out of the cassette 9 (FIG. 1); therefore, an R-shaped curved surface 14h is provided at the one end of the shield plate 14c, so that the recording medium P being passed by this curved surface 14h can be smoothly conveyed to be reversed. Also, the electrical component mounting board 14a is covered with the cover guide 10e comprising the electrically conductive plates 10e1 and 10e2, and this cover guide 10e guides the bottom surface of the recording medium P having been reversed. Being covered by the cover guide 10e (10e1 and 10e2) and shield plate 14c, which are made of the electrically conductive metallic plate, the electrical component mounting board 14a is provided with a higher degree of shielding effects.

Referring to FIG. 33, the AC connector 14f1 is affixed to the shield plate 14c by means of screwing the electrically conductive metallic plate inlet 14i to the shield plate 14c, with the use of screws 14j in combination with lock face nuts. This arrangement of the metallic plate 14i and shield plate 14c creates an electrical single turn coil around the AC connector, whereby the noise from the AC input portion 14a1 is effectively suppressed.

<Cooling Duct>

In the image forming apparatus, the electrical elements or the like mounted on the electrical component mounting board 14a generate heat, and also, the fixing means is provided with a heater; therefore, the heat sensitive electrical elements must be prevented from being deteriorated by the heat. In this embodiment, the frame 15 is provided with the fan 19 for blowing air over the electrical component mounting board 14a.

Figure 34:
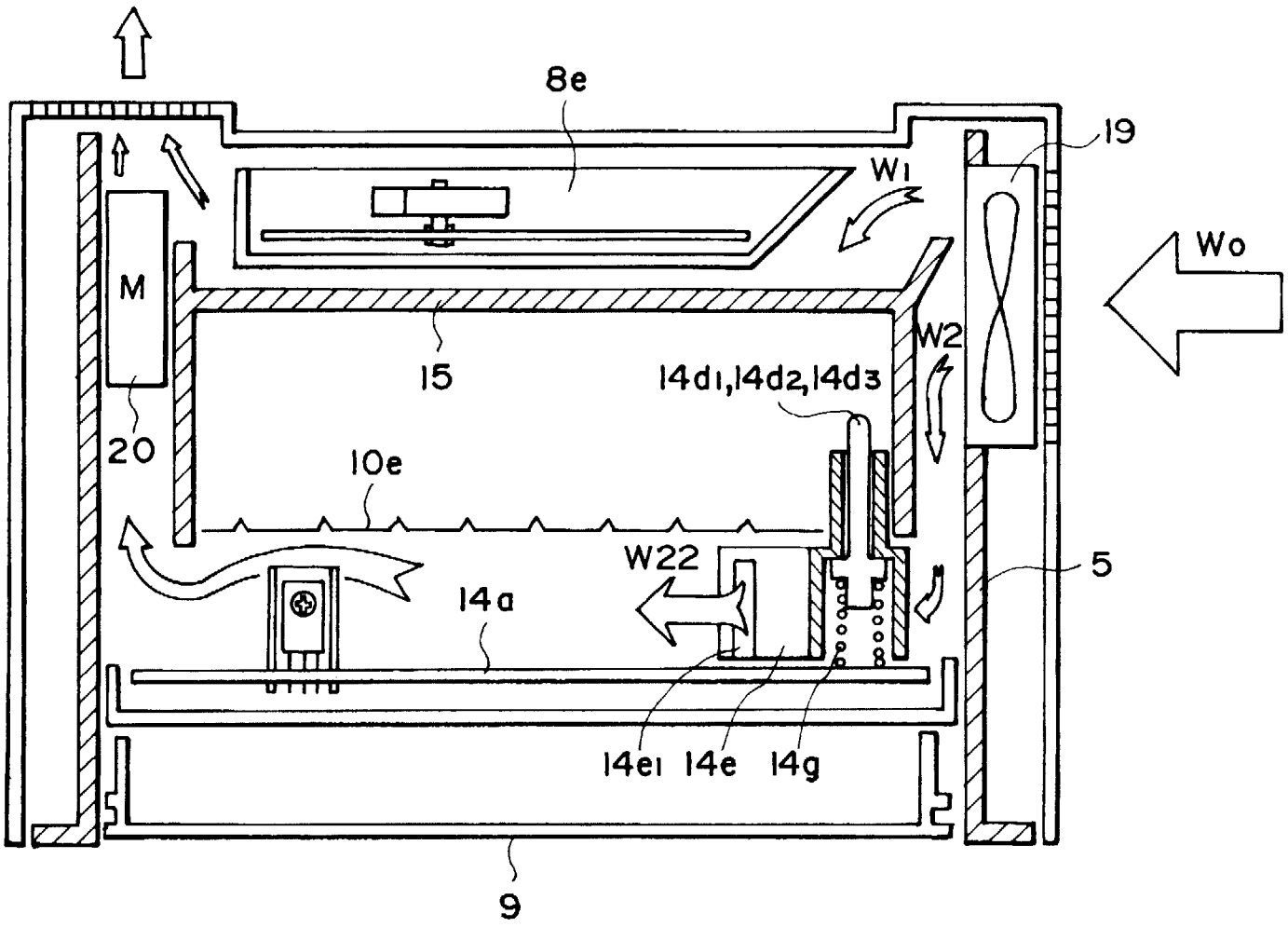
FIG. 34 depicts an air flow generated by a cooling fan.

In order to cool effectively the interior of the apparatus, a suction type fan is used as the cooling fan 19. Referring to FIG. 34, the air drawn in by the fan 19 is separated into sub-air ducts W1 and W2. The air duct is formed in such a manner that one of the sub-air ducts, W1, is routed to the scanner unit 8e mounted in the upper portion of the frame 15, and the other, W2, is routed over the electrical component mounting board 14a, passing by the main motor 20, and to an exit.

Figure 35:
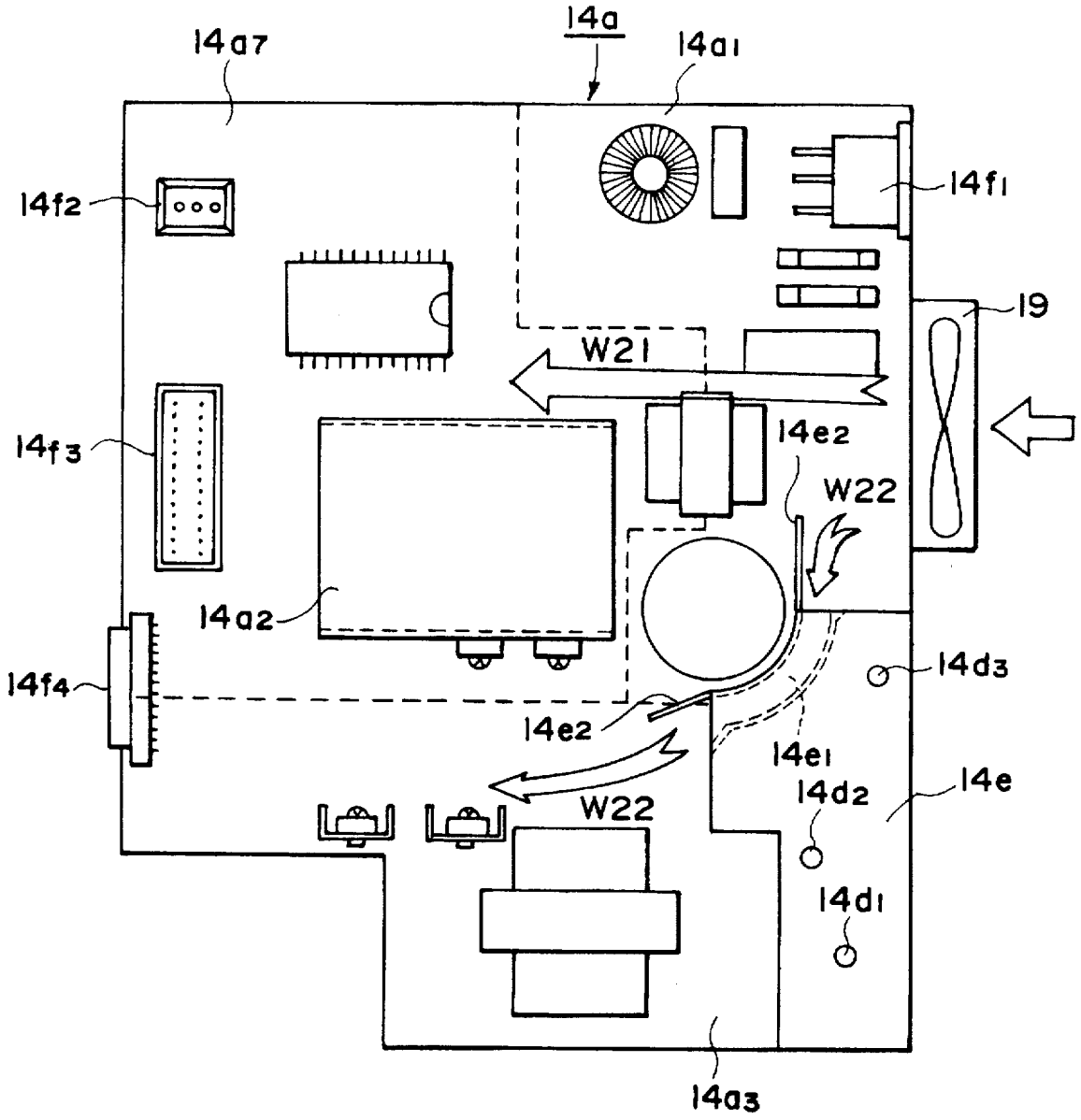
FIG. 35 depicts the air flow generated over the circuit board.

Referring to FIG. 35, the sub-air duct W2 for sending the air to the electrical component mounting board 14a is further divided into the first duct W21 for cooling the hot spot of the DC power source portion 14a2 and the second duct W22 for cooling the high voltage source portion 14a3. In order to accomplish such a duct arrangement, an air duct 14e1 is provided within the holder cover 14e which holds the contact pints. At the air entrance and air exit of this air duct 14e1, air stream guide walls 14e2 are integrally formed with the holder cover 14e, whereby the air is smoothly flowed in and out of the duct 14e1.

Since the air duct 14e1 is formed as a part of the holder cover 14e, no specific space is necessary for dividing the air duct W2 into the first and second air ducts W21 and W22.

<Holder Cover>

Figure 36:
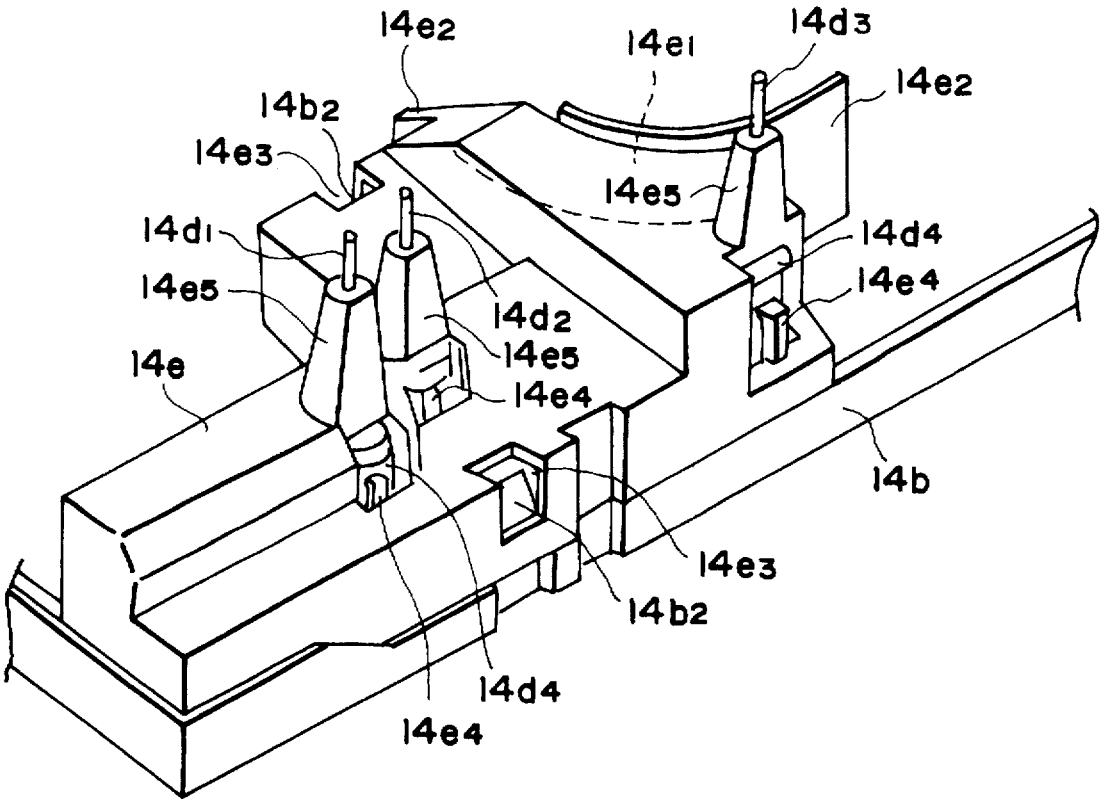
FIG. 36 is an oblique view of a holder cover for retaining contact pins.
Figure 37:
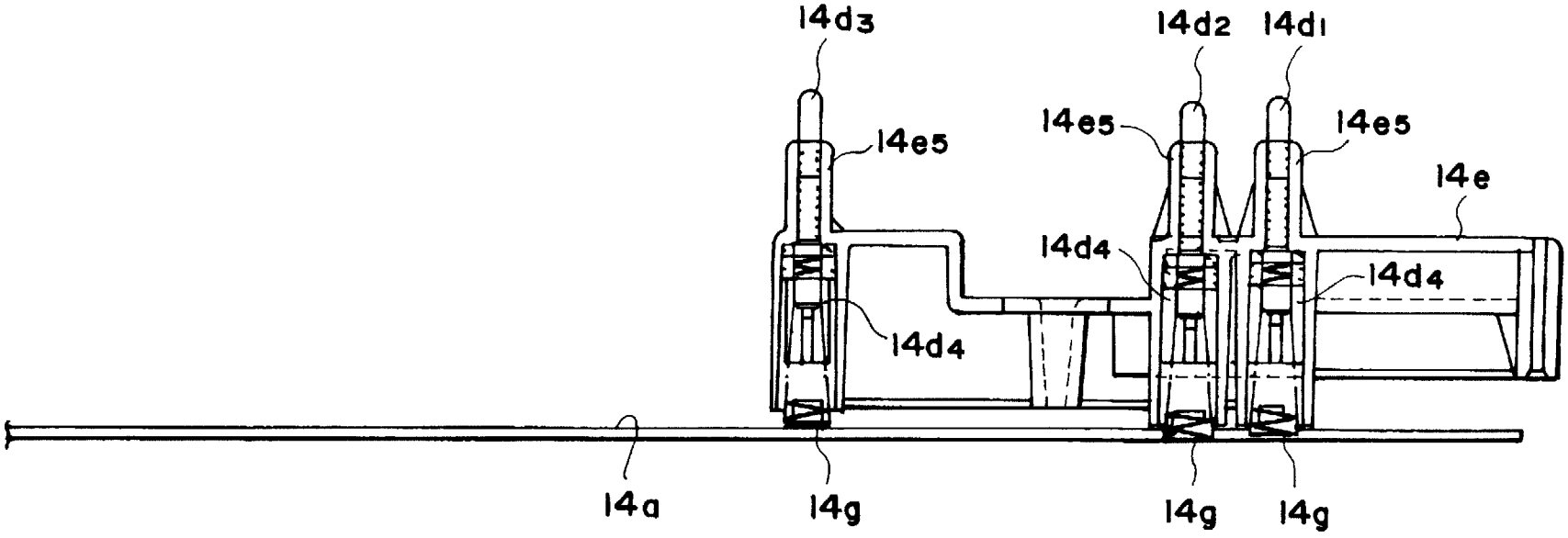
FIG. 37 is a sectional view of the contact pins and holder cover.

The holder cover 14e is attached to the case 14b, with the use of the so-called snap-in design. More specifically, referring to the oblique view in FIG. 36 and the sectional view in FIG. 37, the case 14b is provided with the engagement hooks 14b2, and the holder cover 14e is provided with the engagement portions 14e3 engageable with the hooks 14b2. Further, the holder cover 14e is provided with engagement projections 14e4 to come in contact with the contact pins.

With this arrangement in place, as the holder cover 14e is lowered so as for the end portions of the contact pins 14d1–14d3 to be exposed from the pin covers 14e5, and the engagement hooks 14b2 are elastically deformed to be engaged with the engagement portions 14e3, accomplishing the mounting of the holder cover 14e by a single action. After the holder cover 14e has been mounted, the engagement projections 14e4 are in contact with cylindrical spring covers 14d4 being integral with contact pins 14d1–14d3, preventing the contact pins 14d1–14d3 from wobbling sideways.

Three contact pins 14d1–14d3 are non-linearly disposed relative to the installing direction of the cartridge B (the same direction as the recording medium conveyance direction), that is, the upward direction in FIG. 35. More specifically, in relation to the development bias contact pin 14d1, the ground contact pin 14d2 is offset to the left and the charge bias contact pin 14d3 is offset to the right. Therefore, the charge bias contact, drum ground contact, and development bias contact which are provided on the bottom surface of the process cartridge B corresponding to the locations of these contact pins 14d1–14d3 do not make contact with the wrong contact pins. In other words, with the contact pins 14d1–14d3 being disposed non-linearly, the charge bias contact of the cartridge B does not come in contact with the ground contact pin 14d2, and the drum ground contact of the cartridge B does not come in contact with the development bias contact pin 14d3, during the insertion of the cartridge B. Therefore, unnecessary contacts between the contacts and contact pins are eliminated.

By having the holder divide the passage of the air flowing over the electrical component mounting board 14a, the heat generating portions of electrical component mounting board 14a can be effectively cooled without adding to the component count.

Further, being provided with the so-called snap-in structure, the holder cover 14e can be mounted with a single action. Though the charge bias contact pins 14d1 is disposed on the side opposite to the ground contact pin 14d2 across the charging roller 11, these contact pins 14d1–14d3 are covered with the single piece holder cover 14e; therefore, even when the toner leaks out of the transferring station, the holder cover 14e catches the toner, preventing thereby the toner from adhering to the surface of electrical component mounting board 14a or contact pins and causing a high voltage leak.

<Structure of Intermediary Connector>

Figure 38:
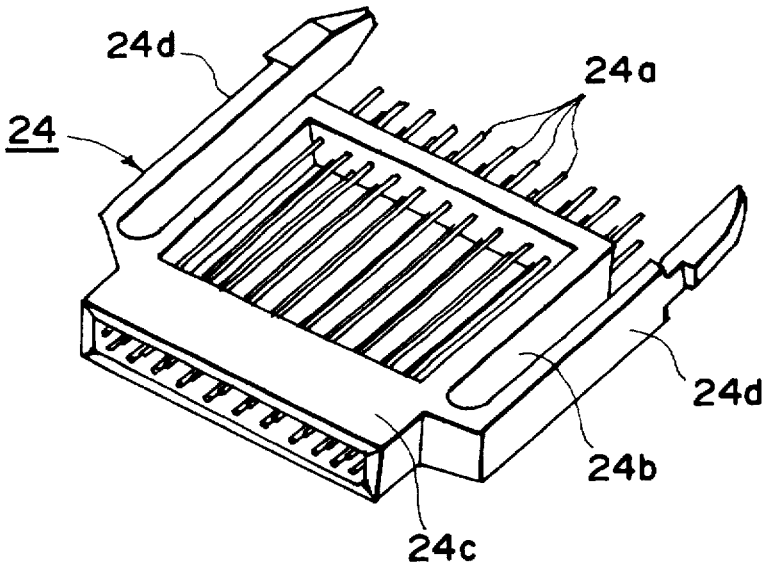
FIG. 38 is an oblique view of an intermediary connector.

The electrical connection is established by coupling the connectors provided on the electrical component mounting board 14a with the connectors of various electrical components, wherein in this embodiment, the coupling of the connectors is simplified by using the intermediary connectors. For example, referring to FIG. 32, the image signal connector 14f4 is first coupled with an image processing circuit board 22 as the interface, and is indirectly coupled with a host computer 23 through this circuit board 22, wherein the connection between this image signal connector 14f4 and image processing circuit board 22 is established with use of an intermediary connector 24 as shown in FIG. 38.

Figure 39:
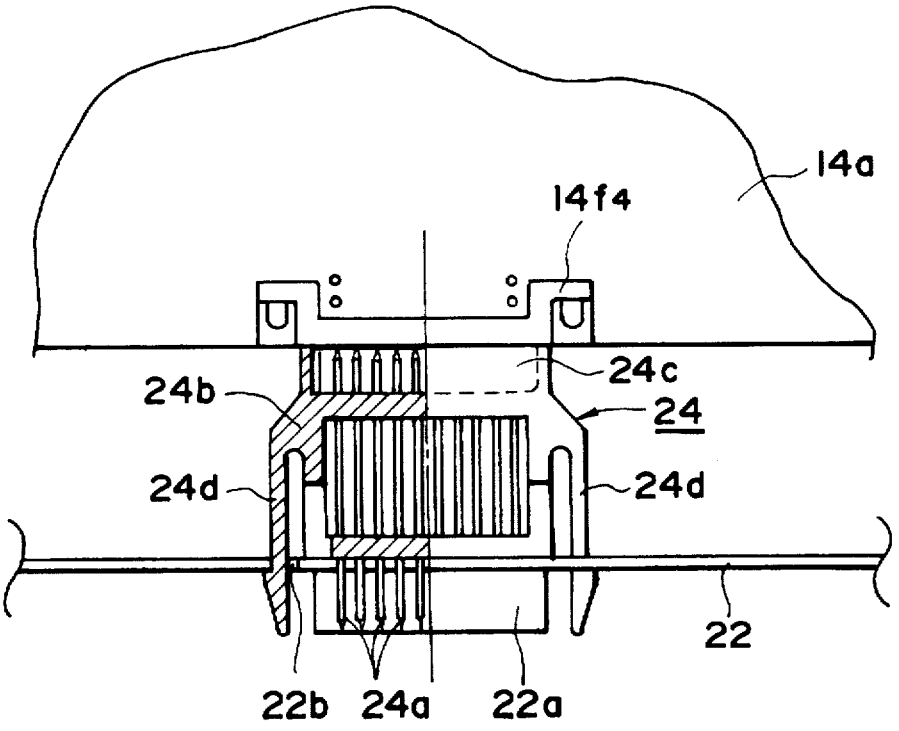
FIG. 39 depicts how the electrical component mounting board and the image processing circuit board are connected with use of the intermediary connector.

This intermediary connector 24 comprises a connector mains frame 24b, a number of connecting pins 24a supported by the connector main frame 24b, and a plug portion 24c for plugging one end of each connecting pin into the image signal connector 14f4 of electrical component mounting board 14a. Also, the connector main frame 24b is provided with a pair of guide hook portions 24d, which serve as a guide when the other end of each connecting pin 24a is inserted into the connector 22a of image processing circuit board 22, as shown in FIG. 39. The ends of the guide hook portions 24d project beyond those of the connecting pins and are in the form of a hook engageable with through holes 22b provided on the image processing circuit board 22.

Referring to FIG. 39, when the electrical component mounting board 14a is electrically connected to the image processing circuit board 22, with the use of the intermediary connector 24 having the aforementioned structure, the plug portion 24c is first inserted into the image signal connector 14f4 of the electrical component mounting board 14a, and then, the connecting pins 24a are inserted into the connector 22a of the image processing circuit board 22. At this time, before the connecting pins 24a come to be inserted into the connector 22a, the guide hook portions 24d are engaged into the through holes 22b of the image processing circuit board 22, guiding the connecting pins 24a into the connector 22a while being elastically deformed, and as soon as the pins 24a are completely inserted into the connector 22a, the guide hook portions 24d spring back to their original shapes, preventing themselves from disengaging.

In other words, the intermediary connector 24 having the guide hook portions 24d can be also coupled with the connector 22a of the image processing circuit board 22, with the so-called snap-in structure. All that is needed for establishing this connection is to simply engage the guide hook portions into the through holes 22b, which not only provide visible guidance, but also give a feel of clicking at the moment the connection is completed. Therefore, the connecting operation is very easy. Further, since the guide hook portions 24 becomes disengagement-proof once they become engaged with the through holes 22b, the image processing circuit board 22 and intermediary connector 24 do not disengage from each other, offering thereby improved connectional reliability. Further, the presence of the guide hook portions 24d allows the stresses exerted on the intermediary connector by external disturbances or the like to be dissipated to the guide hook portions 24d, preventing thereby the connecting pins 24a from being directly subjected to the stresses. Therefore, the connecting pins 24a can be prevented from being damaged through deformation caused by external disturbances or the like.

Further, by forming asymmetrically the pair of guide hook portions 24d provided on the intermediary connector 24, relative to the center line of the connector 24, the intermediary connector 24 can be prevented from being reversely inserted. For example, the pair of guide hook portions 24d may be differentiated in shape or size, wherein the through holes 24b may be correspondingly changed in shape or size.

Figure 40:
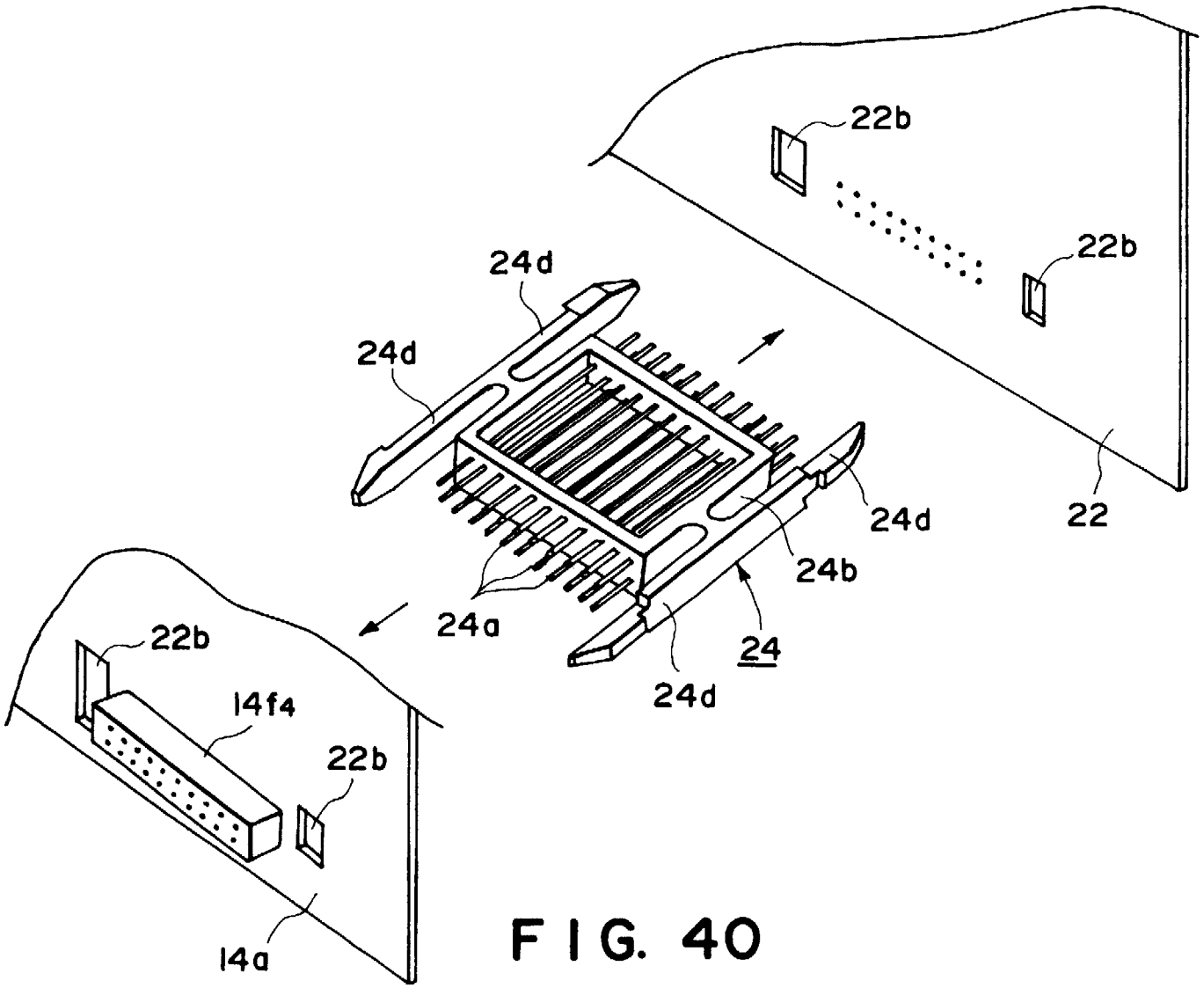
FIG. 40 is an oblique view of an alternative embodiment of the intermediary connector.

In this embodiment, the guide hook portions 24d are provided at only one end of the intermediary connector 24, that is, on the side where the connection is made with the connector 22a of the image processing circuit board 22, whereas on the side where the connection is made with the connector 14f4 of the electrical component mounting board 14a, the plain plug portion 24c is provided. However, an intermediary connector 24 as shown in FIG. 40 may be employed. This intermediary connector 24 shown in FIG. 40 is provided with the guide hook portions 24d also on the side where the connection is made with the connector 14f4 of the electrical component mounting board 14a, with the provision of corresponding through holes 22b on the electrical component mounting board 14a, so that the connector 14f4 and intermediary connector 24 can be also coupled with the so-called snap-in structure. With this arrangement, the electrical connection can be more easily made between the electrical component mounting board 14*a* and image processing circuit board 22.

Further, in this embodiment, the intermediary connector 24 is used for the connection of the image processing circuit board 22, but it can be also used for making connections between other connectors, as well as for establishing electrical connections between the components in electrical or electronic apparatuses other than the image forming apparatus.

(Cooling Fan)

Figure 41:
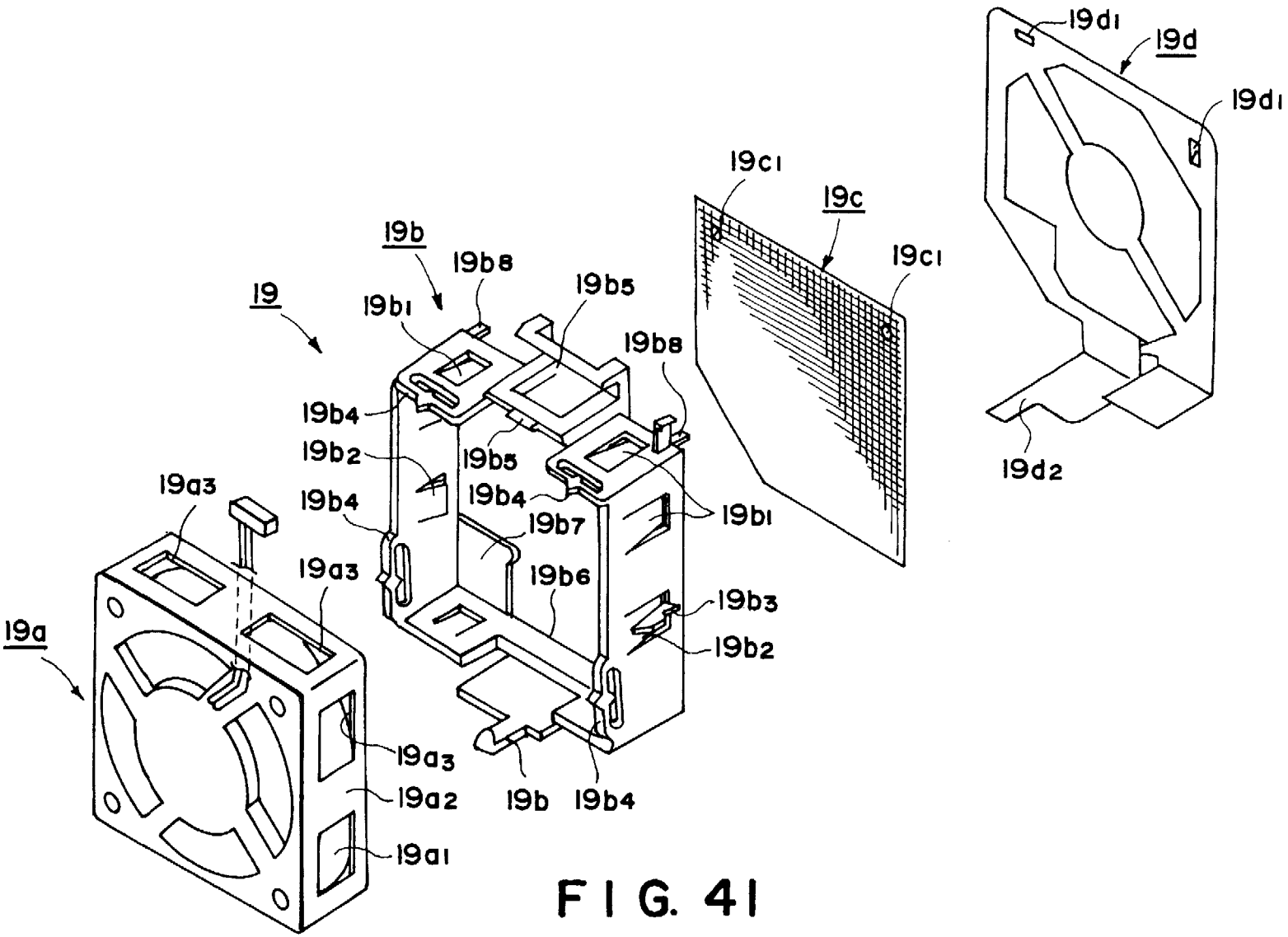
FIG. 41 is an exploded view of the cooling fan assembly.
Figure 42:
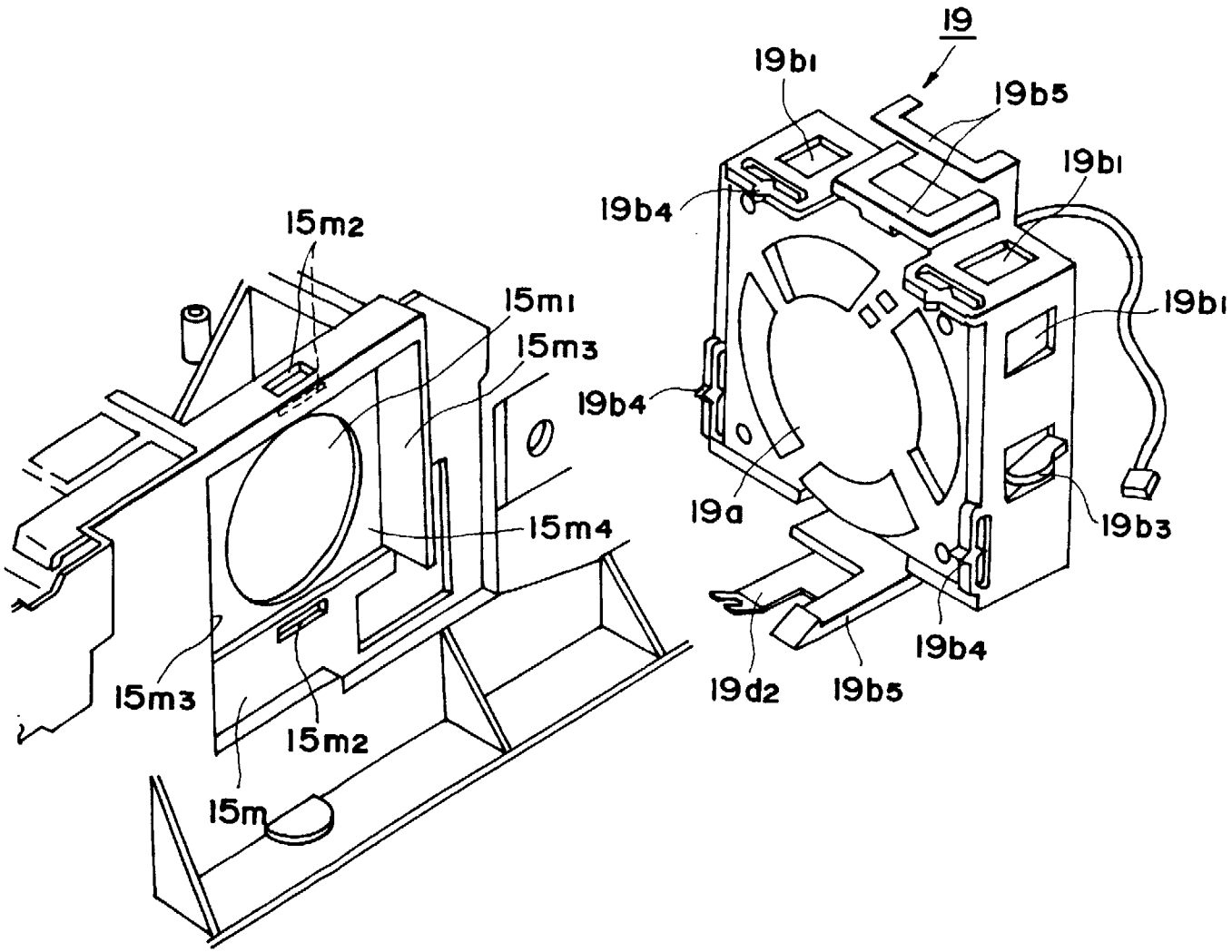
FIG. 42 depicts how the cooling fan is mounted on the frame.
Figure 43:
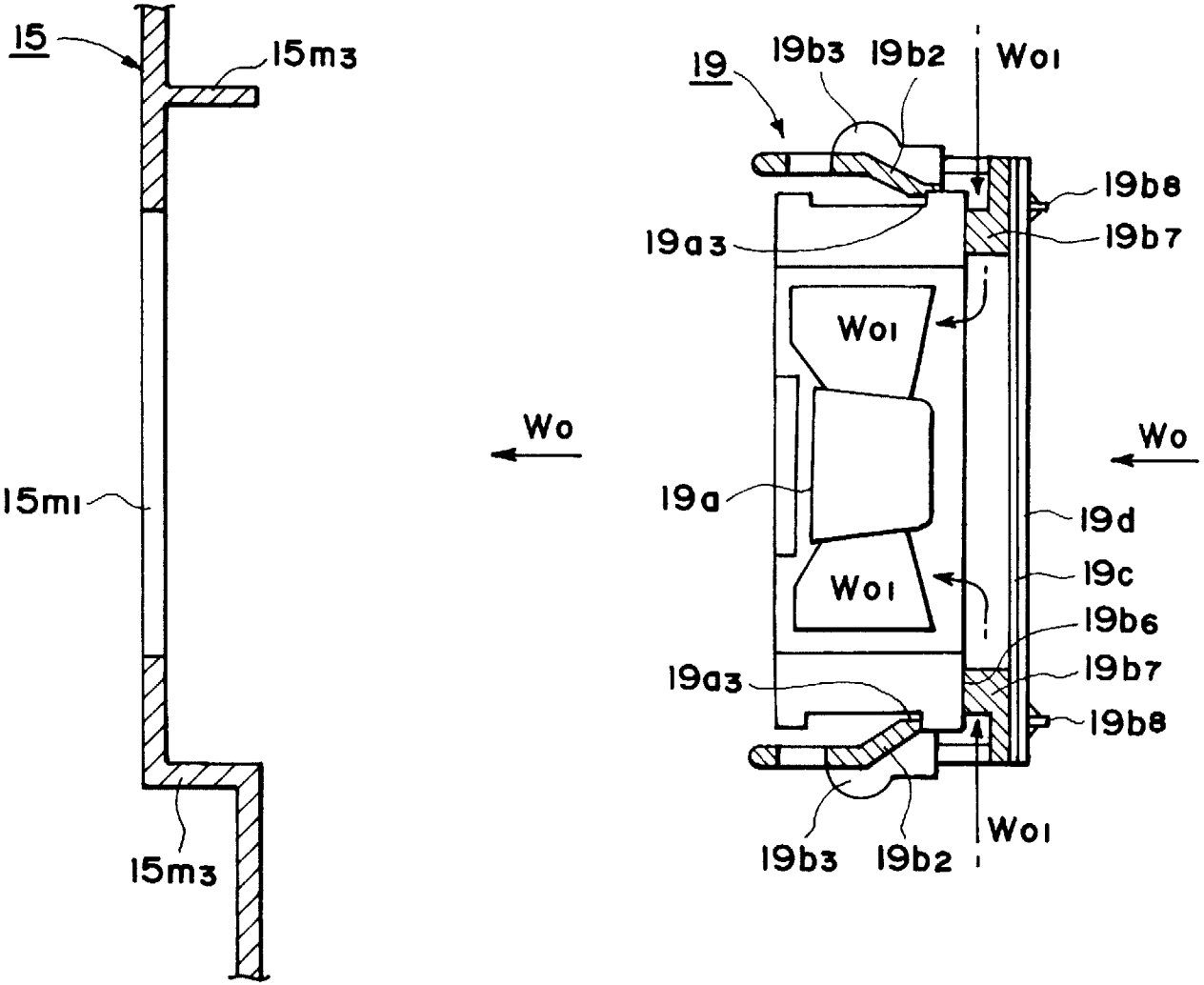
FIG. 43 is a sectional view of the cooling fan mounted on the frame.

Next, referring to FIGS. 41–43, the structure of the cooling fan 19 will be described. Referring to FIG. 41, the cooling fan 19 comprises a fan main assembly 19*a*, a fan cover 19*b* for covering the fan main assembly, a mesh filter 19*c* attached to the fan cover 19*b* for preventing dust or foreign matter from entering the apparatus, and metallic shield plate 19*d* attached to the fan cover 19*b* for preventing electrostatic noise.

The fan main assembly 19*a* comprises a frame 19*a*2 and a fan mounted on the frame 19*a*2. This frame 19*a*2 is provided with engagement portions 19*a*3 around its side walls. The fan cover 19*b* is molded of flexible resin material such as ABS, PP, PC, or PPPO, in the form of a cylinder having an opening at both ends, and its side walls are provided with elastic engagement plates 19*b*1 which look as if they were made by cutting the side walls and bending slightly inward the cut portions. These engagement plates 19*b*1 engage with the engagement portions 19*a*3.

The right and left walls of the fan cover 19*b* are provided with pressing portions 19*b*2 which can elastically deformed inward, and the exterior surface of each pressing portion 19*b*2 is provided with a tapered projection 19*b*3 which is integrally formed with the pressing portion 19*b*3. Further, at the edge portions of one of the open ends of the fan cover 19*b* (left side in FIG. 41), molded spring portions 19*b*4 are provided, which are elastically deformable by pressure.

The top and bottom walls of the fan cover 19*b* are provided with engagement hook portions 19*b*5 used for fixing the cover 19*b* to the frame 15. These hook portions 19*b*5 have elasticity and engage with the engagement hole portions provided on the frame 15.

At the edge portions of the intake side opening (right side in FIG. 41) of the fan cover 19*b*, contact portions 19*b*7 where the filter 19*c* makes contact are provided, wherein the contact portions have an engagement projection 19*b*8. The filter contact surface of the contact portion 19*b*7 slightly (approximately 1 mm–2 mm) projects above the end of the intake side opening 19*b*6.

The mesh filter 19*c* is provided with holes 19*c*2 in which the engagement projection 19*b*8 is fitted. The shield plate 19*d* is provided with a shield arm portions 19*d*2 and engagement portions 19*d*1 with cut-and-raised locking tabs, in which the engagement projection 19*b*8 is to be locked in.

As for the assembling process of the cooling fan 19, first, the fan main assembly 19*a* is fitted in the fan cover 19*b*, whereby the end portion of the engagement plate 19*b*1 of the cover 19*b* automatically engages with the engagement portions 19*a*3, locking together the fan main assembly 19*a* and fan cover 19*b*. In other words, the fan main assembly 19*a* and fan cover 19*b* are locked together with the so-called snap-in structure.

At the intake side opening of the fan cover 19*b*, the engagement projection 19*b*8 is put through the hole 19*c*1 of the filter 19*c* and is engaged with the engagement portion 19*d*1 of the shield plate 19*d*, whereby the filter 19*c* and shield plate 19*d* are attached. This filter 19*c* and shield plate 19*d* can be also attached by a single action.

Next, referring to FIG. 42 and 43, a fan attachment portion 15*m* of the frame 15 is provided with a circular air passage hole 15*m*1, and above and below this hole 15*m*1, an engagement hole 15*m*2 is provided, into which the engagement hook portion 19*b*5 of the fan cover 19*b* is engaged. Therefore, as the engagement hook portion 15*b*5 is engaged into the engagement hole 15*m*2, the cooling fan 19 is automatically mounted on the frame 15. In other words, the cooling fan 19 is mounted with the so-called snap-in structure.

When the fan is mounted, the tapered projection 19*b*3 is pressed on the frame surface 15*m*3, whereby the pressing portion 19*b*2 is elastically deformed inward to be pressed down on the fan main assembly 19*a*. With this arrangement, even when a certain amount of play is found between the fan main assembly 19*a* and fan cover 19*b* after the installation of a commercially available general purpose fan, the play can be eliminated as they are assembled into the frame 15. Further, when the cooling fan 19 is mounted on the frame 15, the molded spring portion 19*b*4 is pressed on the frame 15*m*4 and is elastically deformed. This elastic deformation keeps the fan cover 19*b* and frame 15 rattle free. Having elasticity as described in the foregoing, the pressing portion 19*b*2 and molded spring 19*b*4 constitute a vibration preventing means which effectively absorbs the vibrations during the fan operation.

Figure 48:
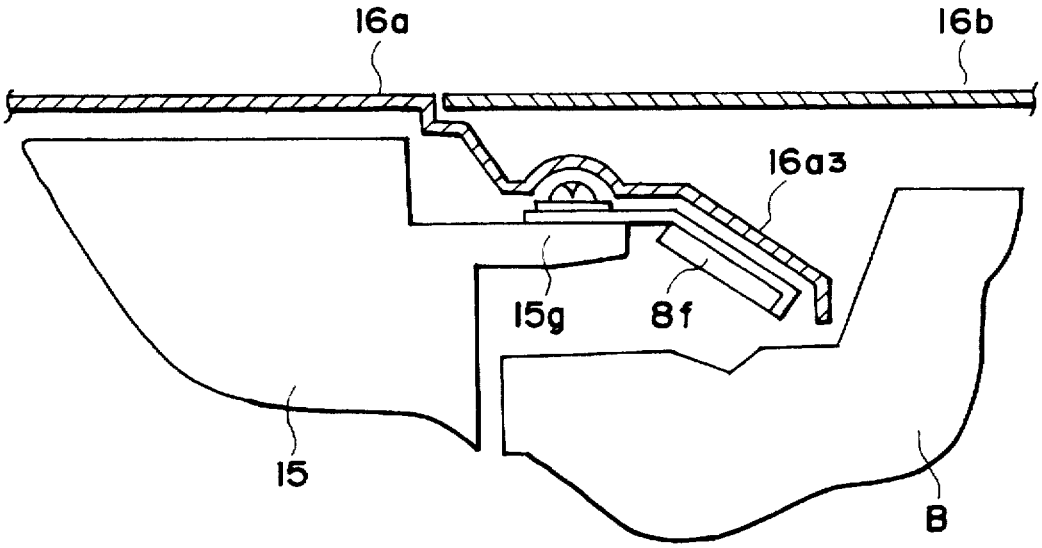
FIG. 48 is a sectional view of a structure for offering double protection to a reflection mirror.

When the cooling fan 19 mounted on the frame 15 is on, cooling air is sent into the apparatus as indicated by an arrow mark W0 in FIG. 48, through the filter 19*c*, and the main air duct which extends as far as the air passage hole 15*m*1. After the accumulation of usage time, the filter 19*c* may be clogged with dust or foreign matter. When such a situation occurs in this embodiment, the cooling air is sent into the apparatus through the sub-air duct indicated by an arrow mark W01 in FIG. 43. In other words, the end portion of the intake side opening of the fan cover 19*b* is not perfectly in contact with the filter 19*c*, but instead, a small amount of gap is provided between them (equivalent to the amount by which the filter contact portion 19*b*7 projects above the end of the intake side opening 19*b*6). Thus, when the filter 19*c* is clogged, the cooling air is drawn into the apparatus, through the gap and the sub-air duct indicated by the arrow mark W01. Therefore, the cooling system of this embodiment can afford the minimum cooling capacity even when the filter 19*c* is clogged.

(Frame)

Next, description will be given as to the frame 15 on which the process cartridge B, scanner unit 8*e*, gear unit 13, electrical component unit 14 and the like are mounted. Referring to FIG. 5, the frame 15 of this embodiment has an integral monocoque structure. In consideration of rigidity, dimensional stability, heat resistance and the like properties, it is injection-molded of PC (polycarbonate), PPO (polyphenylene oxide), ABS (acrylonitrile-butadienestyrene), HIPS (high impact styrene) or a like resin, in the form of a three-dimensional, highly precise single piece component with high rigidity. The frame 15 may be made of composite material composed by mixing glass fiber or carbon fiber into the preceding resin material by approximately 30%–50%, which can further increase the rigidity.

Referring to FIGS. 1 and 5, the frame 15 is provided with the following portions formed integrally with the frame 15: cassette guide portion 15*d* for guiding and supporting the cassette 9 which stores the recording medium P; motor supporting portion 15*e* for supporting the main motor 20; guide portions 7*a* and 7*b* for guiding and supporting the process cartridge B; supporting portion 15*f* for the scanner unit 8*e*; supporting portion 15*g* for the reflection mirror 8*f*; supporting portion 15*h* for the transferring portion 11; supporting portion 15*i* for the cover guide 10*e*; positioning-supporting portions (unshown) for pickup roller 10*a*, conveying roller 10*b*, and discharging rollers 10*h* and 10*i*; positioning portion for the electrical component unit 14 on which various sensors and the like are mounted; and cassette inserting guide portion. Therefore, the positional relation among the various units described hereinbefore can be highly precisely fixed.

Since the guide portion 15*j* which guides the recording medium P from the conveying roller 10*b* to the transferring roller 11 is integrally formed with the frame 15, a precise and stable positional relationship is always maintained between the recording medium P and the transfer nip portion created by the pressure contact between the photosensitive drum 2 and the transferring roller 11. Therefore, high quality images, with no sign of image shifting slanting or the like which occurs during the transfer operation, can be produced.

Further, the sheet path 10*g* for reversing the recording medium P after the image fixing process is also integrally formed with the frame 15; therefore, the positional relation of the fixing means 12 to the relaying roller 10*f* and discharging roller 10*h* is also highly precisely maintained. As a result, the sheet reversing path which reverses as well as de-curls the curled recording medium after the fixation can be precisely structured as described previously.

Since the positions of the scanner unit 8*e*, reflection mirror 8*f*, and process cartridge B are fixed by the frame 15, the distances among these units can be precisely maintained; therefore, the degree of positional accuracy by which the laser beam is projected on the photosensitive drum 2 is improved along with the degree of positional accuracy by which the image is transferred onto the recording medium P.

The position of the scanner unit 8*e* is fixed by the scanner supporting portion 15*f* of the frame 15. This scanner supporting portion 15*f* is formed in such a manner as to bridge the left and right walls of the frame 15, being in a form least susceptible to the frame 15 distortion.

More specifically, the rigidity of the frame 15 is provided by the beams bridging the left and right side walls. The first of the beams is constituted by the fixing means supporting portion 15n and sheet path 10*g*, and the second is constituted by the guide portion 15*j*. Further, the electrical component unit 14 is screwed on in such a manner as to bridge the fixing means supporting portion 15*n* and guide portion 15*j*, reinforcing thereby the preceding two cross beams. In other words, the guide portion 15*j*, sheet path 10*g*, fixing means supporting portion 15n, and scanner supporting portion 15*f* constitute beam structures for improving the frame 15 strength by bridging the left and right side walls.

The scanner supporting portion 15*f* is disposed between the guide portion 15*j* and fixing means supporting portion 15*n*, while being above both fixing means supporting portion 15*n* and guide portion 15*j*, covering the area from the approximate middle of the apparatus, relative to the recording medium P conveying direction, to the fixing means supporting portion 15*n*. This location is approximately the center of the frame 15, which coincides with the location of the node of the torsional vibration, that is, the portion with high rigidity.

Since the main motor 20 generates vibrations when it rotates, it must be disposed at a location with higher rigidity in the frame 15; therefore, the motor supporting portion 15*e* for supporting the motor 20 is disposed at the location where the scanner supporting portion 15*f* meets the side wall, that is, a location with high rigidity. Further, with the main motor being disposed adjacent to the apparatus center, the driving force can be effectively proportioned for conveying the recording medium P, for driving the fixing means, and for driving the photosensitive drum 2.

Further, having a three-dimensional structure, the frame 15 of this embodiment offers such advantages that its rigidity is high, and that the vibrations from the main motor 20, scanner motor 8*c*, and cooling fan 19 more easily attenuate, being unlikely to cause the frame 15 to resonate.

While problems related to erroneous image formation, faulty recording medium P conveyance or the like can be prevented by inspecting the frame 15, the frame 15 of this embodiment is a single piece frame; therefore, only a single piece is needed to be inspected in order to take quickly appropriate measures for correcting the predictable problems, improving thereby the productivity.

When a metallic filler (stainless steel, copper, or the like) is used as the filler material to be mixed with the resin material for the frame 15, not only can the frame 15 rigidity be further improved, but also some conductivity equivalent to a resistance value of approximately 10 Ω can be given. With this composition, the electrical noise generated from the electrical component mounting board 14*a* within the apparatus can be prevented from leaking outward from the apparatus.

When highly elastic rubber material is mixed into the resin material for the frame 15, the vibration attenuating properties of the frame 15 can be enhanced. In other words, various complex functions can be given to the frame 15, by means of mixing various material or materials having specific relevant properties, into the resin material for the frame 15.

(External Case)

After the various components or units are mounted on the frame 15, the assembly is covered with the external case 16 to finish the image forming apparatus. This external case 16 will be described next.

(Integral External Case)

Figure 44:
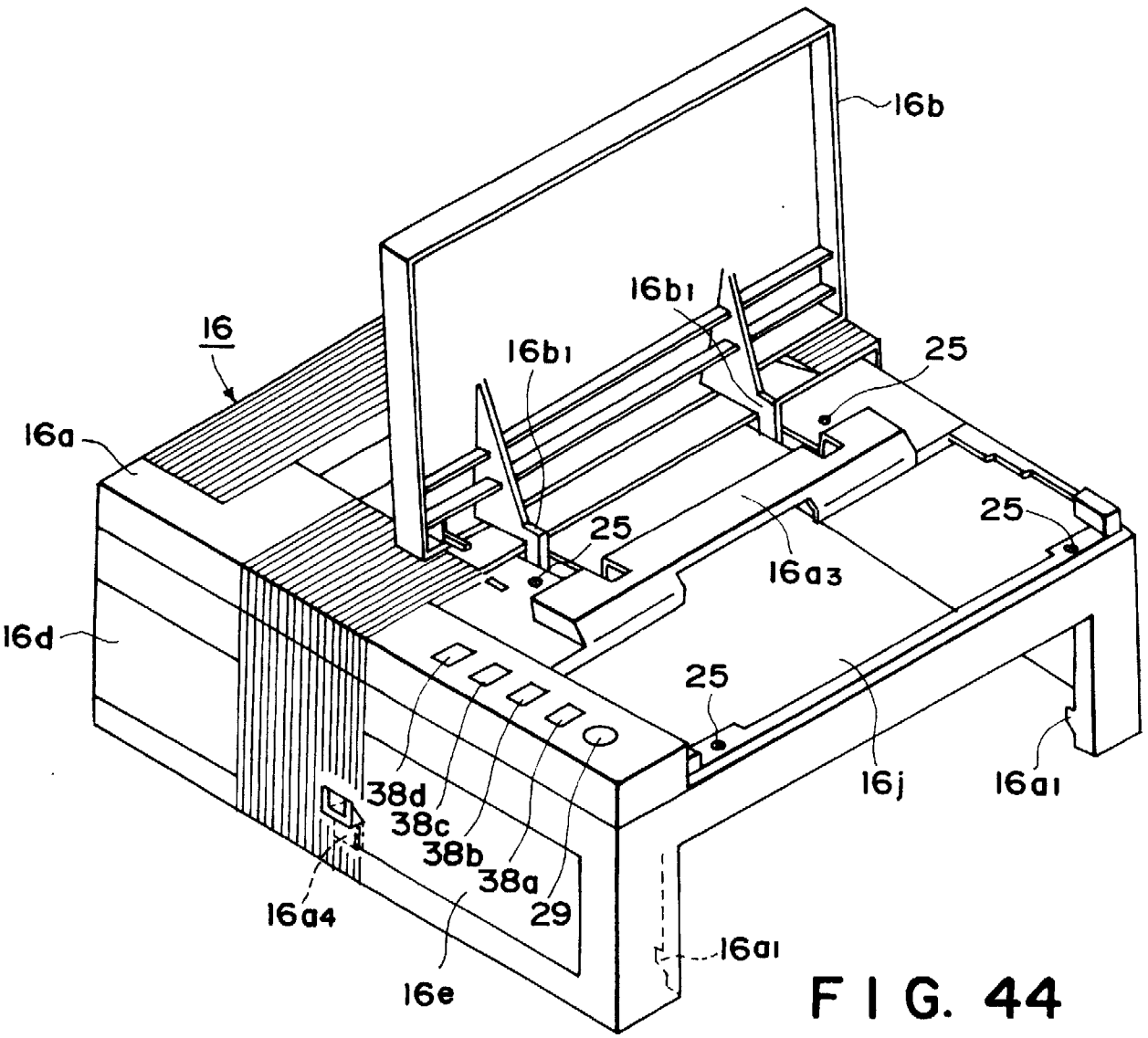
FIG. 44 is an oblique front view of an external case.
Figure 45:
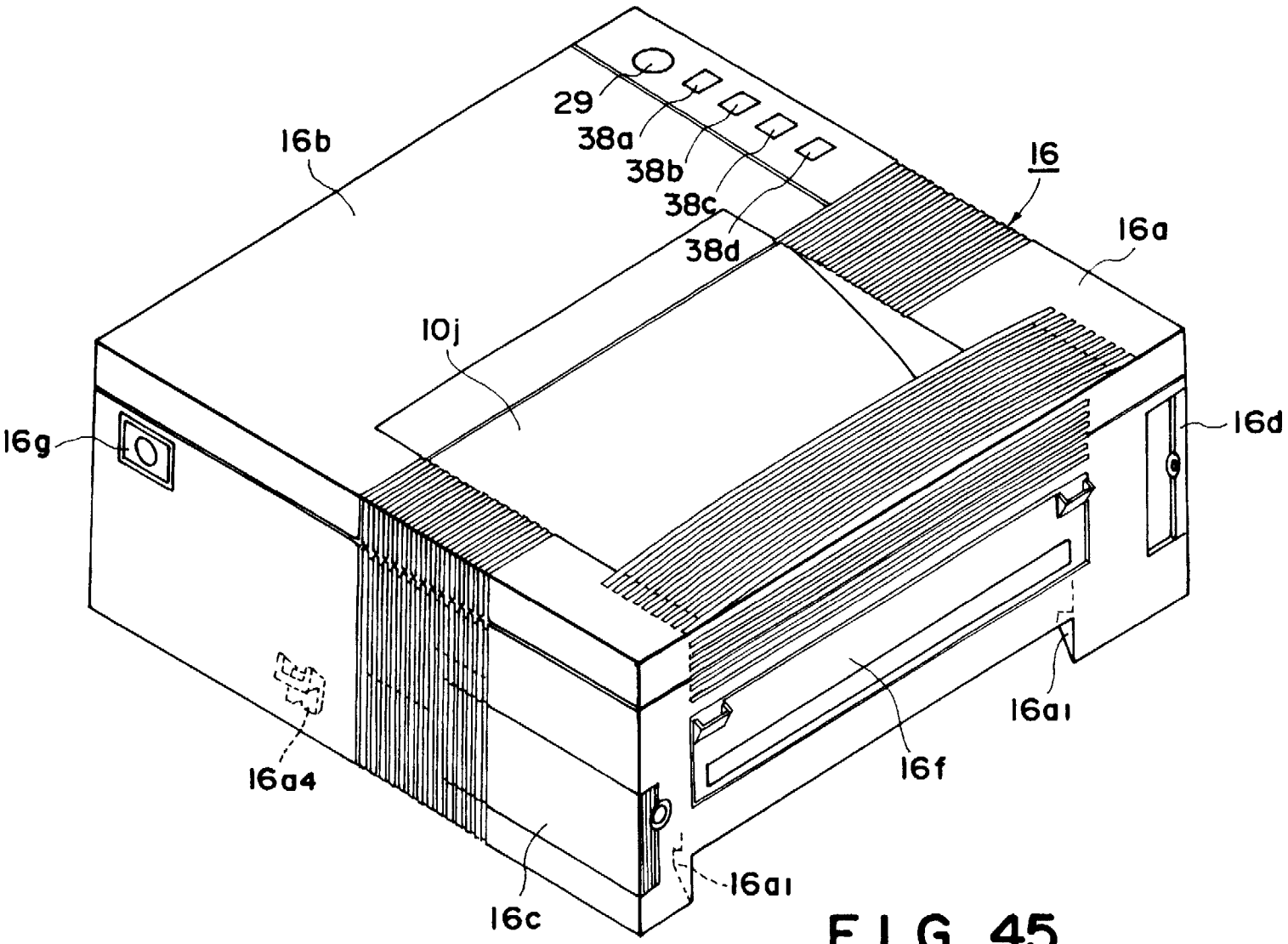
FIG. 45 is an oblique rear view of an external case.

Referring to FIG. 44, an oblique front view, and FIG. 45, an oblique rear view, the external case 16 comprises a main cover 16*a*, a top lid 16*b*, side lids 16*c*, 16*d*, and 16*e*, and a rear lid 16*f*, all of which are united into an external case unit. The main cover 16*a* of this embodiment is different from that for the prior type image forming apparatus, in that a total of five walls, that is, top wall, front and rear walls, and left and right walls, are integrated, whereas the prior type comprises two or more separate pieces. It is molded of resin material. On the top surface of the main cover 16*a*, the recording medium P discharge tray 10*j* is provided at the rear, being molded integrally with the main cover 16*a*, and the cartridge inserting opening 16*j* is provided at the front. This opening 16*j* is exposed or covered by the top lid 16*b*.

On the interior surface of each of the front and rear walls of the main cover 16*a*, a pair of engagement claws 16*a*1 are provided, and on the interior surface of each of the lateral walls, an engagement portion 16*a*4 is provided at each of predetermined locations. As the main cover 16*a* is lowered from above onto the frame 15, the claws 16*a*1 and engagement portions 16*a*4 engage with the frame. Then, the main cover 16*a* is fixed to the frame 15, with use of screws 25. These screws 25 are placed where they cannot be seen when the top lid 16*b* is closed.

Since the cover 16*a* which is the main structure of the external case 16 is integrated as described in the foregoing, it can be simply mounted on the frame 15 just by lowering it from above. In other words, all that is needed to finish the apparatus exterior of this embodiment is to cover the frame 15 with the main cover 16*a*, whereas the prior external case comprises several separate pieces and each must be individually mounted with the use of screws or the like. Therefore, it becomes extremely simple to mount the external case of this embodiment, reducing the assembly time.

The size of the main cover 16*a* has been reduced to a range presented hereinafter. Downsizing of the image forming apparatus has been accomplished to a point where an image forming apparatus for printing images on the recording medium P of A4 size (210 mm×297 mm) can be fitted into a main cover 16*a* of this size.

(1) Height: approx. 130 mm–145 mm (2) Depths: approx. 350 mm–370 mm (3) Width: approx. 350 mm–360 mm <Top Lid>

The top lid 16*b* is provided with leg portion 16*b*1 which is rotatable about the a rotational axis provided within the main cover 16*b*. This rotational axis (unshown) is provided with a torsional hinge spring so that the top lid 16*b* automatically opens when the lock is released for exchanging the process cartridge B or dealing with the problem of jamming.

Figure 46B:
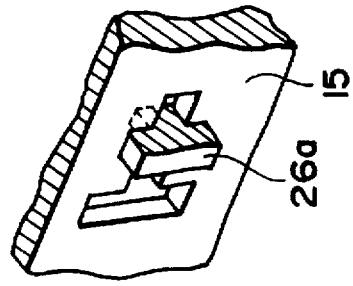
FIGs. 46(*a*) and (*b*) depict a locking mechanism of the top lid.
Figure 46A:
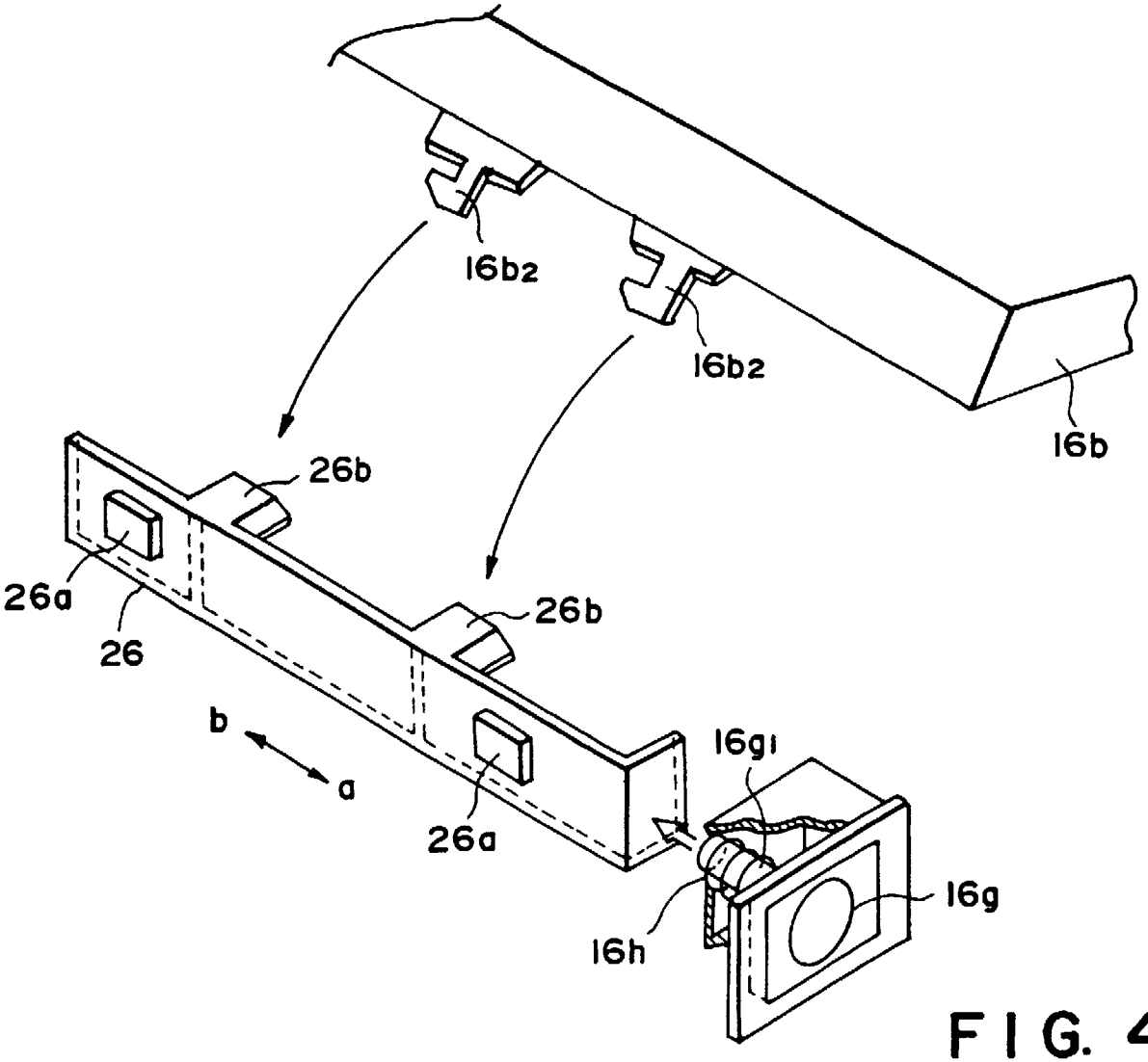

The lock of the top lid 16*b* is released by an eject button 16*g* attached on the surface of the right wall of the main cover 16*a*. As shown in FIG. 46(*a*), the eject button 16*g* is provided with a guide member 16*g*1, α11owing the eject button 16*g* to be pushed in or out. The guide member 16*g*1 is provided with a compression spring 16*h*, which pressures the eject button 16*g* outward from the external case 16*g* to the normal position.

The guide member 16*g*1 is disposed so as to face the sliding member 26 when the external case 16 is covering the frame 15, as shown in FIG. 46(*a*). This sliding member 26 is provided with a pair of claw portions 26*a* which engage with the frame 15 as shown in FIG. 46(*b*) to allow the sliding member 26 to be slid in the directions indicated by arrows a or b without dropping out. This sliding member 26 is always under the pressure from a spring (unshown) in the direction indicated by the arrow mark a.

The sliding member 26 is also provided with engagement portions 26*b*. When the top lid 16*b* is closed, the engagement hook portion 16*b*2 provided on the cover 16*b* engages with the engagement portion 26*b* and locks shut the top lid 16*b*. When the eject button 16*g* is pressed, the guide member 16*g*1 slides the sliding member 26 in the direction indicated by the arrow b in FIG. 46(*b*), whereby the locked engagement hook portion 16*b*2 is disengaged from the engagement portion 26*b*. As a result, the top lid 16*b* is opened by the aforementioned hinge spring.

<Side Lids>

On the right wall of the main cover 16*a*, an inlet connection window is provided at the rear, along with a side lid 16*c* to cover this window. On the left wall of the main cover, an I/O connection window is provided at the rear, along with a side lid 16*d* to cover this window. Also on the left wall of the main cover 16*a*, a module exchange window is provided approximately in the middle, along with a side lid 16*e* to cover this window.

Next, the structures for opening or closing these side lids will be described. Since all three side lids 16*c*, 16*d*, and 16*e* have basically the same structures for opening or closing them, only the lid 16*c* for covering the inlet window will be described as their representative, for the sake of convenience.

Figure 47A:
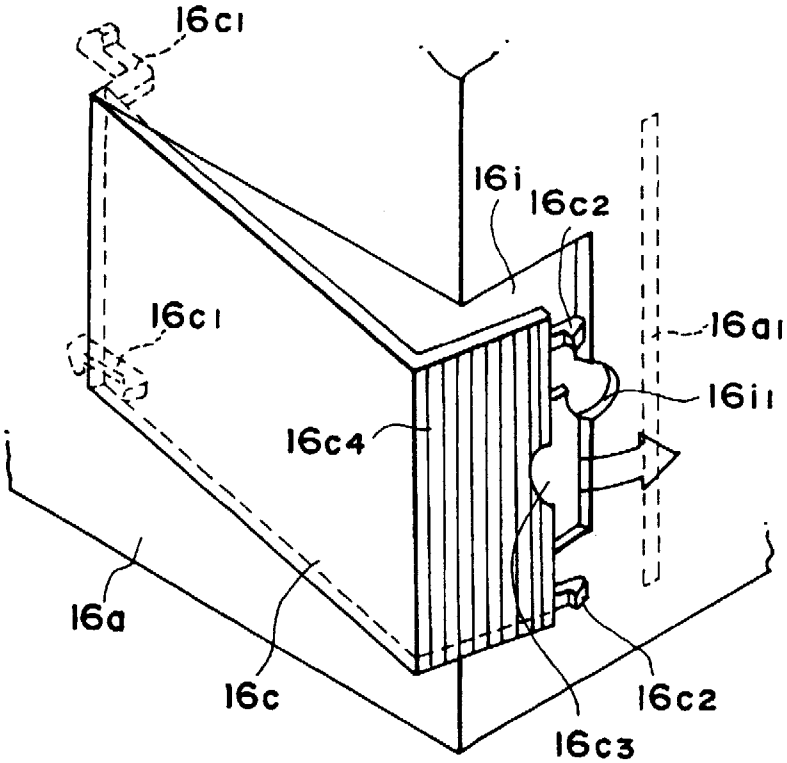
FIGS. 47(*a*) and (*b*) depict the structure of a side lid.
Figure 47B:
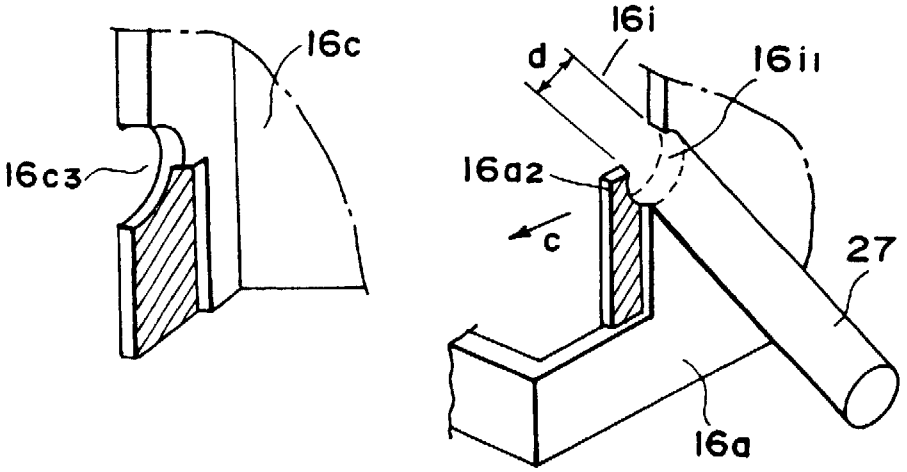

Referring to FIG. 47(*a*), one edge of the side lid 16*c* is provided with a pair of hinge claws 16*c*1. These hinge claws are inserted through the window 16*i* of the main cover 16*a* and are pivoted about the edge of the window 16*i* where the edge of the side lid 16 makes contact as shown in FIG. 47(*a*), and a pair of engagement claws 16*c*2 provided on the other edge of the side lid 16*c* are hooked onto a pair of engagement ribs 16*a*1 provided on the internal surface of the main cover 16*a*, fixing thereby the side lid 16 in place.

The cover 16*c* and window 16*i* are provided with a power cord cutaway 16*c*3 and 16*i*1, at the edge adjacent to the ribs 16*a*1 and at the edge adjacent to the engagement claws 16*c*2, respectively, so that a power cord can be put through a hole formed by these cutaways. Further, the side lid 16*c* is provided with a knurled surface 16*c*4 on the rearward facing portion so that it is easier to be opened or closed.

The portions of the side lid 16*c* and main cover 16*a*, where the power cord cutaways 16*c*3 and 16*i*1 are provided, have half the thickness of the other portions, at the areas indicated by solidus in FIG. 47(*c*), and these solidus areas with half the thickness overlap each other when the side lid 16*c* is closed. This arrangement is made to cause the cord 27 put through the hole formed by the power cord cutaway 16*c*3 and 16*i*1 of the side lid 16*c* and main cover 16*a*, respectively, to hang up on the projecting thin wall portion 16*a*2 of the main cover 16*a*, when the cord 27 is pulled by mistake in the direction indicated by an arrow mark c in FIG. 47(*b*), so that the side lid 16*c* is prevented from being accidentally opened by the cord 27 pulled in the wrong direction by mistake. Needless to say, the measurement d of the opening of the cutaway portion 16*i*1 is made to be larger than the diameter of the cord 27.

Similarly, the I/O connection side lid 16*d* is provided with the same structure, that is, the cord cutaway and knurled surface.

With provision of the side lids 16*c*, 16*d*, and 16*e*, the connectors for the cord 27 or the like are not exposed, which prevents dust or foreign matter from settling down on the connector portions. Also, this arrangement of placing the cord 27 to be pulled out rearward favorably affects the apparatus design.

<Double Protection for Reflection Mirror>

While the external case 16 covering the apparatus constitutes the apparatus exterior, this external case 16 offers double protection to the reflection mirror 8*f* of the optical system. The reflection mirror 8*f* is mounted on the frame 15, and when this reflection mirror 8*f* is shifted even by a slightest amount, the optical image projected on the photosensitive drum is distorted, which results in the distorted image or the like. Therefore, the positional accuracy of the reflection mirror 8*f* must be strictly controlled, and it is preferable to prevent as much as possible the reflection mirror 8*f* from being subjected to impact.

Therefore, in this embodiment, when the frame 15 is covered with the external case 16, the top portion of the reflection mirror mounted on the frame 15 is covered with the mirror protecting portion 16*a*3 of the main frame 16*a* as shown in FIG. 44 and 48. Further, this mirror protecting portion 16*a*3 is covered with the top lid 16*b* when the top lid 16*b* is closed.

Therefore, when the top lid 16*b* is at a normal position, that is, when it is closed, the reflection mirror 8*f* is under double protection, being covered by the mirror protecting portion 16*a*3 and top lid 16*b*. With this arrangement in place, even when the something is dropped on the apparatus by mistake, its impact is unlikely to be transmitted to the reflection mirror 8*f*.

<LED Light Conducting Member>

On the top surface of the external case 16, a display portion is provided for displaying whether the power is on or off, whether the line connecting the host computer and image forming apparatus is on or off, or the like state of the image forming apparatus, which is indicated by whether the light from the LED is on or not. This light from the LED is conducted to the top surface of the external case 16 through an optically conductive member 28 shown in FIGS. 49 and 50.

This optically conductive member 28 is composed of material such as acrylic material having a high light transmissivity, being provided with an extremely smoothly formed surface, and is attached to the internal surface of the external cover 16, wherein each of the light exiting ends of four light pipes 28*a*, 28*b*, 28*c*, and 28*d* is exposed at the top surface of the external case 16 (FIG. 44 and 45). When the external case 16 is in place, each of the light entering ends of the aforementioned four light pipes 28*a*, 28*b*, 28*c*, and 28*d* is disposed to face a corresponding LED 28*f*, which comes on or off in response to the control from the control circuit portion 14*a*7, so that the light is conducted to be displayed at the top surface of the external case 16.

Figure 49:
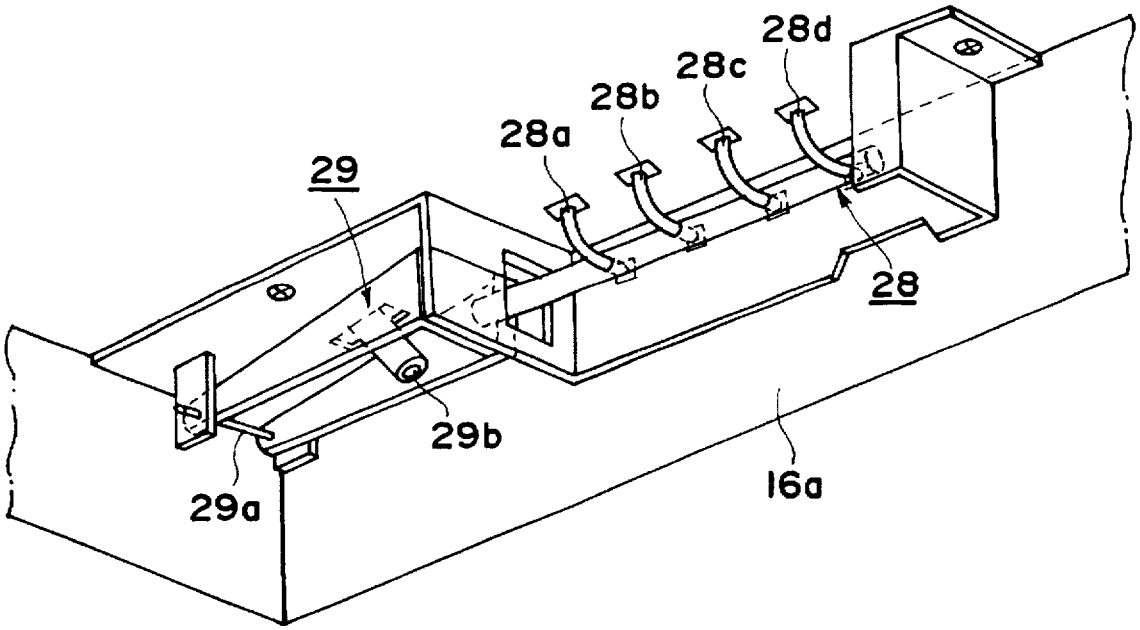
FIG. 49 is an oblique view of a light conducting member.
Figure 50:
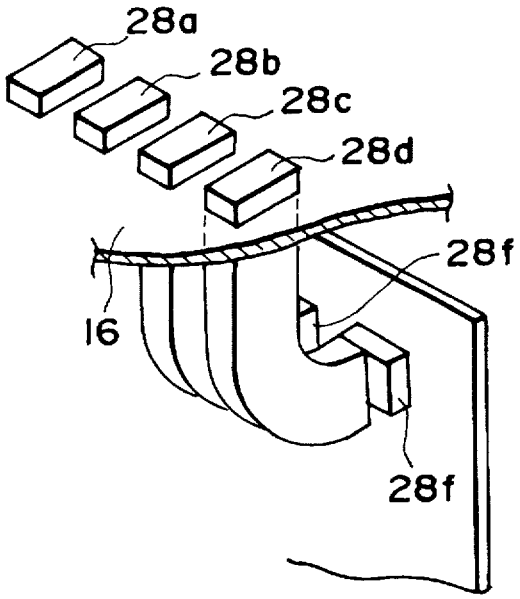
FIG. 50 is an oblique view of the light conducting member.

The line between the host computer and image forming apparatus is switched on or off by pressing an access button 29 exposed outward the external case 16, as shown in FIG. 44. This access button 29 is attached so as to be pivotable about an axis 29*a* as shown in FIG. 49. As for the location of the access button 29, it is on the internal surface of the external case, approximately at the same location as the optically conductive member 28, and a portion of the optically conductive member 28 pivotally supports the axis 29*a* of the access button 29.

When the access button 29 is pressed, a pressing portion 29*a* is pivoted and presses a contact switch (unshown) connected to the electrical component mounting board 14*a*. Then, an operational mode is switched through this switch, and the LED 28*f* is turned on or off in response to this mode switching.

(Assembling Process)

The aforementioned assembly process is centered around the frame 15. Next, the assembling order will be described referring to FIGS. 1 and 5.

To begin with, the cover guide 10*e* is mounted from underneath (in actuality, the frame 15 is placed upside down, and the assembly takes place downward from the top), and then, the electrical component unit 14 is mounted from underneath the cover guide 10*e*. Further, the conveying unit 30 in which the pickup roller 10*a*, conveying gear 10*a*1, conveying roller 10*b* and the like are united, is mounted.

Since the electrical component unit 14 is mounted from underneath as described in the foregoing, the recording medium P guiding portion 15*j* (FIG. 1) to be located above the electrical component unit 14 can be integrally molded with the frame 15, which in turn makes it easy to establish the positional relationship of the recording medium P to the transfer nip formed between the photosensitive drum 2 and transferring roller 11 by their contact pressure, to be always highly precise.

When the assembly process is structured so as for the electrical component unit 14 to be mounted from above as it is done in the prior assembly process, the conveying guide portion 15*j* cannot be integrally formed with the frame 15, and as a result, the conveying guide portion is required to be highly precisely positioned relative to the frame 15, in order to achieve a high degree of accuracy in the positional relation of the recording medium P to the transfer nip, which makes a simple assembly process impossible, whereas in this embodiment, such a problem does not exist.

Diagonally downward from above the front side of the frame 15 (putting the upside down frame 15 back to the normal position), guide 10*c*, rollers 10*d*1, 10*d*2, and 10*d*3 (FIG. 1) are mounted. Then, after the gear unit 13 are mounted on the left lateral wall of the frame 15, the main motor 20 is mounted. At the same time as this main motor 20 is mounted, the connector 20*c* of the main motor 20 is fitted into the motor connector 14*f*2 of the electrical component mounting board 14*a*. Next, after the transferring unit comprising the transferring roller 11, guide member 11*b*, and the like are mounted, the scanner unit 8*e* is mounted.

Further, the fixing means 12 in which the film guide member 12*a*, pressure roller 12*d* and the like are united, is mounted, and during this step, the connectors of the fixing means 12 are inserted into the DC and AC connectors 14*f*5 and 14*f*6. Then, after the discharging members such as the discharging roller pairs 10*h* and 10*i*, and the cooling fan 19 are mounted, the reflection mirror 8*f* is mounted last.

After all the components are thus mounted on the frame 15, the external case 16 is mounted from above the frame 15, completing the assembly process of the image forming apparatus A. Then, the cassette 9 and process cartridge B are inserted to complete the entire assembly process.

(Image Forming Operation)

Next, referring to FIG. 1, the image forming operation of the aforementioned image forming apparatus A will be described. First, the process cartridge B is installed, along with the cassette 9 storing the recording medium P. When the apparatus in this state receives a recording start signal, the pickup roller 10*a* along with the conveying roller 10*b* are rotated, whereby the recording medium P is separated one by one by the separating claw 9*f*, is fed out of the cassette 9, with its top surface being guided by the shield plate 14*c* of the electrical component unit 14, and is delivered to the conveying roller 10*b*. After being reversed along the conveying roller 10*b*, it is conveyed to the image forming station, with its bottom surface being guided by the guide portion 15*j* and the top side being guided by the guide member 10*k*.

When the leading end of the recording medium P is detected by the registration sensor S1, an image is formed in the image forming station in synchronism with the conveying timing with which the leading end of the recording medium P travels from the sensor to the transfer nip portion.

More specifically, the photosensitive drum 2 is rotated in the direction indicated by an arrow in FIG. 1 in a manner so as to synchronize with the recording medium P conveying timing, and in response to this rotation, a charge bias is applied to the charging roller 3*a*, whereby the surface of the photosensitive drum 2 is uniformly charged. Then, a laser beam modulated by the imaging signal is projected from the optical system 8 onto the surface of the photosensitive drum 2, whereby a latent image is formed on the drum surface in response to the projected laser beam.

At the same time as when the latent image is formed, the developing means 4 of the process cartridge B is driven, whereby the toner feeding mechanism 4*b* is driven for feeding the toner within the toner storage 4*a* out to the developing sleeve 4*d*, and the toner layer is formed on the rotating developing sleeve 4*d*. The latent image on the photosensitive drum 2 is developed by the toner by applying to the developing sleeve 4*d* a voltage having the same polarity and substantially the same amount of electric potential as those of the photosensitive drum 2. Then, the toner image on the photosensitive drum 2 is transferred onto the recording medium P having been delivered to the transfer nip portion, by applying to the transferring roller 11 a voltage having the polarity opposite to that of the toner.

While the photosensitive drum 2 from which the toner image has been transferred onto the recording medium P is further rotated in the arrow direction in FIG. 1, the residual toner on the photosensitive drum 2 is scraped off by the cleaning blade 5a. The scraped toner is collected in the waste toner storage 5c.

On the other hand, the recording medium P on which the toner image has been transferred is guided by the cover guide 10e, by the bottom surface, and is conveyed to the fixing means 12. In this fixing means 12, the toner image on the recording medium is fixed by applying heat and pressure. Next, the recording medium P is reversed by the discharge relay roller 10f and the sheet path 10g, being thereby de-curled as it is reversely curved, and is discharged by the discharge roller 10h and 10i into the discharge tray 10j.

(Image Formation References)

In the image forming apparatus of this embodiment, (1) recording medium P conveyance reference, (2) process cartridge B installation position reference, and (3) scanning start reference, based on which the optical system 8 begins projecting the optical image onto the photosensitive drum 2, are provided on the same side of the image forming apparatus A (in this embodiment, the left lateral side of the apparatus main assembly, that is, the side on which the gear unit 13 is disposed). This arrangement will be more specifically described referring to a schematic plan view in FIG. 51.

First, the recording medium P conveyance reference will be described. While, after having been fed out by the pickup roller 10a, the recording medium P is conveyed forward by the conveying roller 10b and rollers 10d1, 10d2, and 10d3 being pressed thereupon (FIG. 1), the angular conveyance angles α (angle at which the rollers press the recording medium P onto the referential surface of the conveying guide), at which three rollers 10d1, 10d2, and 10d3 are angled to the left, are set at α1=0.5°, α2=4.0°, and α3=4.0°. Also, their contact pressures upon the conveying roller 10b are set at 400 g, 400 g, and 300 g, respectively. As described hereinbefore, the driving force is transmitted to the conveying roller 10b, by way of the clutch 32, from the conveying gear 10b1 meshed with the conveyance drive gear 13f of the gear unit 13.

With this arrangement, while the recording medium P is conveyed by the conveying roller 10b, one of the lateral sides of the recording medium P is pressed against the conveying guide referential surface 31 provided on the frame 15. In other words, the recording medium P is conveyed using the so-called single conveyance reference. The conveying guide referential surface 31 is provided on the internal surface of the left lateral wall of the frame 15, on which the gear unit 13 is mounted.

The process cartridge B positioning reference will be described. As described previously, when the process cartridge B is installed, it is inserted with its cylindrical projections 7c1 and 7c2 being guided by the first guide portions 7a provided on the frame 15, and as it is further inserted, these projections 7c1 and 7c2 drop into the groove portion 7a1, completing the installation process. One of the first guide portions 7a located on the internal surface of the left lateral wall of the frame 15 is provided with the cartridge positioning referential surface 33 which projects inward adjacent to the groove portion 7a1. Having one of the first guide portions 7a1 project inward adjacent to the groove portion 7a1, the process cartridge B is unlikely to rattle in the lateral direction.

The photosensitive drum 2 within the process cartridge B is rotated as the driving force is transmitted to the drum gear 2a meshed with the gear 13c2 of the gear unit 13. Since the gear 13c2 and drum gear 2a are helical gears, their rotation generates thrust which pressures the photosensitive drum 2 toward the cartridge installation referential surface 33. More specifically, the drum gear 2a is provided with a right helix angle of approximately 14.6°; therefore, when the driving force is transmitted to the photosensitive drum 2, the entire process cartridge B is pressured toward the left side of the apparatus in the thrust direction of the photosensitive drum 2, whereby the left surface of the frame 1 is placed in contact with the cartridge installation referential surface 33. Normally, while coming in contact with the referential surface 33, the process cartridge B shifts approximately 1 mm–3 mm in the thrust direction, within the range of the play allowed for the installation.

Therefore, as the left surface of the frame 1 comes in contact with the cartridge installation referential surface 33 during the image forming operation, the photosensitive drum 2, which has been positionally fixed in the front and rear direction when the cylindrical projections 7c1 and 7c2 dropped into the groove portion 7a1, comes in contact with this frame i f with the left surface (more precisely, the drum gear 2a mounted on the left end of the photosensitive drum 2), whereby the photosensitive drum 2 is positionally fixed in the lateral direction also. With this arrangement in place, the position of the photosensitive drum 2 of this embodiment is always fixed at the same spot.

Further, since the cartridge installation referential surface 33 is provided on the frame 15, on the same side, the left side, where the gear unit 13 for transmitting the driving force to the drum gear 2a is provided, the distance between the drum gear 2a and referential surface 33 is small compared to an arrangement in which the gear unit 13 is disposed, for example, on the left side wall of the frame 15; therefore, even when the helical drum gear 2a is slightly shifted toward the referential surface 33, the amount of shift is smaller. As a result, the accuracy in distances among the components and assembly accuracy can be improved.

The optical image scanning start reference will be described. When the optical image is projected on the surface of the photosensitive drum 2 from the optical system 8, this optical image is scanned side to side in the longitudinal direction of the photosensitive drum 2, by the rotation of the polygon mirror 8b. In this embodiment, this scanning action is started at the left side relative to the longitudinal direction of the photosensitive drum 2. More specifically, referring to FIG. 51, a scanning starting reference point X1 is provided at one end of the optical image scanning range G (image forming range), on the same side as the side where the aforementioned conveyance referential surface 31 and cartridge positioning referential surface 33 are disposed, that is, on the side where the gear unit 13 is disposed, and the scanning is started at the scanning start referential point X1 and is carried out toward X2.

Figure 52:
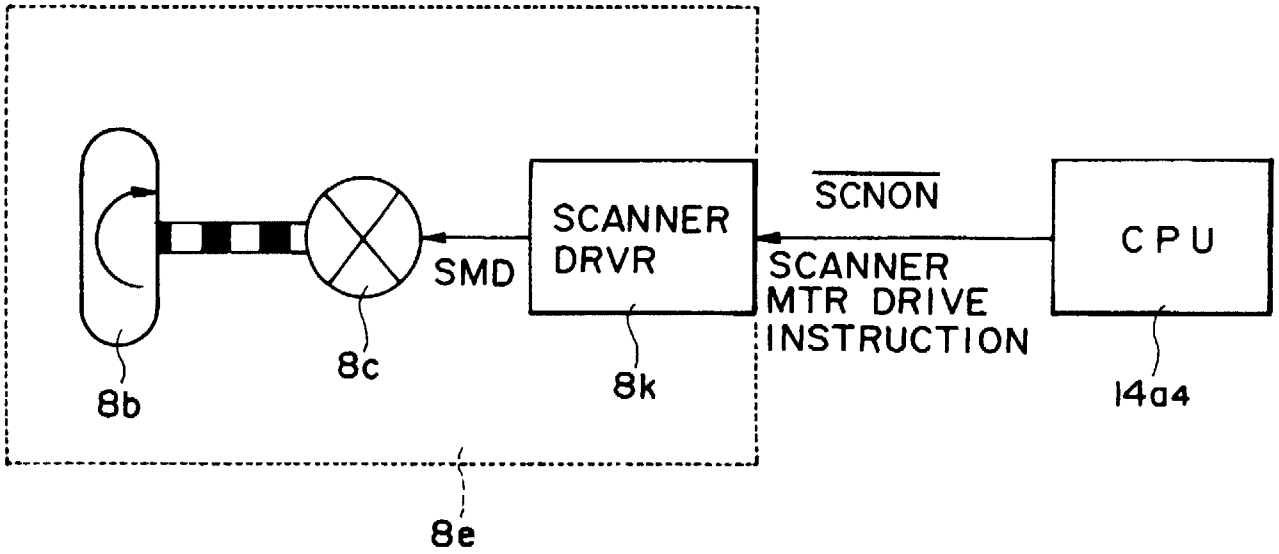
FIG. 52 is a block diagram of a scanning sequence of a scanning unit.

At this time, referring to FIG. 52, the scanning structure will be described. The most important portion of the scanner unit 8e is the polygonal mirror 8b, which is mounted on the rotational axle of the scanner motor 8c and is rotated as the scanner motor 8e rotates. The rotational velocity f the scanner motor 8c is controlled by the scanner driver 8k, so that the laser beam reflected by the polygon mirror 8b scans the surface of the photosensitive drum 2 at a constant speed, starting from the side where the gear unit 13 is disposed.

More specifically, when a scanner drive command (SCNON) is sent from the CPU 14a1 to the scanner driver 8k, the scanner driver 8k sends a scanner motor rotation signal (SMC) to the scanner motor 8c to start the motor 8c. Also, the scanner driver 8k controls the voltage of the motor rotation signal, so that the rotational velocity of the scanner motor 8c remains constant. At this time, the polygonal mirror 8b of this embodiment is rotated in the clockwise direction, whereby the laser beam sequentially scans the surface of the photosensitive drum 2 in the thrust direction from the side where the gear unit 13 is disposed, that is, from X1 to X2 in FIG. 51, at a constant speed.

Since the referential surface for recording medium P conveyance, the reference surface for fixing positionally in the thrust direction the process cartridge B which forms the toner image and transfers it onto the recording medium P, and the reference point at which the laser bean scanning is started for forming the latent image on the photosensitive drum 2 of the process cartridge B are all provided on the same side of the apparatus main assembly (that is, the side on which the gear unit 13 is disposed), an image shift or the like is unlikely to occur. As a result, high quality images can be produced.

[Alternative Embodiments]

Next, an alternative embodiment of each of the components of the aforementioned image forming apparatus and process cartridge will be described.

{Cartridge Installing Means}

(Process Cartridge Installation Guide)

Figure 53:
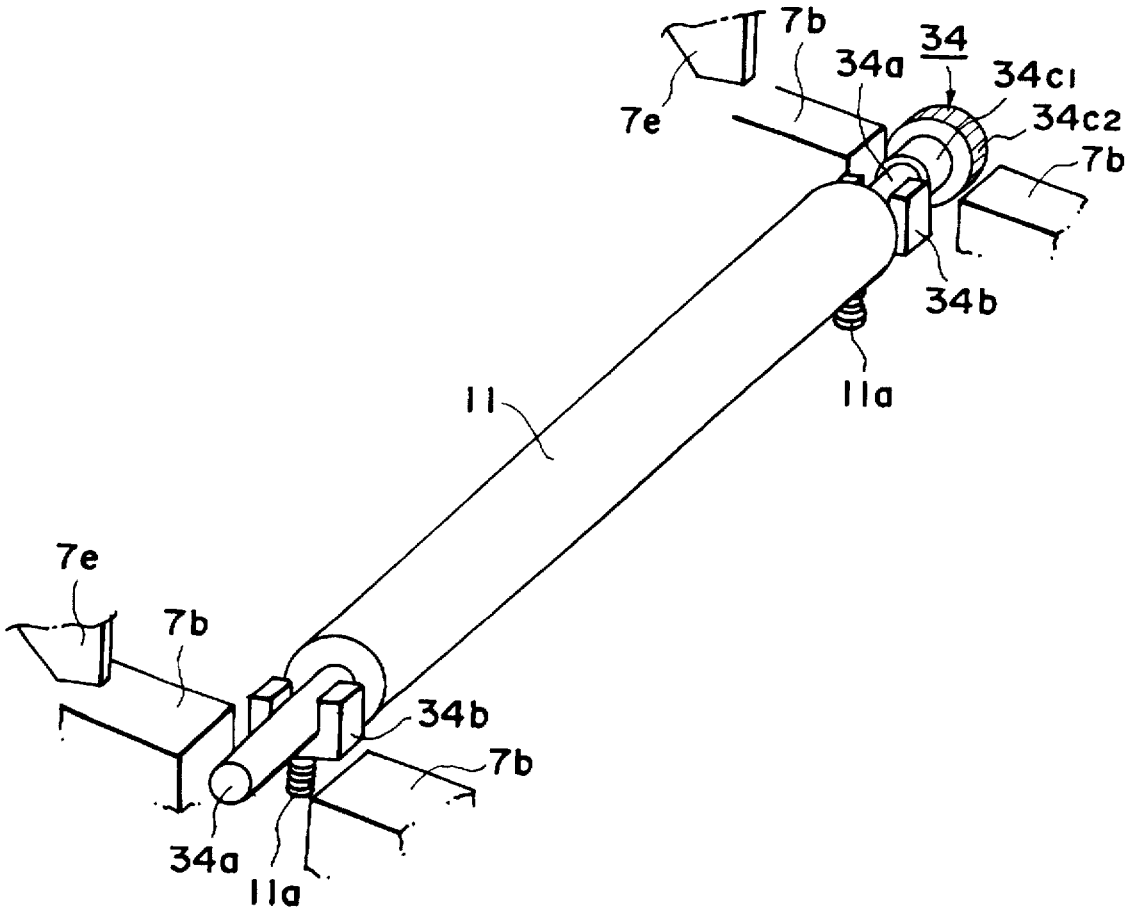
FIG. 53 is an oblique view of an alternative embodiment of the second guide portion for guiding the process cartridge.

The first embodiment exemplifies the case in which the first guide portion 7a and second guide portions 7b are provided on the frame 15 of the apparatus main assembly 6, as shown in FIG. 6, for guiding the process cartridge B during the installation, wherein the second guide portion 7b is continuous. However, this second guide portion 7b may have a structure as shown in FIG. 53, in which the second guide portion 7b is disposed across the bearing portion of the transferring roller 11. At this time, the structure shown in FIG. 53 will be concretely described, wherein the components having the same functions as those in the first embodiment will be designated by the same symbols.

A shaft 34a of the transferring roller 11 is supported by the bearing 34b, and a single piece transfer gear 34c comprising a flange portion 34c1 and a gear portion 34c is attached to one end of the shaft 34a. The roller shaft 34a extends across the second guide portion 7b, rendering the second guide portion 7b discontinuous at the locations of the flange portion 34c1 and roller shaft 34a.

In the case of this structure, when the process cartridge B is inserted in such a manner as for the second engagement portion 7e of the process cartridge B to be guided by the second guide portion 7b, the second engagement portion 7e comes to be guided by the flange portion 34c and roller shaft 11c, at the locations where the second guide portion 7b is discontinuous. While riding over the roller shaft 11c, the second engagement portion 7e presses down the roller shaft 11c. Therefore, when the process cartridge B is installed, the transferring roller 11 escapes downward. As a result, the collision between the cartridge frame 1 and transferring roller 11 which occurs during the cartridge installation can be surely prevented even without strict control over the vertical distance between the second guide portion 7b and transferring roller 11, or the like.

Figure 54:
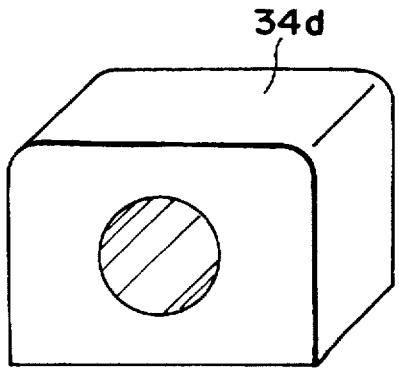
FIG. 54 is an oblique view of an alternative embodiment of a bearing for a transferring roller.

In addition to this structural arrangement in which the flange portion 34c1 and shaft 34a of the transferring roller 11 are pressed down by the second engagement portion 7e of the process cartridge B, another alternative structure may be employed in which the second engagement portion 7e presses down the bearing 34b. In such a case, a bearing 34d shaped to cover the entire circumference of the roller shaft 34a as shown in FIG. 54 affords a better operational efficiency during the cartridge installation than the U-shaped bearing 34b as shown in FIG. 53, since the former does not hang up with the second engagement portion 7e.

Figure 55:
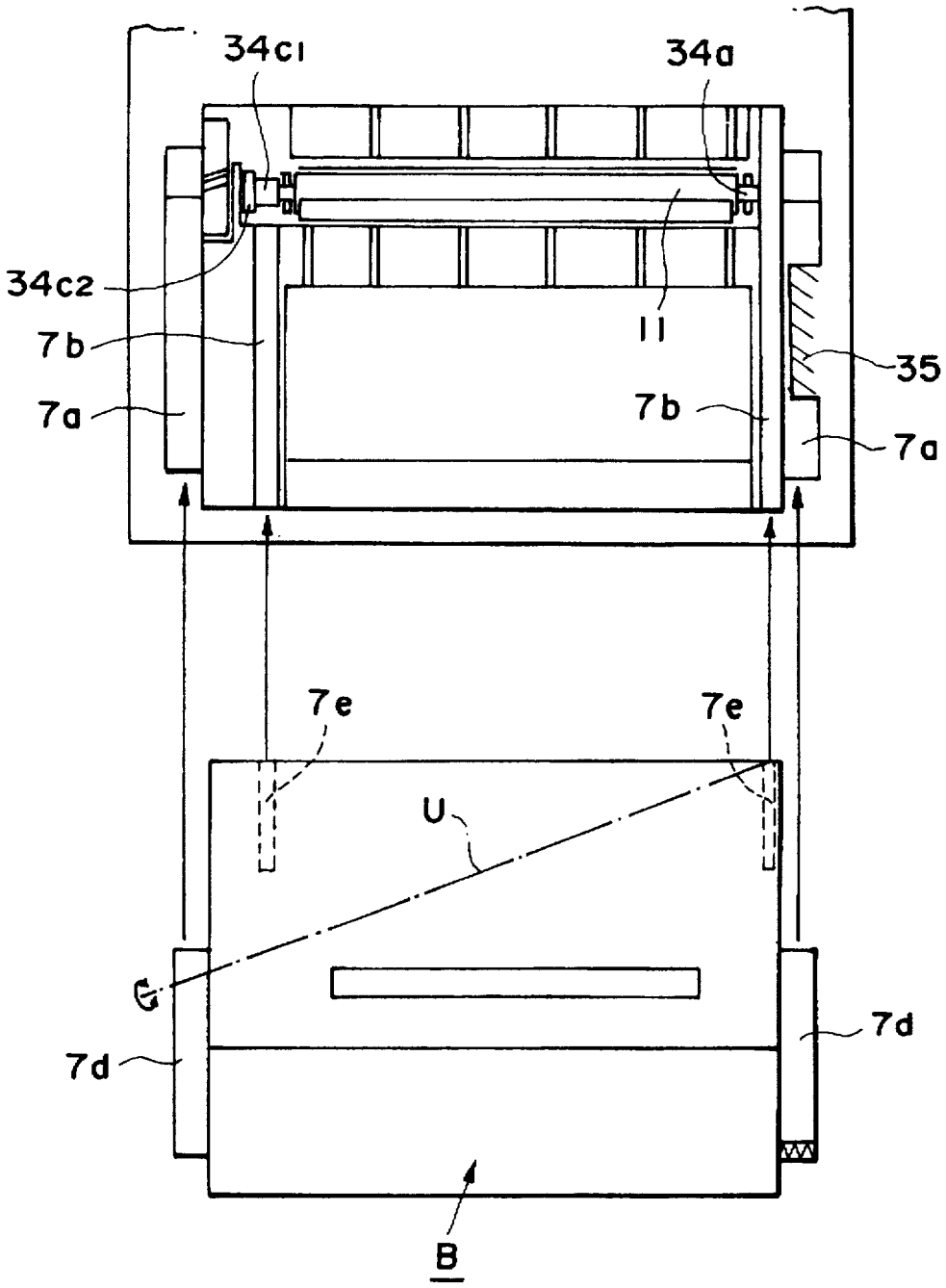
FIG. 55 is a schematic plan view of an alternative embodiment in which one of the second guide portions is shortened, and an auxiliary guide is provided.
Figure 56:
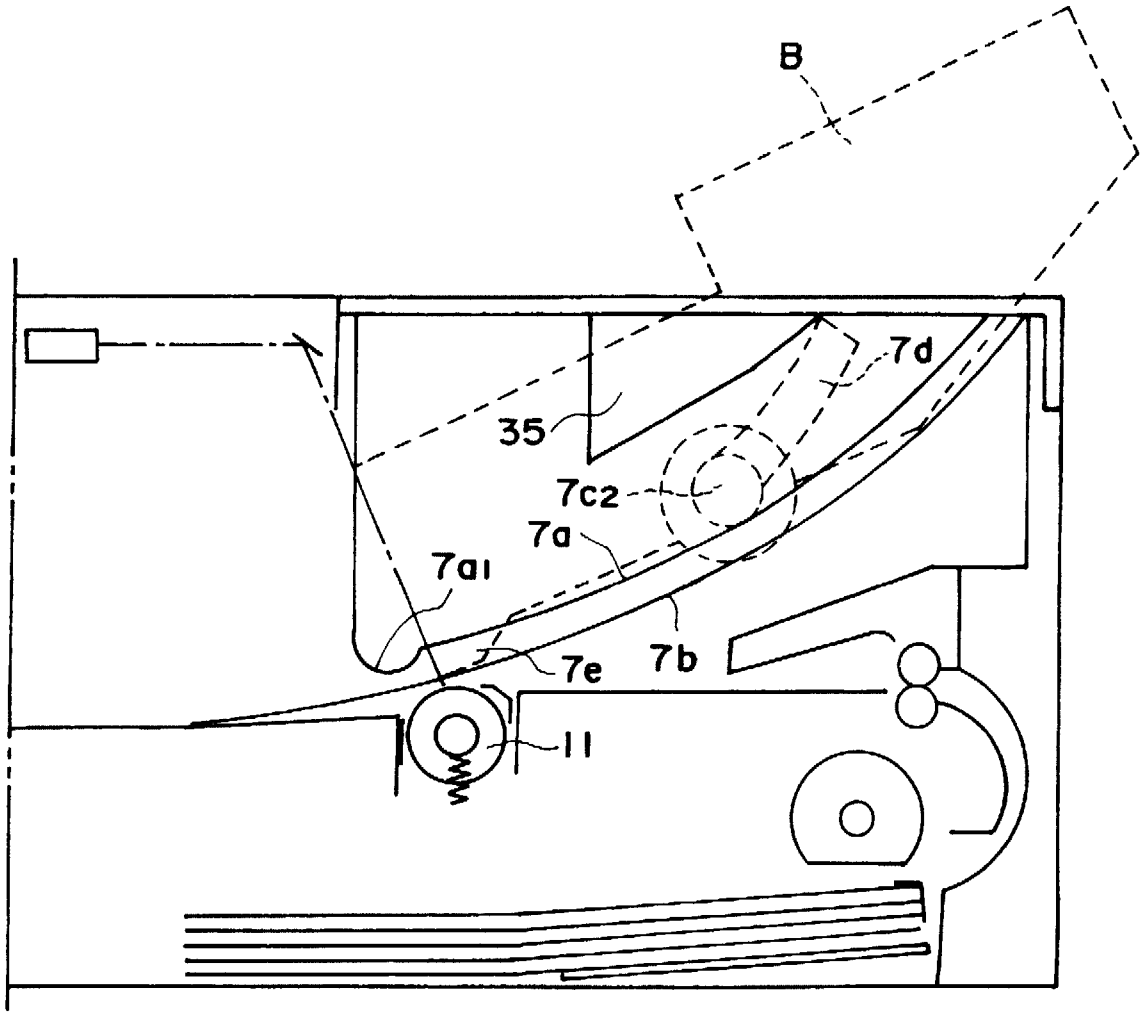
FIG. 56 is a schematic sectional view of an alternative embodiment in which the auxiliary guide is provided.
Figure 57:
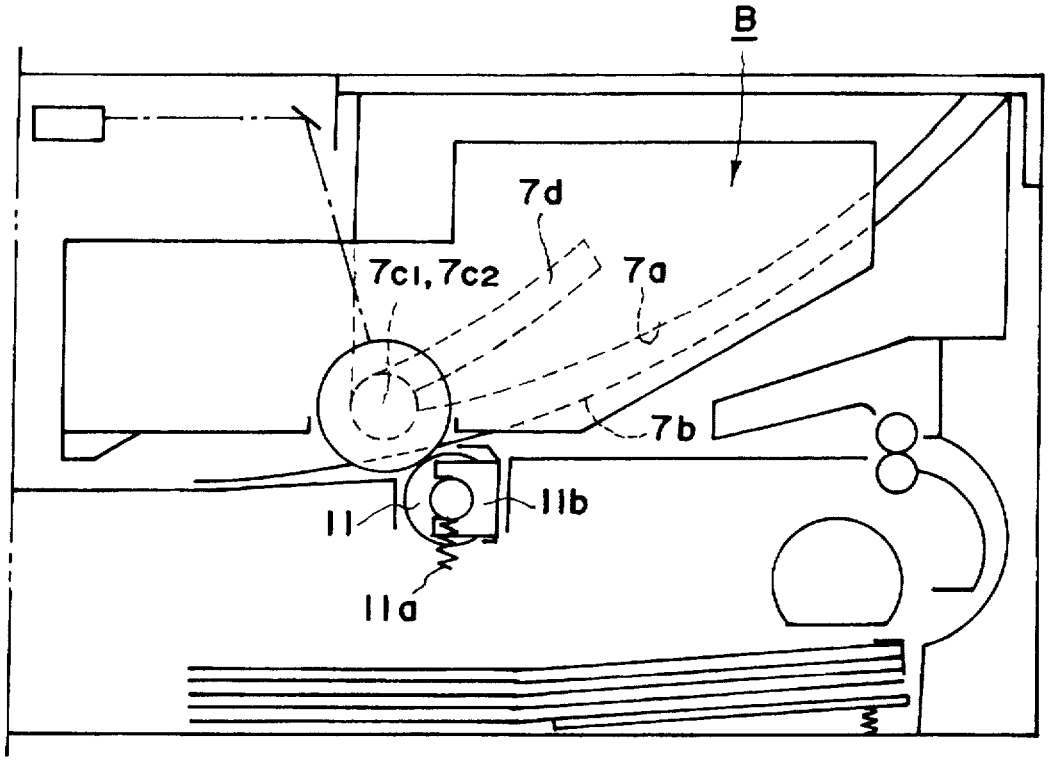
FIG. 57 is a schematic sectional view of an alternative embodiment in which the transferring roller and guide portions can be integrally moved.
Figure 58:
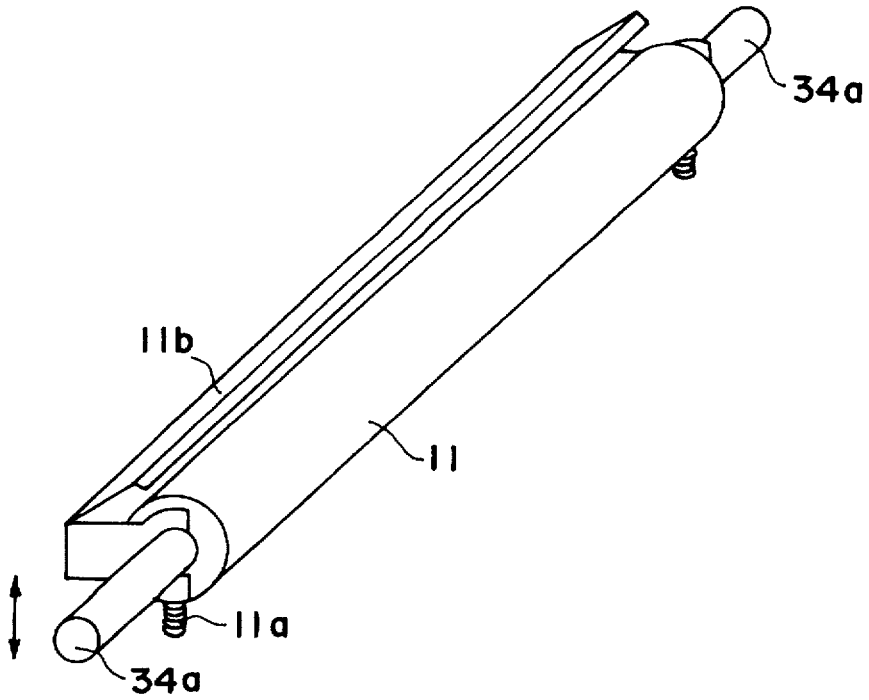
FIG. 58 is an oblique schematic view of the alternative embodiment in which the transferring roller and guide portions can be integrally moved.

Further, the first embodiment exemplifies an arrangement in which the second guide portion 7b is disposed in the apparatus inward of the first guide portion 7a, and also, is extended rearward beyond the transferring roller 11, as shown in FIG. 6. However, a structure as shown in FIGS. 55 and 56 may be employed. In this structure, one of the second guide portions 7b described in connection with the first embodiment (second guide portion 7b on the left in FIG. 55) is shortened, extending as far as only the front side of the flange portion 34c1 of the transferring roller 11, and instead, an auxiliary guide portion 35 is provided above the other second guide portion 7b on the right side. This auxiliary guide portion 35 guides the top end of the first engagement portion 7d as shown in FIG. 56 during the process cartridge installation.

At the initial stage of the process cartridge B insertion being guided by such a guide, the first engagement portion 7d is guided by the first guide portion 7a, and the second engagement portion 7e is guided by the second guide portion 7b. However, after the second engagement portion 7e has reached beyond the transferring roller 11, the second engagement portion 7e on the left side loses contact with the shorter second guide portion 7e, sticking out in the air; therefore, the cartridge B comes to be supported at three points: both left and right first engagement portions 7d and the second engagement portion on the right side. Therefore, without the auxiliary guide portion 35, the cartridge B is allowed to rotate about a line U connecting the first engagement portion 7d on the left side and the second engagement portion 7e on the right side, as shown in FIG. 55.

With the provision of the auxiliary guide 35, the top end of the first engagement portion 7d on the right comes in contact with the auxiliary guide portion 35 as shown in FIG. 56, regulating thereby the rotational movement of the cartridge B. Therefore, the cartridge B does not collide with the transferring roller 11 or the like during the cartridge installation.

The embodiment illustrated in FIG. 55 exemplifies a case in which the auxiliary guide portion 35 is provided on the internal surface of the right side wall and the second guide portion 7b on the left is shortened, but the auxiliary guide portion 35 may be provided on the left side, or on both sides. Further, the second guide portion 7b on the right may be shortened.

In the first embodiment, the guide member 11b for guiding the recording medium P to the transferring roller 11 is positionally fixed (FIG. 1), but an alternative structure may be employed in which the guide member 11b is allowed to move vertically along with the transferring roller 11. With such an arrangement, when the transferring roller 11 escapes downward during the process cassette B installation, the guide member 11b also escapes downward; therefore, the collision which occurs between the cartridge frame 1 and guide member 11b can be surely prevented without a need for strict control over the vertical distance between the second guide portion 7b and guide member 11b, or the like.

Figure 59:
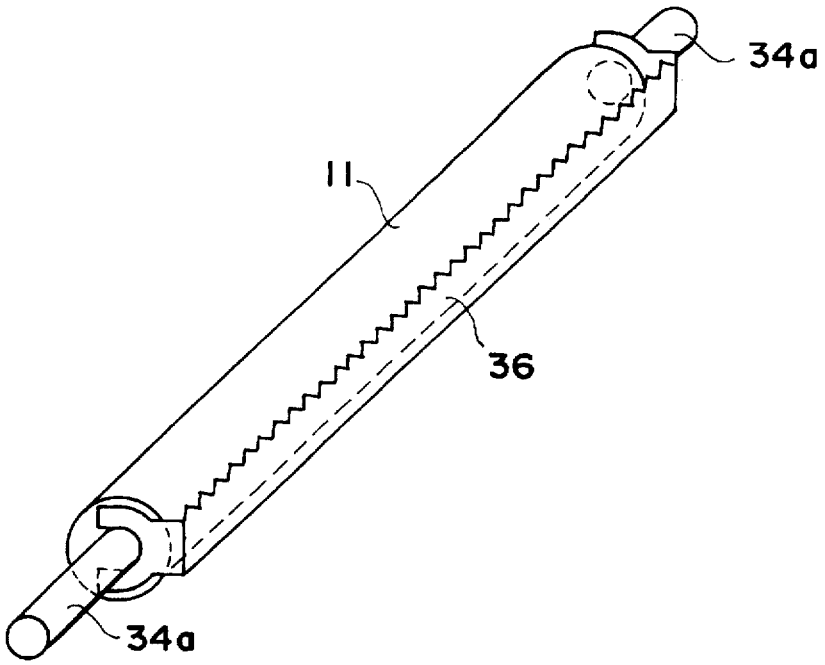
FIG. 59 is, an oblique schematic view of an alternative embodiment in which the transferring roller and a discharging needle can be integrally moved.

Further, a discharging needle as a discharging member for discharging the recording medium P after the toner transfer is provided adjacent to the transferring roller 11, and this discharging needle may be mounted as shown in FIG. 59 so that it is moved along with the transferring roller 11 in the same manner as described in the foregoing. In this case, the same effects as described in the foregoing are obtained.

(Pressure Generation by Drum Shutter)

In the first embodiment, the drum shutter 17a is designed to be automatically opened as the process cartridge B is installed, and to be automatically closed by the torsional coil spring 17*d* as the cartridge B is pulled out. Therefore, when the process cartridge B is in the image forming apparatus, the drum shutter 17*a* is pressured in the closing direction by the spring 17*d*, whereby the process cartridge B is pressured in the direction in which the process cartridge B is to be lifted out of the frame 15, which is one of the advantages of such a design. However, when the pressure from the torsional spring 17*d* is too strong, the process cartridge B becomes positionally instable. Therefore, a locking mechanism may be provided for locking the drum shutter 17*a* when the drum shutter 17*a* is opened.

Figure 60:
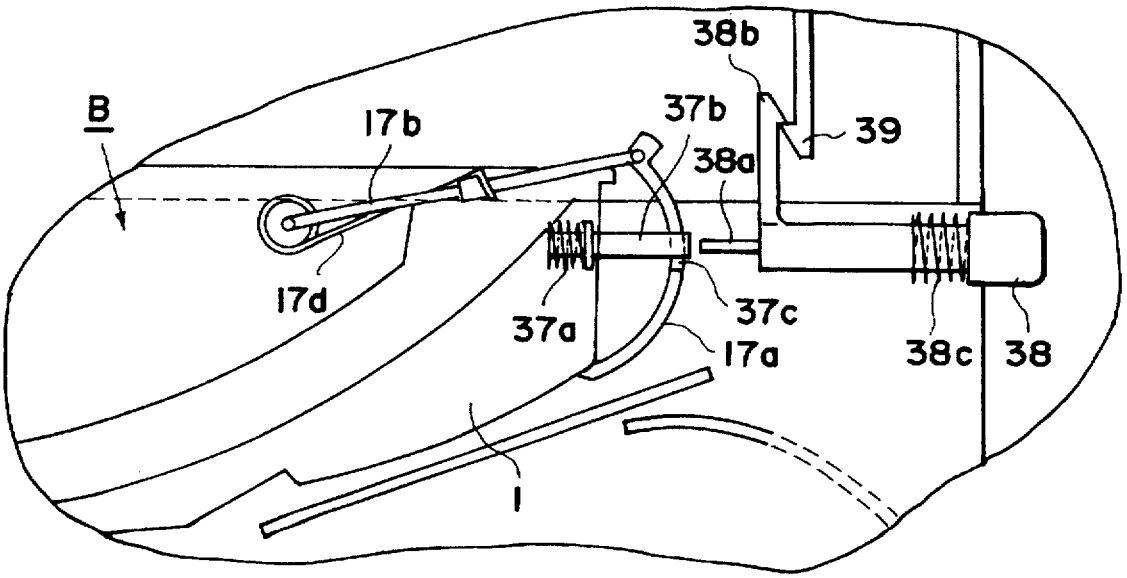
FIG. 60 depicts an alternative embodiment comprising a locking mechanism for locking the shutter mechanism in the open state.

As for the locking mechanism, referring to FIG. 60, a lever 37*b* pressured by a compression spring 37*a* is provided at a predetermined location of the process cartridge B, wherein this lever 37*b* engages into an engagement hole 37*c* provided on the drum shutter 17*a* when the shutter mechanism opens all the way. By this arrangement, the drum shutter 17*a* is locked in the open state; therefore, the pressure from the torsional coil spring 17*d* is prevented from working to lift the process cartridge B.

The locked shutter mechanism is released by an eject button 38 shown in FIG. 60. More specifically, the apparatus main assembly 6 is provided with the eject button 38, which is pressured by a compression spring 38*c* in the direction to stick out of the apparatus main assembly. As this ejection button 38 is pressed, a pressing projection 38*a* located at the end of the button pushes in the lever 37*b*, whereby the lever 37*b* is disengaged from the engagement hole 37*c*, releasing thereby the shutter mechanism from the locked state.

The eject button 38 is provided with an engagement claw 38*b*. When the top lid 16*b* is closed, this engagement claw 38*b* engages with the engagement hook 39 provided on the top lid 16*b*, locking thereby the top lid 16*b* in the closed state. On the other hand, when the eject button 38 is pressed, the engagement is broken and the top lid 16*b* is opened by the pressure from the torsional coil spring provided at the rotational center of the top lid 16*b*. In other words, as the ejection button 38 is pressed, the top lid 16*b* is automatically opened, and at the same time, the process cartridge B is lifted, as if floating out of the frame 15, by the pressure from the spring 17*d*, which makes it easier to take out the process cartridge B.

Referring to FIGS. 61–65, the pressure which is provided by the drum shutter in the first embodiment can be provided by an alternative structure, which is totally different from that in the first embodiment. Hereinafter, the structure of the alternative structure shown in FIGS. 61–65 will be described.

Figure 61:
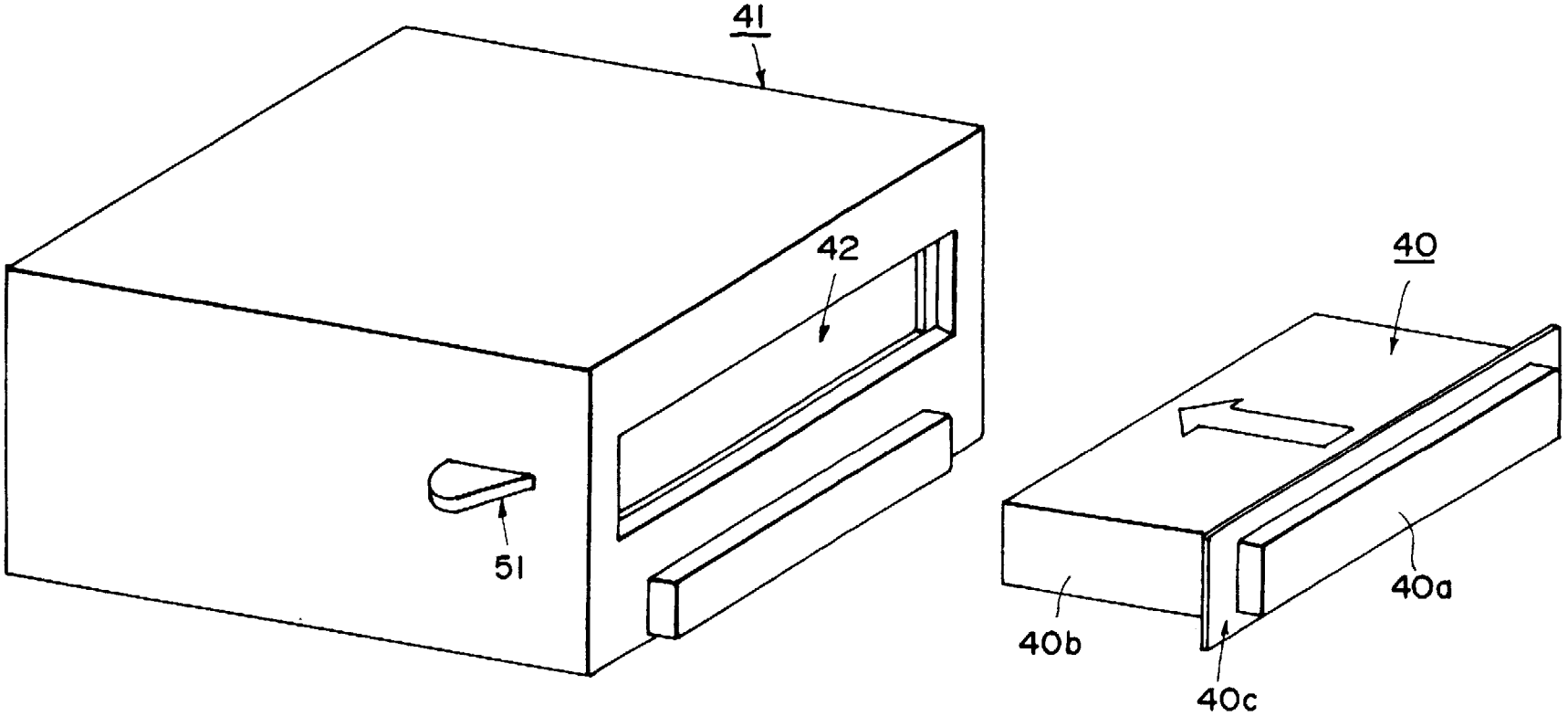
FIG. 61 is an oblique view of an image forming apparatus comprising an alternative embodiment of a pressure generating structure based on the drum shutter, and a process cartridge for such an apparatus.
Figure 62:
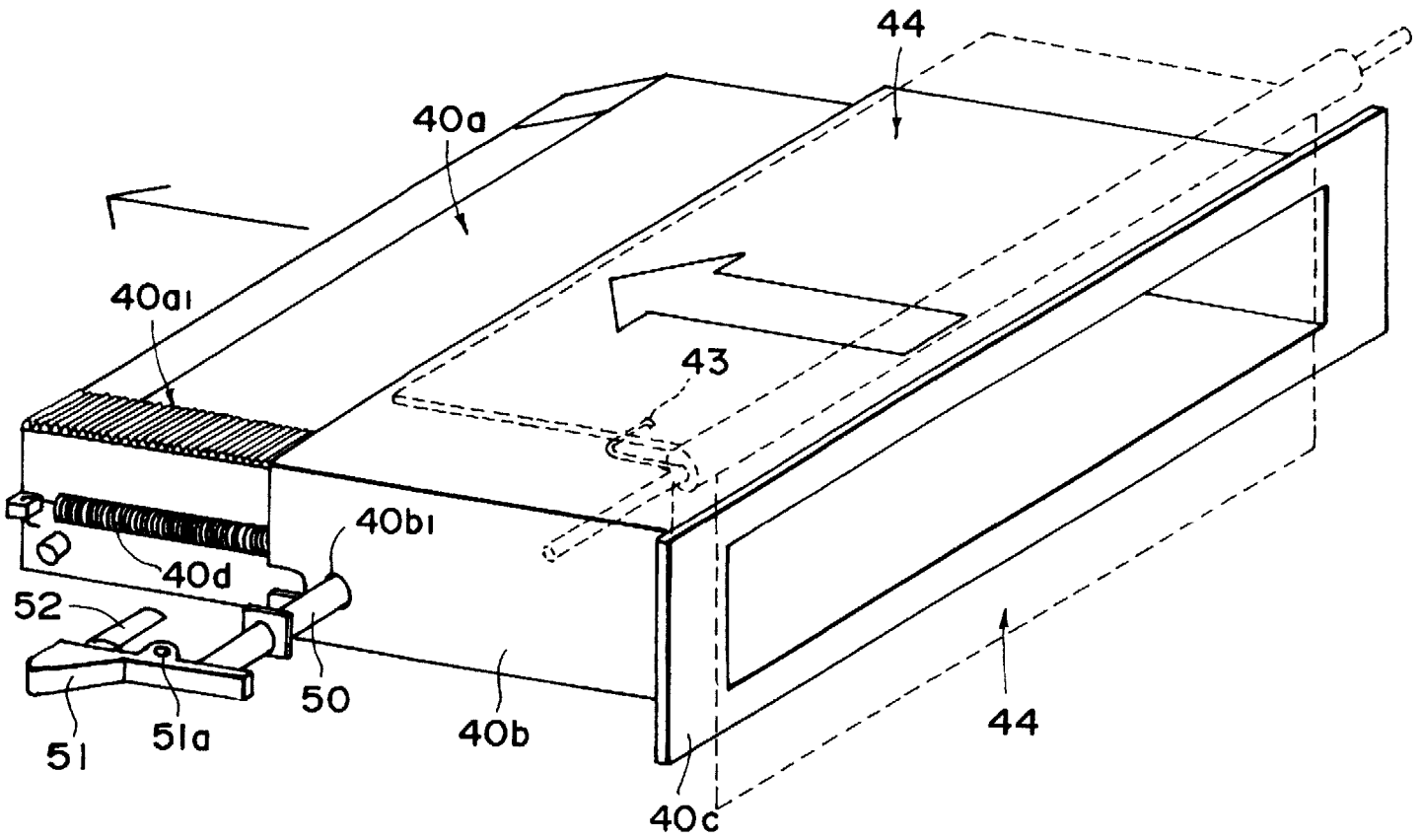
FIG. 62 depicts the structure of the image forming apparatus comprising an alternative embodiment of a pressure generating structure based on the drum shutter, and the structure of the process cartridge for such an apparatus.

In this embodiment, a process cartridge 40 shown in FIG. 61 is installed in the image forming apparatus 41 by inserting it through an inserting window 42 provided in front of the apparatus. The process cartridge 40 and image forming apparatus 41 have the same functions as those of the first embodiment, and the process cartridge 40 comprises a cartridge main assembly 40*a* and a case 40*b* which functions as the shutter mechanism.

Figure 63A:
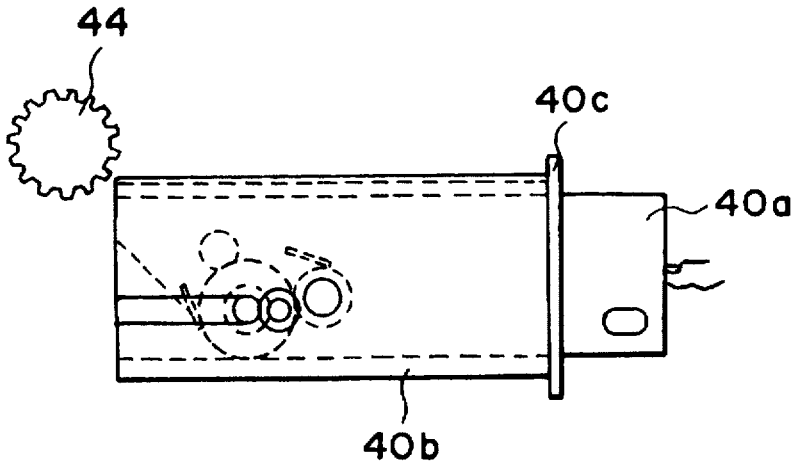
FIGS. 63(*a*) and (*b*) present a plan view and a side view, respectively of the alternative embodiment of the pressure generating structure based on the drum shutter, depicting the initial stage of the cartridge installation into the image forming apparatus.
Figure 63B:
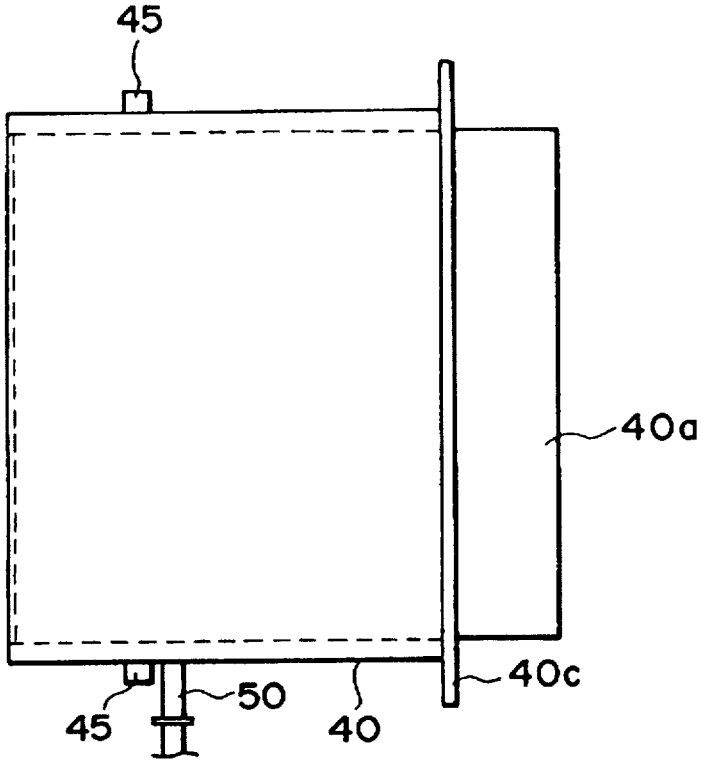

The cartridge inserting window 42 is blocked with a thin plate 44 imparted with the pressure from a spring 43 in the closing direction, and this thin plate 44 is pushed open by the process cartridge 40 to be inserted. The process cartridge 40 is inserted until its flange portion 40*c* becomes substantially level with the front surface of the image forming apparatus main assembly, as shown in FIG. 63. As the cartridge main assembly 40*a* is pushed in further, the case 40*b* remains where it is. As a result, a forward portion of the cartridge main assembly 40*a* is projected out of the process cartridge 40. Then, the projected cartridge main assembly 40*a* is detected by an unshown sensor, and a gear 44 engaged with an unshown motor begins to rotate.

Figure 64A:
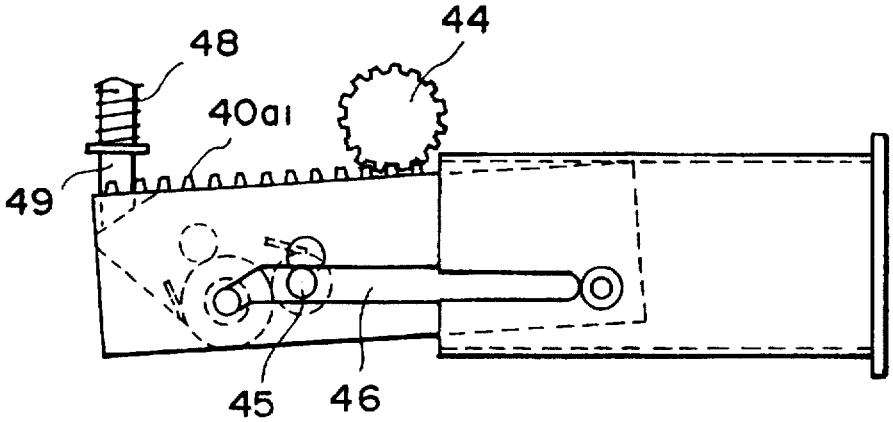
FIGS. 64(*a*) and (*b*) present a plan view and a side view respectively of the alternative embodiment of the pressure generating structure based on the drum shutter, depicting the stage at which the cartridge main assembly has been pulled out of the case.
Figure 64B:
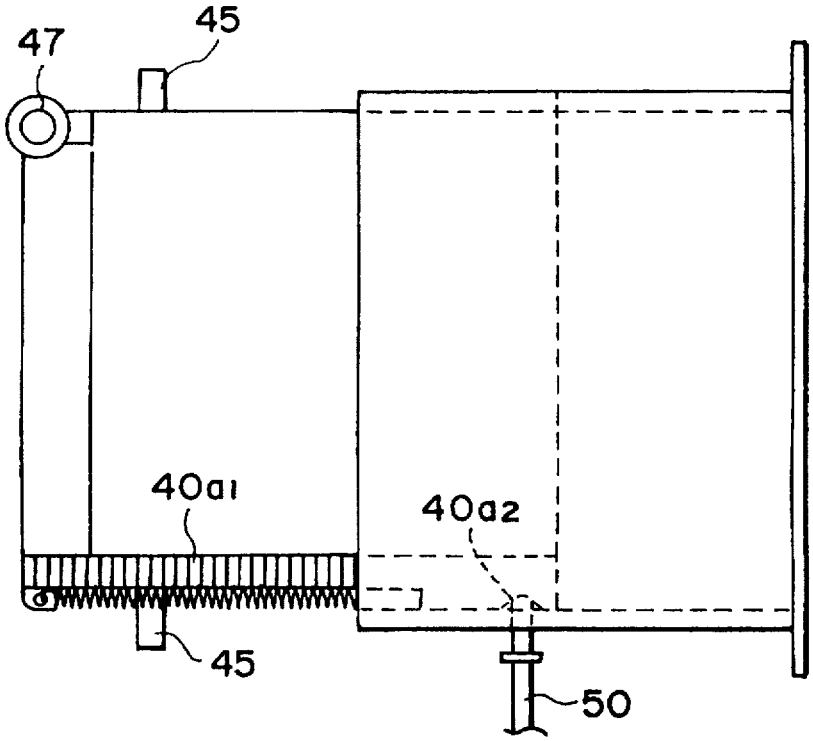

The gear 44 engages with a rack 40*a*1 provided on the top surface of the cartridge main assembly 40*a*, and the cartridge main assembly 40*a* is pulled out further from the case 40*b* by the rotation of the gear 44. At this time, an axle 45 that is the extension of the axle of the photosensitive drum contained in this cartridge main assembly engages into a guide groove 46 provided within the image forming apparatus 41, being thereby guided forward by this guide groove 46. Referring to FIG. 64, a contact 47 for making an electrical contact is provided at the rear (left side in FIG. 64) of the cartridge main assembly 40*a*. As the cartridge main assembly 40*a* is further pulled out, the contact 47 comes in contact with a contact pin 49 which is provided on the image forming apparatus 41 side and is under downward pressure from a spring 48. At this time, the cartridge main assembly 40*a* is subjected to the downward pressure from the contact pin 49, and as a result, the rear portion of the cartridge main assembly 40*a* slightly drops down along the guide groove 46.

Also, as the cartridge main assembly 40*a* is inserted, a shaft 50 provided on the image forming apparatus 41 side is projected into a hole 40*b*1 of the case 40*b*. This shaft 50 is pressured by a compression spring 52, by way of a lever 51, in the direction to be projected into the hole 40*b*1, wherein the lever 51 is exposed outward the image forming apparatus 41. When the cartridge main assembly 40*a* is further pulled out to a predetermined point, the shaft 51 drops into a concave 40*a*2 provided on the side surface of the cartridge main assembly 40*a*, whereby the cartridge main assembly 40*a* is locked at this location against the pressure of a tension spring 40*d* working to pull the cartridge main assembly 40*a* back into the case 40*b*. In other words, in this locked state, the force of the tension spring 40*d* is prevented from working to move the cartridge main assembly 40*a* out of the normal position; therefore, the process cartridge 40 is positionally stabilized in the image forming apparatus 41.

The lever 51 is pivotable about an axis 51*a*, and when a force is exerted in the direction of an arrow in FIG. 65, the shaft 51 is pushed out of the concave 40*a*2 by the pressure from the tension spring 40*d*, and the cartridge main assembly 40*a* is pulled back into the case 40*b*. During this pull-back, since the gear 44 and rack 40*a*1 remain engaged, the gear 44 serves as a damper to prevent the cartridge main assembly 40*a* from being snappingly pulled back into the case 40*b*.

After the cartridge main assembly 40*a* has been pulled back into the case 40*b*, the cartridge main assembly 40*a* protrudes a predetermined amount from the image forming apparatus 41 as shown in FIG. 63, making it easy to pull it out.

As described in the foregoing, the provision of the tension spring 40*d* with an adequate force for pulling back the cartridge main assembly 40*a* into the case 40*b*, as well as the provision of the locking mechanism make it extremely easy to take out the cartridge 40.

Further, with this arrangement in place, the installation related status of the cartridge 40 can be monitored by observing the condition of the lever 51. More specifically, referring to FIG. 66, when the process cartridge 40 is not in the image forming apparatus 41, the lever 51 looks as shown in FIG. 66(*a*); when the process cartridge 40 has been properly installed and the shaft 51 has dropped into the concave 40*a*2, it looks as shown in FIG. 66(*b*); and when the cartridge 40 has been improperly installed in the image forming apparatus 41, it looks as shown in FIG. 66(*c*).

Therefore, the installation related status of the cartridge can be determined just by observing externally the position of the lever 51.

{Electrical Component Unit}

Next, alternative embodiments for the electrical component mounting board will be described. Referring to FIG. 32, the first embodiment exemplifies a case in which the AC input portion 14*a*1 and high voltage source portion 14*a*3 are disposed on the non-driven side, and the DC power source 14*a*2 and control circuit portion 14*a*7 are disposed on the driven side, but in the some image forming apparatuses, for example, in an image forming apparatus which does not require the process cartridge B, it is unnecessary to limit the internal component arrangement to those described hereinbefore.

Figure 67:
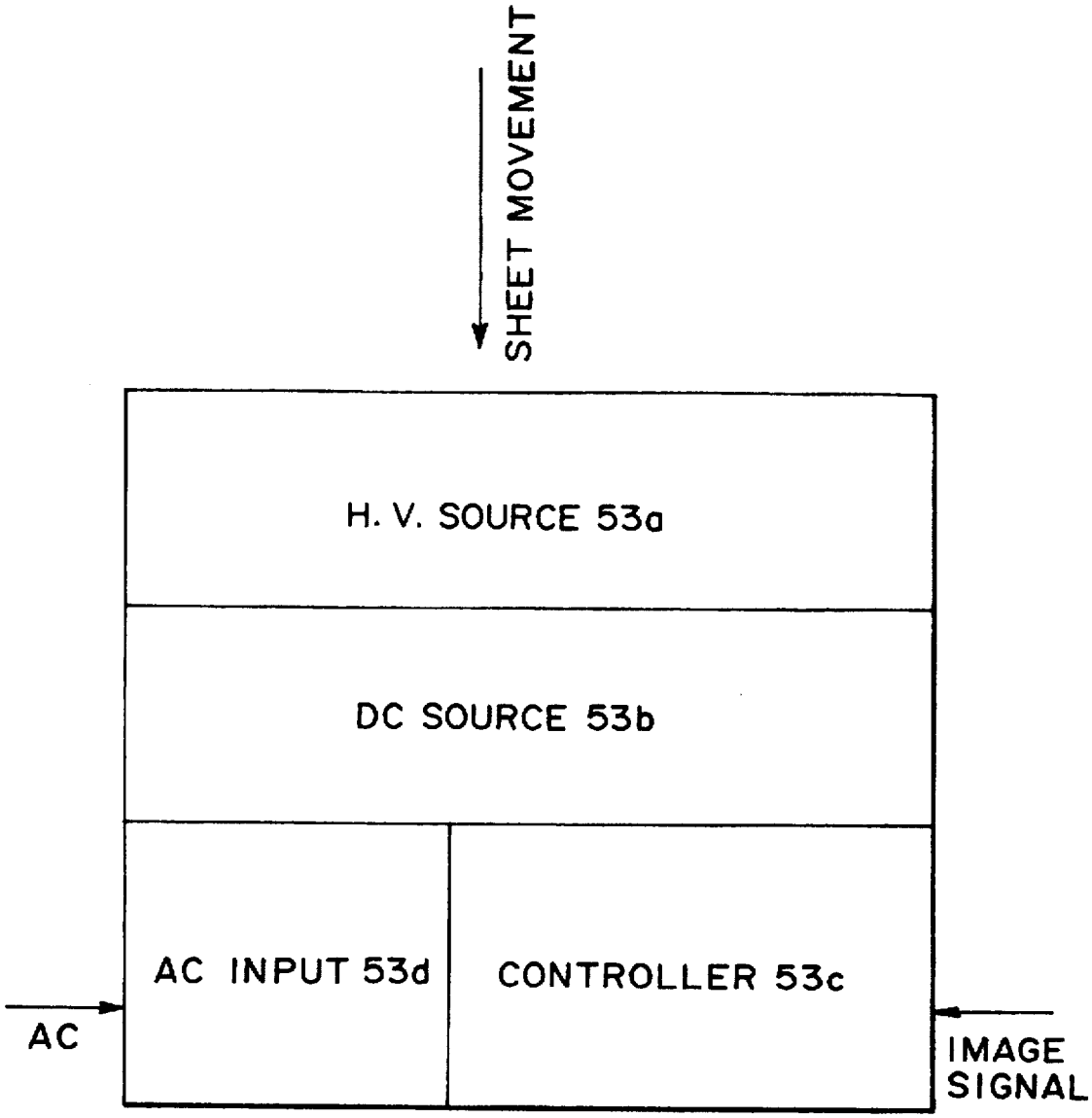
FIG. 67 is a block diagram of the electrical component mounting board for an alternative embodiment.

For example, referring to FIG. 67, when a 12 V DC and a 5 V DC are used as the DC power source, the high voltage source 53*a*, DC source 53*b*, control circuit portion 53*c*, and AC input portion 53*d* may be disposed in this order from the upstream side relative to the recording medium P conveying direction.

The reason for this arrangement is as follows. The charge bias and development bias for forming the toner image on the photosensitive drum, and the transfer bias, which are applied during the image forming operation, must have a high voltage, and these image forming members are likely to be disposed on the upstream side relative to the recording medium P conveying direction in many cases. Therefore, having the high voltage source 53*a* disposed adjacent to these members eliminates a need for long wiring, effectively preventing leakage.

The purpose of disposing the DC power source 53*b* substantially in the middle of the electrical component mounting board 53 is for using short wiring to supply the electrical power from this DC power source 53*b* to the main motor which drives the photosensitive drum or the like. More specifically, the driving force is transmitted from the main motor to the photosensitive drum, conveying roller, fixing roller, or the like, which are disposed at appropriate locations on both upstream and downstream sides of the main motor; therefore, when the main motor is disposed substantially in the middle of the apparatus, the gear train is divided into two sub-trains, one on each side, preventing thereby excessive load concentration which occurs on specific gears on the upstream side in the different type apparatuses without the gear train division. This dissipation of the load is advantageous not only from the standpoint of gear damage prevention, but also from the standpoint of maintenance of the strength of the frame on which the gear train is mounted. Further, since the gears are arranged so as for the main motor to be disposed in the middle of the gear train, greater latitude is allowed for the gear train arrangement in the front and rear direction of the apparatus, which in turn facilitates the downsizing of the apparatus. Further, the central portion of the apparatus has mechanically higher strength; therefore, it is preferable to place the main motor substantially in the center of the apparatus, which in turn renders it preferable for the DC power source 53*b*, which supplies the power to the main motor disposed substantially in the middle, to be disposed substantially in the middle of the electrical component mounting board 53.

In order for the power to be supplied from the AC input portion 53*d* to the heater of the fixing device, the AC input portion 53*d* is preferred to be disposed adjacent to the fixing device disposed at the rear portion of the apparatus. Also, in order to prevent the noises or the like, the image signal or the like is preferred to be inputted from the side opposite to the AC input portion 53*d*; therefore, the control circuit portion 53*c* for inputting the image signal or the like is preferred to be disposed on the side opposite to the AC input portion 53*d*.

Figure 68B:
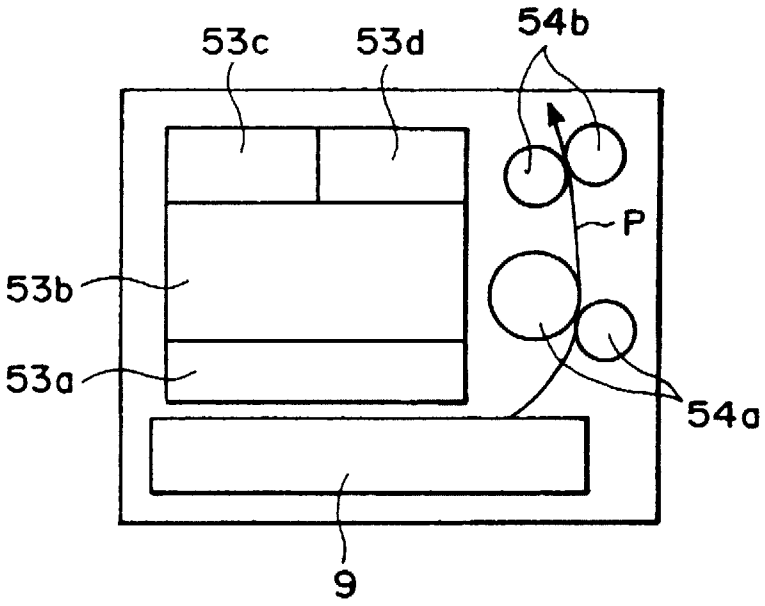
FIGS. 68(*a*) and (*b*) depict versatility of the electrical component mounting board which can be used with either an apparatus in which the recording medium P is horizontally conveyed or an apparatus in which the recording medium P is vertically conveyed.
Figure 68A:
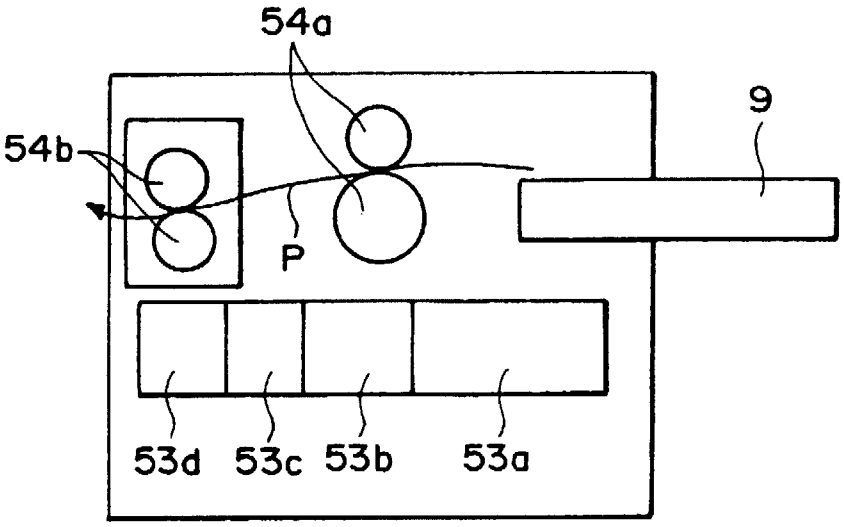

The electrical component mounting board 53 can be used with either an apparatus in which the recording medium P is horizontally conveyed by the conveying roller pair 54*a* and 54*b* as shown in FIG. 68(*a*), or an apparatus in which the recording medium P is conveyed upward from below by the conveying roller pair 54*a* and 54*b* as shown in FIG. 68(*b*).

While the first embodiment contains two boards, the electrical component mounting board 14 and image processing circuit board 22, this image processing circuit board is to be exchanged so that it matches the host computer, and conceptually speaking, it belongs to the control circuit portion within the electrical component mounting board.

(Cooling Fan)

Figure 69:
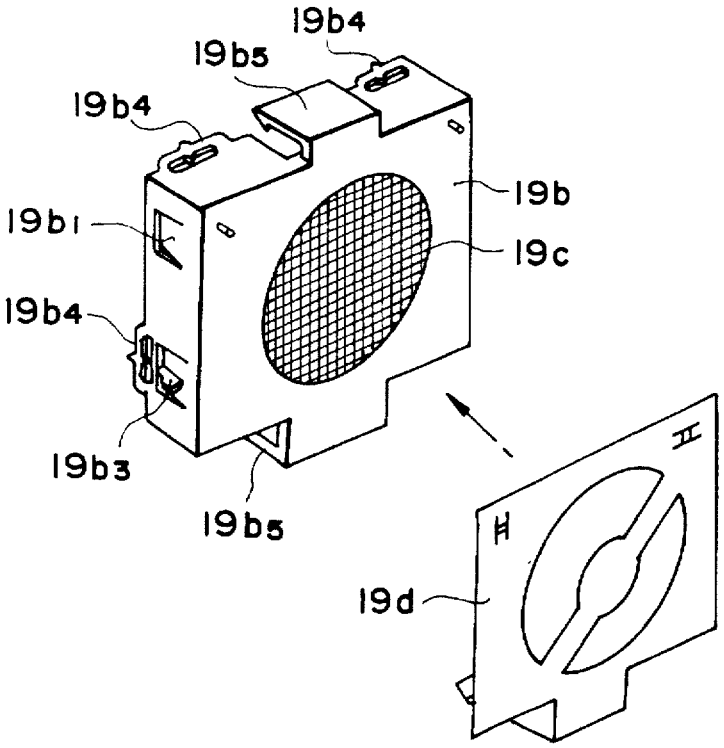
FIG. 69 is an oblique view of an alternative embodiment in which a fan cover of the cooling fan and a filter are integrally formed.
Figure 70:
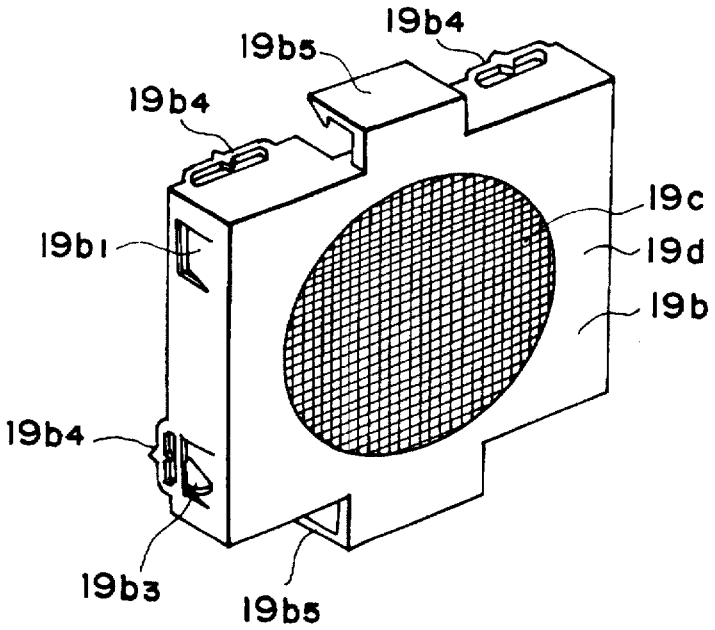
FIG. 70 is an oblique view of an alternative embodiment in which the fan cover of the cooling fan, the filter, and a shield plate are integrally formed.

Next, alternative embodiments of the cooling fan will be described. The first embodiment exemplifies a case in which the fan cover 19*b* and filter 19*c* are composed of different materials as shown in FIG. 41, but it may be structured as shown in FIGS. 69 and 70. In FIGS. 69 and 70, the components having the same function as those in the first embodiment are designated by the same symbols.

First, referring to FIG. 69, the cooling fan 19 and filter 19*c* are integrally molded of resin material with excellent fluidity. With this molding arrangement, one of the steps in the first embodiment, that is, the step in which the filter 19*c* is attached to the fan cover 19*b*, can be eliminated, and also, the component count is reduced. Therefore, the manufacturing cost can be decreased.

In the case of the cooling fan 19 illustrated in FIG. 70, the fan cover 19*b* and filter 19*c* are integrally molded of resin, and their surfaces are plated (for example, aluminum, nickel, or the like) to create integrally the shield plate 19*c*. Such a design can further reduce the number of assembly steps and the component count.

The fan cover 19*b* and filter 19*c* may be integrally molded of electrically conductive flexible resin or may be formed of springy metal (spring steel or the like) by drawing, so that the fan cover itself, being integral with the filter, can be imparted with the shielding effects. This gives the same effects as those described in the forgoing.

{Miscellaneous}

The process cartridge described hereinbefore refers to a process cartridge comprising an electrophotographic photosensitive member or the like as the image bearing member and at least one processing means. However, many other cartridge designs are possible beside those of the embodiments described hereinbefore. For example, the process cartridge is available in the form of an exchangeable process cartridge in which: an image bearing member and a charging means are integrally assembled; an image bearing member and a developing means are integrally assembled; or an image bearing member and a cleaning means are integrally assembled. Further, the process cartridge is also available in the form of an exchangeable process cartridge in which an image bearing member and two or more processing means are integrally assembled.

In other words, the process cartridge described hereinbefore refers to an exchangeable process cartridge for an image forming apparatus, comprising a charging means, developing means, and cleaning means, which are integrally assembled with an electrophotographic photosensitive member, in the form of a cartridge; comprising at least one of a charging means, developing means, and cleaning means, which are integrally assembled with an electrophotographic photosensitive member, in the form of a cartridge;

or comprising at least a developing means, which is integrally assembled with an electrophotographic photosensitive member, in the form of a cartridge.

During the descriptions of the embodiments of the present invention, a laser beam printer is selected as an example of the image forming apparatus, but the present invention is not limited by this choice. It is needless to say that the present invention is applicable to many other image forming apparatuses such as an electrophotographic copying machine, facsimile apparatus, LED printer, word processor, or the like.

According to the embodiments described above, the means is provided which urges the process cartridge when the member is closed, and which releases the urging of the process cartridge when the member is opened. Accordingly, the cartridge can be inserted without being subjected to the load by the urging means. Therefore, the process cartridge can be mounted without damage thereto.

Since the process cartridge is directly inserted into the main assembly, there is no need of provision of an optical path to the openable member, by which the structure of the openable member can be simplified.

By the provision of the means for urging the process cartridge in the upward direction, even if the pressure angle of engagement between the drum and the driving gear is directed downwardly beyond a horizontal line, the process cartridge is raised upwardly upon opening of the member, so that the engagement of the gear can be easily released. For this reason, the driving gear does not require the one-way clutch or the like, and therefore, the number of parts can be reduced.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image on a recording material, wherein a process cartridge is detachably mountable to said image forming apparatus, and wherein said process cartridge comprises an electrophotographic photosensitive member and process means, said apparatus comprising:

a main assembly;

mounting means, in said main assembly, for detachably mounting said process cartridge;

an openable cover movable relative to said main assembly, wherein said cover is openable so that said process cartridge may be mounted to said mounting means;

first urging means, provided in said cover, for elastically urging said process cartridge so as to position said process cartridge at a positioning portion in said mounting means;

second urging means, provided in said main assembly, for elastically urging said process cartridge so as to position said process cartridge at the positioning portion in said mounting means; and feeding means for feeding the recording material.

2. An apparatus according to claim 1, wherein said first urging means is disposed on an inner side of said cover, and said first urging means comprises a buffer spring and an urging member at an end of said buffer spring, wherein said first urging means elastically urges a first top surface of said process cartridge through said first urging member when said cover is closed.

3. An apparatus according to claim 2, wherein said process means comprises developing means for developing with a toner a latent image on said photosensitive member which is in the form of a drum, wherein said first top surface is at a portion closer to said developing means than said photosensitive member, and wherein said process cartridge is moved to said mounting means with said portion at a trailing side, when said process cartridge is mounted.

4. An apparatus according to claim 1 or 14, wherein said second urging means is provided on a frame of said main assembly, and said second urging means comprises a leaf spring, wherein said second urging means is urged by an urging portion of said cover when said cover is closed, so that a second top surface is elastically urged by said leaf spring.

5. An apparatus according to claim 4, wherein said process means comprises cleaning means for removing residual toner from said photosensitive member, wherein said second top surface is at a portion closer to said cleaning means than said photosensitive member, and wherein said process cartridge is moved to said mounting means with said portion closer to said cleaning means at a leading side, when said process cartridge is mounted.

6. An apparatus according to claim 5, wherein a distance between a fulcrum and an acting point where said leaf spring is urged by said cover is longer than a distance between the fulcrum and an application point for applying force to said second top surface.

7. An apparatus according to claim 4, wherein a distance between a fulcrum and an acting point where said leaf spring is urged by said cover is longer than a distance between the fulcrum and an application point for applying force to said second top surface.

8. An apparatus according to claim 7, further comprising a guide for guiding said process cartridge to said positioning portion, said positioning portion comprising a groove, and said guide and said groove being disposed to accommodate opposite ends of said process cartridge.

9. An apparatus according to claim 8, wherein a projection, extending outwardly from a cartridge frame in a direction coaxial with said photosensitive member which is in the form of a drum in said process cartridge, fits into said groove, and wherein said projection is guided by said guide when said process cartridge is moved to said groove.

10. An apparatus according to claim 8, wherein a sum of downward forces on said process cartridge is larger than a sum of upward forces, and wherein the downward forces include forces provided by said first urging means and said second urging means.

11. An apparatus according to claim 10, wherein the downward forces include a weight of said process cartridge, and a force provided by rotation of a gear in said main assembly for rotating said photosensitive member in said process cartridge, and wherein said upward forces include a force provided by a spring for urging an image transfer roller in said main assembly to said photosensitive member, a force provided by a contact spring in said main assembly for urging an electric contact, and a force provided by a spring for urging a drum shutter for protecting said photosensitive member in a closing direction.

12. An apparatus according to claim 8, wherein said cover is capable of being closed and opened relative to an outer cover on said main assembly.

13. An apparatus according to claim 4, further comprising a guide for guiding said process cartridge to said positioning portion, said positioning portion comprising a groove, and said guide and said groove being disposed to accommodate opposite ends of said process cartridge.

14. An apparatus according to claim 13, wherein a projection, extending outwardly from a cartridge frame in a direction coaxial with said photosensitive member which is in the form of a drum in said process cartridge, fits into said groove, and wherein said projection is guided by said guide when said process cartridge is moved to said groove.

15. An apparatus according to claim 13, wherein a sum of downward forces on said process cartridge is larger than a sum of upward forces, and wherein the downward forces include forces provided by said first urging means and said second urging means.

16. An apparatus according to claim 15, wherein the downward forces include a weight of said process cartridge, and a force provided by rotation of a gear in said main assembly for rotating said photosensitive member in said process cartridge, and wherein said upward forces include a force provided by a spring for urging an image transfer roller in said main assembly to said photosensitive member, a force provided by a contact spring in said main assembly for urging an electric contact, and a force provided by a spring for urging a drum shutter for protecting said photosensitive member in a closing direction.

17. An apparatus according to claim 13, wherein said cover is capable of being closed and opened relative to an outer cover on said main assembly.

18. An apparatus according to claims 1 or 14, further comprising a guide for guiding said process cartridge to said positioning portion, said positioning portion comprising a groove, and said guide and said groove being disposed to accommodate opposite ends of said process cartridge.

19. An apparatus according to claim 18, wherein a projection, extending outwardly from a cartridge frame in a direction coaxial with said photosensitive member which is in the form of a drum in said process cartridge, fits into said groove, and wherein said projection is guided by said guide when said process cartridge is moved to said groove.

20. An apparatus according to claim 18, wherein a sum of downward forces on said process cartridge is larger than a sum of upward forces, and wherein the downward forces include forces provided by said first urging means and said second urging means.

21. An apparatus according to claim 20, wherein the downward forces include a weight of said process cartridge, and a force provided by rotation of a gear in said main assembly for rotating said photosensitive member in said process cartridge, and wherein said upward forces include a force provided by a spring for urging an image transfer roller in said main assembly to said photosensitive member, a force provided by a contact spring in said main assembly for urging an electric contact, and a force provided by a spring for urging a drum shutter for protecting said photosensitive member in a closing direction.

22. An apparatus according to claim 18, wherein said cover is capable of being closed and opened relative to an outer cover on said main assembly.

23. An apparatus according to claim 1, wherein a sum of downward forces on said process cartridge is larger than a sum of upward forces, and wherein the downward forces include forces provided by said first urging means and said second urging means.

24. An apparatus according to claim 23, wherein the downward forces include a weight of said process cartridge, and a force provided by rotation of a gear in said main assembly for rotating said photosensitive member in said process cartridge, and wherein said upward forces include a force provided by a spring for urging an image transfer roller in said main assembly to said photosensitive member, a force provided by a contact spring in said main assembly for urging an electric contact, and a force provided by a spring for urging a drum shutter for protecting said photosensitive member in a closing direction.

25. An apparatus according to claim 1, wherein said cover is capable of being closed and opened relative to an outer cover on said main assembly.

26. An apparatus according to claim 1, wherein said main assembly includes optical means for projecting a laser beam, in accordance with image information, onto said photosensitive member, image transfer means for transferring a toner image from said photosensitive member to the recording material, and fixing means for fixing the toner image on the recording material.

27. An apparatus according to claim 1, wherein said process cartridge integrally contains said process means comprising charging means, developing means, and cleaning means, and said electrophotographic photosensitive member as an image bearing member.

28. An apparatus according to claim 1, wherein said process cartridge integrally contains said process means comprising at least one of charging means and cleaning means, and said electrophotographic photosensitive member as an image bearing member.

29. An apparatus according to claim 1, wherein the process cartridge integrally contains said process means comprising developing means and said electrophotographic photosensitive member as an image bearing member.

30. An image forming apparatus for forming an image on a recording material, wherein a process cartridge is detachably mountable to said image forming apparatus, and wherein said process cartridge comprises an electrophotographic photosensitive drum, developing means for developing, at a developing station, a latent image on said photosensitive drum with toner, and cleaning means for removing, at a cleaning station, toner from said photosensitive drum, said apparatus comprising:

a main assembly;

mounting means, in said main assembly, for detachably mounting said process cartridge, said mounting means including a guiding portion and a positioning portion for positioning the process cartridge;

an openable cover movable relative to said main assembly, wherein said cover is rotatable about one end thereof relative to said main assembly, and said cover is rotatable upward to open so that said process cartridge may be mounted to said mounting means;

a first spring, provided in said cover, for elastically urging a first top surface of said process cartridge so as to position said process cartridge at said positioning portion in said mounting means, wherein said first top surface is adjacent a trailing side of said process cartridge with respect to a mounting direction of said process cartridge;

a second spring, provided in said main assembly, for elastically urging a second top surface of said process cartridge so as to position said process cartridge at said positioning portion in said mounting means, wherein said second top surface is adjacent a leading side of said process cartridge with respect to the mounting direction of said process cartridge;

feeding means for feeding the recording material, wherein said cleaning station is adjacent said leading side, and said developing station is adjacent said trailing side.

31. An apparatus according to claim 30, wherein said first spring has an urging member on an end thereof, and said first spring elastically urges the first top surface of said process cartridge through said urging member when said cover is closed.

32. An apparatus according to claim 30 or 31, wherein said second spring is provided on a frame of said main assembly, and said second spring comprises a leaf spring, and wherein said second spring is urged by an urging portion of said cover to elastically urge said second top surface of said process cartridge.

33. An apparatus according to claim 32, wherein a distance between a fulcrum and an acting point where said leaf spring is urged by said cover is longer than a distance between the fulcrum and an application point for applying force to said second top surface.

34. An apparatus according to claim 32, wherein said positioning portion comprises a groove, and said guiding portion and said groove are provided in said main assembly to accommodate opposite ends of said process cartridge.

35. An apparatus according to claim 34, wherein a projection, extending outwardly from a process cartridge frame in a direction coaxial with said photosensitive drum in said process cartridge, fits into said groove in said main assembly, and wherein said projection is guided by said guiding portion when said process cartridge is moved to said positioning portion.

36. An apparatus according to claim 35, wherein a sum of downward forces applied to said process cartridge is larger than a sum of upward forces, and wherein the downward forces include forces provided by said first spring and second spring.

37. An apparatus according to claim 36, wherein the downward forces include a weight of said process cartridge, and a force provided by rotation of a gear in said main assembly for rotating said photosensitive drum in said process cartridge, and wherein said upward forces include a force provided by a spring for urging an image transfer roller in said main assembly to said photosensitive drum, a force provided by a contact spring in said main assembly for urging an electric contact, and a force provided by a spring for urging a drum shutter for protecting said photosensitive drum in a closing direction.

38. An apparatus according to claim 37, wherein said cover is capable of being closed and opened relative to an outer cover on said main assembly.

39. An apparatus according to claim 30 or 31, wherein said positioning portion comprises a groove, and said guiding portion and said groove are provided in said main assembly to accommodate opposite ends of said process cartridge.

40. An apparatus according to claim 39, wherein a projection, extending outwardly from a process cartridge frame in a direction coaxial with said photosensitive drum in said process cartridge, fits into said groove in said main assembly, and wherein said projection is guided by said guiding portion when said process cartridge is moved to said positioning portion.

41. An apparatus according to claim 40, wherein a sum of downward forces applied to said process cartridge is larger than a sum of upward forces, and wherein the downward forces include forces provided by said first spring and second spring.

42. An apparatus according to claim 41, wherein the downward forces include a weight of said process cartridge, and a force provided by rotation of a gear in said main assembly for rotating said photosensitive drum in said process cartridge, and wherein said upward forces include a force provided by a spring for urging an image transfer roller in said main assembly to said photosensitive drum, a force provided by a contact spring in said main assembly for urging an electric contact, and a force provided by a spring for urging a drum shutter for protecting said photosensitive drum in a closing direction.

43. An apparatus according to claim 42, wherein said cover is capable of being closed and opened relative to an outer cover on said main assembly.

44. An apparatus according to claim 30, wherein a sum of downward forces applied to said process cartridge is larger than a sum of upward forces, and wherein the downward forces include forces provided by said first spring and second spring.

45. An apparatus according to claim 44, wherein the downward forces include a weight of said process cartridge, and a force provided by rotation of a gear in said main assembly for rotating said photosensitive drum in said process cartridge, and wherein said upward forces include a force provided by a spring for urging an image transfer roller in said main assembly to said photosensitive drum, a force provided by a contact spring in said main assembly for urging an electric contact, and a force provided by a spring for urging a drum shutter for protecting said photosensitive drum in a closing direction.

46. An apparatus according to claim 45, wherein said cover is capable of being closed and opened relative to an outer cover on said main assembly.

47. An apparatus according to claim 30, wherein said cover is capable of being closed and opened relative to an outer cover on said main assembly.

48. An apparatus according to claim 30, wherein said main assembly includes optical means for projecting a laser beam, in accordance with image information, onto said photosensitive drum, image transfer means for transferring a toner image from said photosensitive drum to the recording material, and fixing means for fixing the toner image on the recording material.

49. An image forming apparatus for forming an image on a recording material, wherein a process cartridge is detachably mountable to said image forming apparatus, and wherein said process cartridge comprises an electrophotographic photosensitive drum, a developing roller for developing a latent image on said photosensitive drum with toner, a cleaning blade for removing toner from said photosensitive drum, a charging roller for charging said photosensitive drum, a drum shutter, and a shutter spring for urging said drum shutter to a protection position thereof, said apparatus comprising:

a main assembly;

a mounting member, in said main assembly, for detachably mounting said process cartridge, said mounting member comprising a guiding portion and a positioning portion for positioning the process cartridge;

an openable cover movable relative to said main assembly, wherein said cover is rotatable about one end thereof relative to said main assembly, and said cover is rotatable upward to open so that said process cartridge may be mounted to said mounting member;

a first spring, provided in said cover, for elastically urging a first top surface of said process cartridge so as to position said process cartridge at said positioning portion in said mounting member, wherein said first top surface is adjacent a trailing side of said process cartridge with respect to a mounting direction of said process cartridge;

a leaf spring, provided in said main assembly, for elastically urging a second top surface of said process cartridge so as to position said process cartridge at said positioning portion in said mounting member, wherein said second top surface is adjacent a leading side of said process cartridge with respect to the mounting direction of said process cartridge, wherein said leaf spring is urged by an urging portion of said cover when said cover is closed, and wherein a distance between a fulcrum and an acting point where said leaf spring is urged by said cover is longer than a distance between the fulcrum and an application point for applying force to said second top surface;

a developing bias contact, in said main assembly, for supplying electric power to said developing roller in said process cartridge, said developing bias contact being upwardly urged by a developing bias contact spring;

a charging voltage contact, in said main assembly, for supplying electric power to said charging roller in said process cartridge, said charging voltage contact being upwardly urged by a charging voltage contact spring;

laser beam projecting means for projecting a laser beam onto said photosensitive drum in said process cartridge mounted to said mounting member;

an image transfer roller for transferring a toner image, formed on said photosensitive drum in said process cartridge, from said photosensitive drum in said process cartridge onto the recording material;

a spring for urging said transfer roller to said photosensitive drum;

image fixing means for fixing the toner image on the recording material; and a gear for transmitting a driving force for rotating said photosensitive drum in said process cartridge mounted to said mounting member, wherein said cleaning blade is adjacent said leading side, and said developing roller is adjacent said trailing side.

50. An apparatus according to claim 49, wherein said first spring comprises an urging member at an end thereof, and said first spring elastically urges the first top surface of said process cartridge through said urging member when said cover is closed.

51. An apparatus according to claims 49 or 50, wherein a projection, extending outwardly from a cartridge frame in a direction coaxial with said photosensitive drum in said process cartridge, fits into said positioning portion, said projection being guided by said guiding portion when said process cartridge is moved onto said mounting member.

52. An apparatus according to claim 51, wherein a sum of downward forces applied to said process cartridge is larger than a sum of upward forces, and wherein the downward forces include forces exerted by said first spring and said leaf spring.

53. An apparatus according to claim 52, wherein the downward forces include a weight of said process cartridge, and a force provided by rotation of a gear in said main assembly for rotating said photosensitive drum in said process cartridge, and wherein said upward forces include a force provided by said spring for urging said image transfer roller in said main assembly to said photosensitive drum, forces provided by said developing bias contact spring and said charging voltage contact spring in said main assembly, and a force provided by a spring for urging a drum shutter for protecting said photosensitive drum in a closing direction.

54. An apparatus according to claim 52, wherein said cover is capable of being closed and opened relative to an outer cover on said main assembly.

55. An apparatus according to claim 49, wherein a sum of downward forces applied to said process cartridge is larger than a sum of upward forces, and wherein the downward forces include forces exerted by said first spring and said leaf spring.

56. An apparatus according to claim 55, wherein the downward forces include a weight of said process cartridge, and a force provided by rotation of a gear in said main assembly for rotating said photosensitive drum in said process cartridge, and wherein said upward forces include a force provided by said spring for urging said image transfer roller in said main assembly to said photosensitive drum, forces provided by said developing bias contact spring and said charging voltage contact spring in said main assembly and a force provided by a spring for urging a drum shutter for protecting said photosensitive drum in a closing direction.

57. An apparatus according to claim 49 or 53, wherein said cover is capable of being closed and opened relative to an outer cover on said main assembly.

* * * * *

UNITED STATES PATENT AND TRADEMARK OFFICE

CERTIFICATE OF CORRECTION

PATENT NO. : 5,787,323

DATED : July 28, 1998

INVENTOR(S) : YOSHIYA NOMURA ET AL.

It is certified that error appears in the above-identified patent and that said Letters Patent is hereby corrected as shown below:

SHEET 32

"PRCESSER" should read --PROCESSOR--.

COLUMN 4

Line 9, "is," should read --is--.
Line 25, "respectively" should read --respectively,--.
Line 29, "view" should read --view,--.

COLUMN 5

Lines 7-8, "electrophotographically" should read --electrophotographic--.

COLUMN 9

Line 24, "other" should read --the other--.

COLUMN 11

Line 11, "lift" should read --lifted--.

COLUMN 12

Line 66, "force is." should read --force.--.

UNITED STATES PATENT AND TRADEMARK OFFICE

CERTIFICATE OF CORRECTION

PATENT NO. : 5,787,323

DATED : July 28, 1998

INVENTOR(S) : YOSHIYA NOMURA ET AL.

It is certified that error appears in the above-identified patent and that said Letters Patent is hereby corrected as shown below:

COLUMN 13

Line 45, "and a" should read --and an--.
Line 55, "axis" should read --axes--.

COLUMN 14

Line 31, "open it" should read --it open--.

COLUMN 15

Line 11, "pressuring" (both occurrences) should read --pressing--.
Line 13, "mediums" should read --media--.

COLUMN 16

Line 5, "10b," should read --10d1,--.

COLUMN 17

Line 64, "follow-" should read --in the follow---.

COLUMN 21

Line 3, "transmits" should read --transmit--.

UNITED STATES PATENT AND TRADEMARK OFFICE

CERTIFICATE OF CORRECTION

PATENT NO. : 5,787,323

DATED : July 28, 1998

INVENTOR(S) : YOSHIYA NOMURA ET AL.

It is certified that error appears in the above-identified patent and that said Letters Patent is hereby corrected as shown below:

COLUMN 23

Line 22, "gear" should read --gears--.

COLUMN 24

Line 27, "shielding. (Electrical Component Unit)" should read --shielding. ¶ (Electrical Component Unit)--.

COLUMN 26

Line 52, "pints." should read --pins.--.

COLUMN 27

Line 38, "pins" should read --pin--.
Line 62, "mains" should read --main--.

COLUMN 28

Line 32, "24" should read --24d--; and "becomes" should read --become--.

COLUMN 29

Line 30, "elastically" should read --be elastically--.
Line 51, "with a" should read --with--.

UNITED STATES PATENT AND TRADEMARK OFFICE

CERTIFICATE OF CORRECTION

PATENT NO. : 5,787,323

DATED : July 28, 1998

INVENTOR(S) : YOSHIYA NOMURA ET AL.

It is certified that error appears in the above-identified patent and that said Letters Patent is hereby corrected as shown below:

COLUMN 33

Line 13, "Depths:" should read --Depth:--.
Line 18, "the a" should read --a--.
Line 26, "αllowing" should read --allowing--.

COLUMN 34

Line 62, "the something" should read --something--.

COLUMN 36

Line 2, "13 are" should read --13 is--.

COLUMN 38

Line 20, "i f" should read --1,--.
Line 57, "f the" should read --of the--.

COLUMN 43

Line 11, "in the" should read --in--.

COLUMN 44

Line 42, "forgoing" should read --foregoing--.
Line 48, "beside" should read --besides--.

UNITED STATES PATENT AND TRADEMARK OFFICE

CERTIFICATE OF CORRECTION

PATENT NO. : 5,787,323

DATED : July 28, 1998

INVENTOR(S) : YOSHIYA NOMURA ET AL.

It is certified that error appears in the above-identified patent and that said Letters Patent is hereby corrected as shown below:

COLUMN 46

Line 8, "14," should read --2,--.

COLUMN 47

Line 26, "14," should read --2,--.

COLUMN 52

Line 37, "assembly" should read --assembly,--.

Signed and Sealed this

Sixth Day of April, 1999

*Attest:*

*Attesting Officer*

Q. TODD DICKINSON

*Acting Commissioner of Patents and Trademarks*